US011592193B2

(12) United States Patent
Onaka et al.

(10) Patent No.: US 11,592,193 B2
(45) Date of Patent: Feb. 28, 2023

(54) AIR-CONDITIONING APPARATUS AND METHOD OF USING AIR-CONDITIONING APPARATUS

(71) Applicant: Mitsubishi Electric Corporation, Tokyo (JP)

(72) Inventors: Yoji Onaka, Chiyoda-ku (JP); Takashi Matsumoto, Chiyoda-ku (JP); Kosuke Miyawaki, Chiyoda-ku (JP); Hiroyuki Okano, Chiyoda-ku (JP); Takanori Koike, Chiyoda-ku (JP); Takeshi Hatomura, Chiyoda-ku (JP); Osamu Morimoto, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 31 days.

(21) Appl. No.: 17/353,862

(22) Filed: Jun. 22, 2021

(65) Prior Publication Data

US 2021/0310672 A1 Oct. 7, 2021

Related U.S. Application Data

(62) Division of application No. 16/319,721, filed as application No. PCT/JP2016/076786 on Sep. 12, 2016, now abandoned.

(51) Int. Cl.
*F28D 1/02* (2006.01)
*F24F 1/14* (2011.01)
(Continued)

(52) U.S. Cl.
CPC ..... *F24F 1/14* (2013.01); *F25B 1/00* (2013.01); *F25B 1/005* (2013.01); *F25B 39/00* (2013.01); *F25B 39/02* (2013.01); *F28F 9/02* (2013.01)

(58) Field of Classification Search
CPC .... F24F 1/14; F25B 1/00; F25B 1/005; F25B 39/00; F28F 9/02
(Continued)

(56) References Cited

U.S. PATENT DOCUMENTS

2014/0048494 A1* 2/2014 Simmons, Jr. ..... B01F 23/23 210/150
2015/0027672 A1* 1/2015 Jindou ..... F25B 39/028 62/526
(Continued)

FOREIGN PATENT DOCUMENTS

JP 5626254 B2 11/2014
WO 2015/178097 A1 11/2015

OTHER PUBLICATIONS

International Search Report dated Dec. 6, 2016 in PCT/JP2016/076786 filed Sep. 12, 2016.
(Continued)

*Primary Examiner* — Claire E Rojohn, III
(74) *Attorney, Agent, or Firm* — Xsensus LLP

(57) ABSTRACT

A header includes a plurality of branch tubes and a header manifold. If refrigerant flowing into the header manifold forms a pattern of annular flow or churn flow, tips of the branch tubes inserted into the header manifold pass through a liquid-phase portion having a thickness δ [m] and reach a gas-phase portion. The thickness δ [m] of the liquid-phase portion is defined as $\delta = G \times (1-x) \times D/(4\rho_L \times U_{LS})$, where G is a flow speed [kg/(m$^2$ s)] of the refrigerant, x is a quality of the refrigerant, D is an inside diameter [m] of the header manifold, $\rho_L$ is a liquid density [kg/m$^3$] of the refrigerant, $U_{LS}$ is a reference apparent liquid speed [m/s] that is a maximum value within a range of variation in an apparent gas speed of the refrigerant flowing into a flow space of the
(Continued)

header manifold. The reference apparent liquid speed $U_{LS}$ [m/s] is defined as $G(1-x)/\rho_L$.

64 Claims, 32 Drawing Sheets

(51) Int. Cl.
*F28F 9/02* (2006.01)
*F25B 39/00* (2006.01)
*F25B 1/00* (2006.01)
*F25B 39/02* (2006.01)

(58) Field of Classification Search
USPC ..... 165/153
See application file for complete search history.

(56) References Cited

U.S. PATENT DOCUMENTS

2016/0355717 A1* 12/2016 Fukushima ..... F25B 43/00
2017/0082332 A1* 3/2017 Onaka ..... F25B 1/00
2019/0234626 A1* 8/2019 Onaka ..... F25B 1/005
2020/0041178 A1* 2/2020 Onaka ..... F28F 9/02

OTHER PUBLICATIONS

Ho-Won Byun, et al., "Two-phase refrigerant distribution in an intermediate header of a parallel flow minichannel heat exchanger," International Journal of Refrigeration, vol. 59, 2015, pp. 14-28.
Yang Zou, et al., "Effects of fluid properties on two-phase flow and refrigerant distribution in the vertical header of a reversible microchannel heat exchanger—Comparing R245fa, R134a, R410A, and R32," Applied Thermal Engineering, vol. 70, 2014, pp. 966-976.

* cited by examiner

AIR-CONDITIONING APPARATUS AND METHOD OF USING AIR-CONDITIONING APPARATUS

CROSS-REFERENCE TO RELATED APPLICATIONS

This application is a Divisional of U.S. application Ser. No. 16/319,721, filed Jan. 22, 2019, which is based on PCT filing PCT/JP2016/076786, filed Sep. 12, 2016, the entire contents of each are incorporated herein by reference.

TECHNICAL FIELD

The present invention relates to a header in which refrigerant is distributed from a header manifold to a plurality of branch tubes, and also relates to a heat exchanger and an air-conditioning apparatus.

BACKGROUND ART

In a known air-conditioning apparatus, liquid refrigerant that is condensed by a heat exchanger serving as a condenser included in an indoor unit is depressurized by an expansion valve and falls into a gas-liquid two-phase state, which is a mixture of gas refrigerant and liquid refrigerant. The gas-liquid two-phase refrigerant flows into a heat exchanger serving as an evaporator included in an outdoor unit.

When the gas-liquid two-phase refrigerant flows into the heat exchanger serving as an evaporator, the performance of refrigerant distribution to that heat exchanger is deteriorated. Hence, as a method for improving the performance of refrigerant distribution, a header is employed as a distributor for the heat exchanger included in the outdoor unit, and the header is provided thereinside with a structural element, such as a partition, an ejection port, or the like.

However, in the header including any additional structural element provided as described above, the degree of improvement in the distribution performance is low, despite a significant cost increase. Moreover, the pressure loss in the header significantly increases, causing a reduction in energy efficiency. Furthermore, in an outdoor unit of an air-conditioning apparatus, a greater volume of air flows in an area that is nearer to a fan. Therefore, if a larger amount of refrigerant is distributed to a lower part of the header, which is farther from the fan than an upper part of the header is to the header, the performance of refrigerant distribution and the performance of the heat exchanger are deteriorated further, causing a further reduction in energy efficiency.

To overcome the above problems, there is a proposal of a technique in which a heat exchanger of an outdoor unit is divided into upper and lower parts, and the diameter of a header manifold connected to one of the heat exchangers that is nearer to a fan and receives a greater volume of air is made smaller than the diameter of a header manifold connected to the other heat exchanger that is farther from the fan and receives a smaller volume of air (see Patent Literature 1, for example). In the technique according to Patent Literature 1, a larger amount of liquid refrigerant can be distributed to the upper part of the header.

There is another proposal of a technique in which the length of insertion of branch tubes into a header manifold is adjusted (see Patent Literature 2, for example). In the technique according to Patent Literature 2, the performance of refrigerant distribution is improved by changing the flow resistance in the header manifold.

CITATION LIST

Patent Literature

Patent Literature 1: International Publication No. 2015/178097

Patent Literature 2: Japanese Patent No. 5626254

SUMMARY OF INVENTION

Technical Problem

The known techniques according to Patent Literature 1 and Patent Literature 2 depend on the refrigerant flow rate or the refrigerant speed. Therefore, the improvement in the performance of refrigerant distribution by using the header cannot be realized unless the range of the refrigerant flow rate or the refrigerant speed is limited and narrow. Hence, in a practical case where the air-conditioning apparatus is operated at a refrigerant flow rate that varies with the environmental load, there is a problem in that the improvement in the performance of refrigerant distribution by using the header cannot be realized depending on operating conditions.

The present invention is to overcome the above problem and provides a header that costs less with a simplified configuration and exhibits improved performance of refrigerant distribution from a header manifold to a plurality of branch tubes over a wide operating range, thereby improving the energy efficiency, and also provides a heat exchanger and an air-conditioning apparatus.

Solution to Problem

A header of an embodiment of the present invention includes a plurality of branch tubes, and a header manifold having a flow space that communicates with the plurality of branch tubes and in which gas-liquid two-phase refrigerant flows upward and is discharged into the plurality of branch tubes. If the refrigerant flowing into the header manifold forms a pattern of annular flow or churn flow, tips of the branch tubes inserted into the header manifold pass through a liquid-phase portion having a thickness δ [m] and reach a gas-phase portion.

The thickness δ [m] of the liquid-phase portion is defined as $\delta = G \times (1-x) \times D/(4\rho_L \times U_{LS})$, where G is a flow speed [kg/(m$^2$ s)] of the refrigerant, x is a quality of the refrigerant, D is an inside diameter [m] of the header manifold, $\rho_L$ is a liquid density [kg/m$^3$] of the refrigerant, $U_{LS}$ is a reference apparent liquid speed [m/s] that is a maximum value within a range of variation in an apparent gas speed of the refrigerant flowing into the flow space of the header manifold, the reference apparent liquid speed $U_{LS}$ [m/s] being defined as $G(1-x)/\rho_L$.

A heat exchanger of another embodiment of the present invention includes a plurality of heat-transfer tubes arranged side by side in a vertical direction in such a manner as to project therefrom on both sides, a first header connected to one end of each of the plurality of heat-transfer tubes, a second header connected to an other end of each of the plurality of heat-transfer tubes, and a plurality of fins joined to each of the plurality of heat-transfer tubes. The heat exchanger forms part of a refrigeration cycle circuit through which refrigerant circulates. The second header is the above header. The header manifold of the second header has a flow space that communicates with the plurality of branch tubes connected to the plurality of heat-transfer tubes, respectively. When the heat exchanger serves as an evaporator, gas-liquid two-phase refrigerant flows upward in the flow space and is discharged into the plurality of branch tubes.

An air-conditioning apparatus of yet another embodiment of the present invention includes a compressor, an indoor heat exchanger, an expansion device, and an outdoor heat exchanger that form a refrigeration cycle circuit through which refrigerant circulates. The outdoor heat exchanger is the above heat exchanger. The air-conditioning apparatus includes a controller configured to control the compressor or the expansion device such that the quality x of the refrigerant flowing into the second header falls within the range $0.05 \leq x \leq 0.30$ in the rated heating operation.

Advantageous Effects of Invention

In each of the header, the heat exchanger, and the air-conditioning apparatus according to the above embodiments of the present invention, if the refrigerant flowing into the header manifold forms a pattern of annular flow or churn flow, the tips of the branch tubes inserted into the header manifold pass through the liquid-phase portion having a thickness δ [m] and reach the gas-phase portion. Thus, with a simplified configuration, a cost reduction is realized, and the performance of refrigerant distribution from the header manifold to the plurality of branch tubes can be improved over a wide operating range. Consequently, the energy efficiency can be improved.

DESCRIPTION OF EMBODIMENTS

Figure 1:
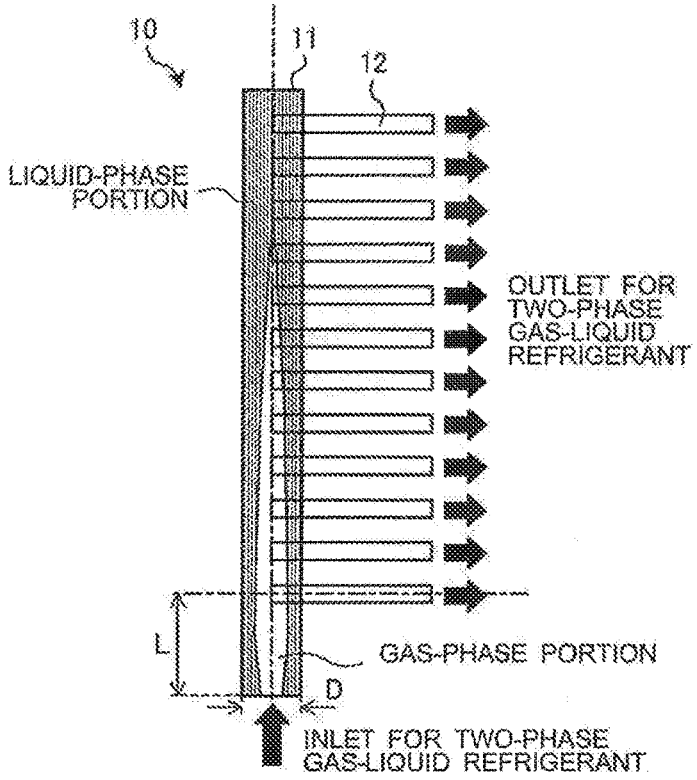
FIG. 1 is a schematic diagram of a header according to Embodiment 1 of the present invention.

Embodiments of the present invention will now be described with reference to the drawings.

In the drawings, like reference numerals denote like or equivalent elements, which applies throughout this specification.

Modes of the elements disclosed in this specification are only exemplary and are not limited thereto.

Embodiment 1

FIG. 1 is a schematic diagram of a second header 10 according to Embodiment 1 of the present invention.

As illustrated in FIG. 1, the second header 10 includes a second header manifold 11 and a plurality of branch tubes 12.

The second header manifold 11 extends vertically, with a section thereof along a horizontal plane being in a round tubular shape. A lower part of the second header manifold 11 is connected to a refrigerant pipe of a refrigeration cycle circuit.

The plurality of branch tubes 12 each extends horizontally, with a vertical section thereof that faces the second header manifold 11 being in a round tubular shape. The plurality of branch tubes 12 are arranged side by side in the vertical direction at a regular pitch. The plurality of branch tubes 12 are each connected to a corresponding one of heat-transfer tubes included in an outdoor heat exchanger forming part of the refrigeration cycle circuit.

The tips of the plurality of branch tubes 12 each communicate with the second header manifold 11 while projecting thereinto in such a manner as to reach the inside-diameter center of the second header manifold 11.

Now, the flow of gas-liquid two-phase refrigerant flowing through the second header 10 will be described.

The gas-liquid two-phase refrigerant enters the second header manifold 11 from the lower part thereof and forms an ascending current flowing against the gravity. The gas-liquid two-phase refrigerant thus entering the second header manifold 11 is distributed to the branch tubes 12 sequentially from the lower part of the second header manifold 11.

In this step, if the gas-liquid two-phase refrigerant flowing into the second header 10 forms a pattern of annular flow or churn flow, as illustrated in FIG. 1, a gas-phase portion thereof is present in a central area of the second header manifold 11, whereas a liquid-phase portion thereof is present along the periphery of the second header manifold 11.

Figure 2:
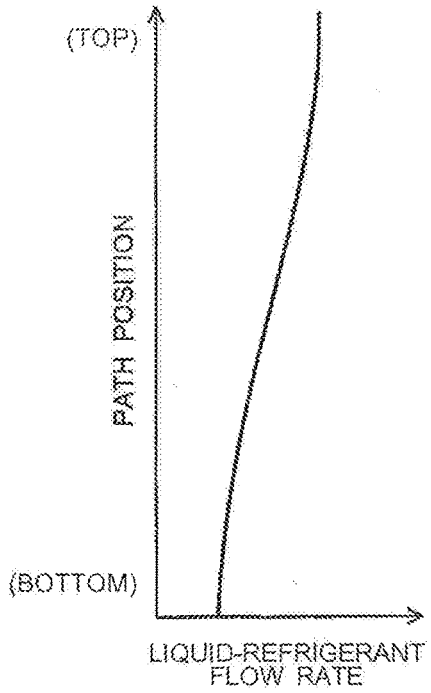
FIG. 2 is a graph illustrating the flow rate of liquid refrigerant with respect to the path position of a header manifold according to Embodiment 1 of the present invention.

FIG. 2 is a graph illustrating the flow rate of liquid refrigerant with respect to the path position of the second header manifold 11 according to Embodiment 1 of the present invention.

As illustrated in FIG. 2, liquid flow rate is distributed such that a larger amount of gas refrigerant is distributed to the branch tubes 12 in the lower part of the second header manifold 11, whereas a larger amount of liquid refrigerant is distributed in the upper part of the second header manifold 11.

Since such a distribution of liquid flow rate is obtained, the header-specific problem, in which, for example, liquid refrigerant does not reach the upper part of the second header manifold 11 because of gravity, can be overcome. Thus, the performance of refrigerant distribution can be improved. Accordingly, the efficiency of the heat exchanger can be improved. Consequently, the energy efficiency can be improved.

The most preferable position of the tip of each branch tube 12 in the second header manifold 11 is substantially the center. However, according to the result of an experiment conducted by the present inventers, if the refrigerant flowing into the second header manifold 11 forms a pattern of annular flow or churn flow, the tip of each branch tube 12 only needs to pass through the liquid-phase portion of the refrigerant flowing in the second header manifold 11, that is, the tip may be positioned within an area spreading around the center.

Figure 3:
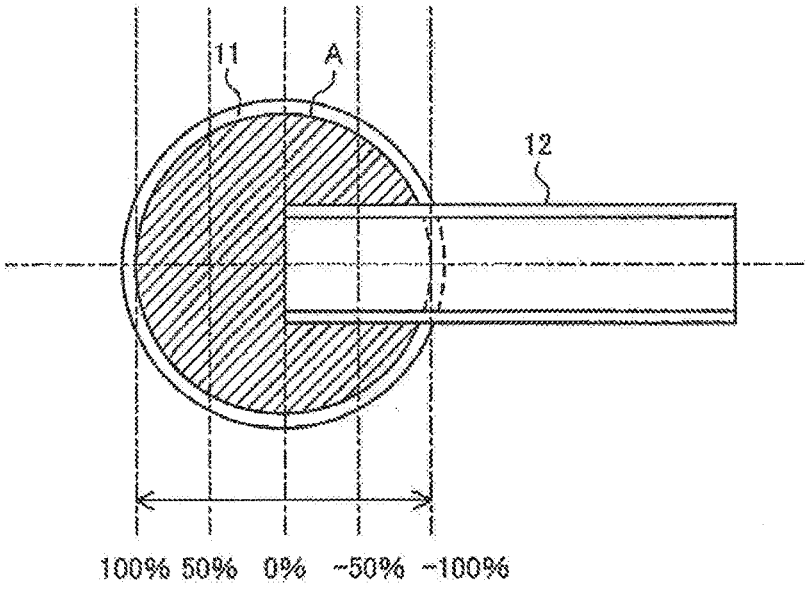
FIG. 3 is a diagram illustrating an example of the position of the tip of a branch tube in the header manifold according to Embodiment 1 of the present invention.
Figure 4:
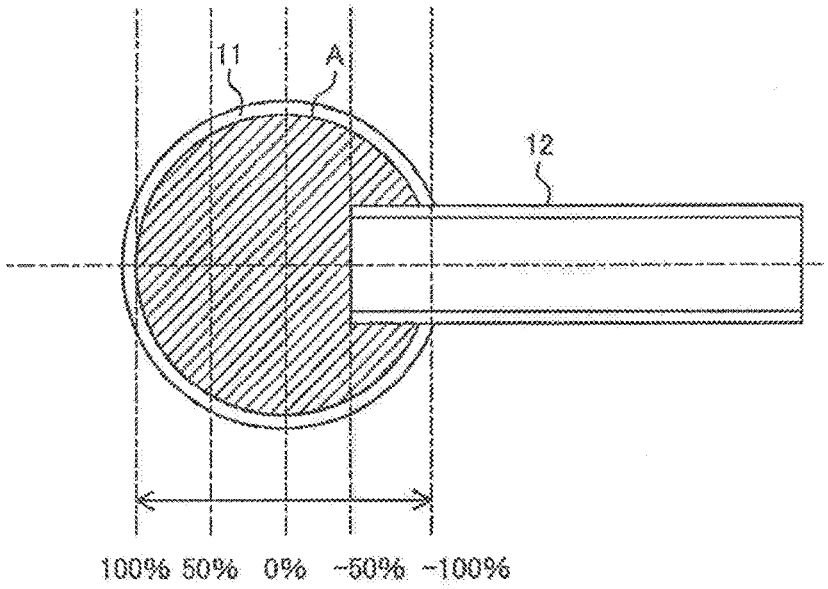
FIG. 4 is a diagram illustrating another example of the position of the tip of the branch tube in the header manifold according to Embodiment 1 of the present invention.
Figure 5:
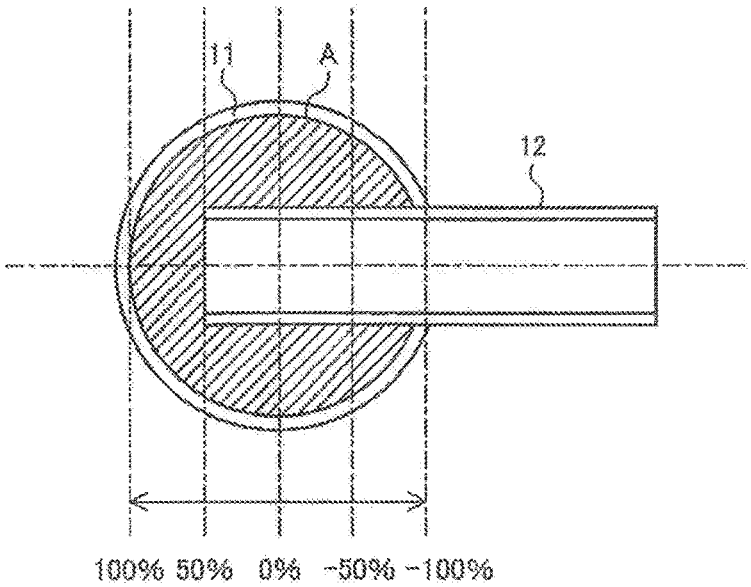
FIG. 5 is a diagram illustrating yet another example of the position of the tip of the branch tube in the header manifold according to Embodiment 1 of the present invention.

FIG. 3 is a diagram illustrating an example of the position of the tip of the branch tube 12 in the second header manifold 11 according to Embodiment 1 of the present invention. FIG. 4 is a diagram illustrating another example of the position of the tip of the branch tube 12 in the second header manifold 11 according to Embodiment 1 of the present invention. FIG. 5 is a diagram illustrating yet another example of the position of the tip of the branch tube 12 in the second header manifold 11 according to Embodiment 1 of the present invention.

Herein, the area spreading around the center is regarded as follows. As illustrated in FIGS. 3, 4, and 5, when the center position of a flow space of the second header manifold 11 in a horizontal plane is defined as 0% and the position of the wall surface of the flow space of the second header manifold 11 in the horizontal plane is defined as 100% on either side, the plurality of branch tubes 12 are each connected such that the tip thereof is positioned in an area within 50% on either side.

Reference character A provided in each of FIGS. 3, 4, and 5 is the effective passage-section area [$m^2$] at a position in the horizontal sectional view where the branch tube 12 is inserted.

According to the experiment and analysis made by the present inventors, in the case of an annular flow or a churn flow, a thickness δ [m] of the liquid-phase portion is expressed as follows relatively matches well: $\delta=G\times(1-x)\times D/(4\rho_L U_{LS})$, where G is the flow speed [kg/($m^2$ s)] of the refrigerant, x is the quality of the refrigerant, D is the inside diameter [m] of the second header manifold 11, $\rho_L$ is the liquid density [kg/$m^3$] of the refrigerant, and $U_{LS}$ is the reference apparent liquid speed [m/s] that is the maximum value within the range of variation in the apparent gas speed of the refrigerant flowing into the flow space of the second header manifold 11. Therefore, the tip of each of the plurality of branch tubes 12 connected to the second header manifold 11 projects at least from the liquid-phase portion having the thickness δ calculated in accordance with the above equation but does not project from another liquid-phase portion having the thickness δ and that is present on the other side of the second header manifold 11 toward which the branch tube 12 projects. That is, configurations are applicable as long as the tip of the branch tube 12 passes through the liquid-phase portion having the thickness δ and reach the gas-phase portion in such a manner as to be positioned in the gas-phase portion.

Note that the reference apparent liquid speed $U_{LS}$ [m/s] is defined as $G(1-x)/\rho_L$.

The flow pattern is identified with reference to the flow pattern diagram of a vertically ascending current and is set in accordance with a reference apparent gas speed $U_{GS}$ [m/s] of the refrigerant at the maximum value within the range of variation in the flow speed of the refrigerant flowing into the flow space of the second header manifold 11.

It is preferable that the reference apparent gas speed $U_{GS}$ [m/s] of the refrigerant flowing into the second header manifold 11 satisfy a condition $U_{GS}\geq\alpha\times L\times(g\times D)^{0.5}/(40.6\times D)-0.22\alpha\times(g\times D)^{0.5}$. It is more preferable that the reference apparent gas speed $U_{GS}$ [m/s] satisfy a condition $U_{GS}\geq3.1/(\rho_G^{0.5})\times[\sigma\times g\times(\rho_L-\rho_G)]^{0.25}$.

Figure 6:
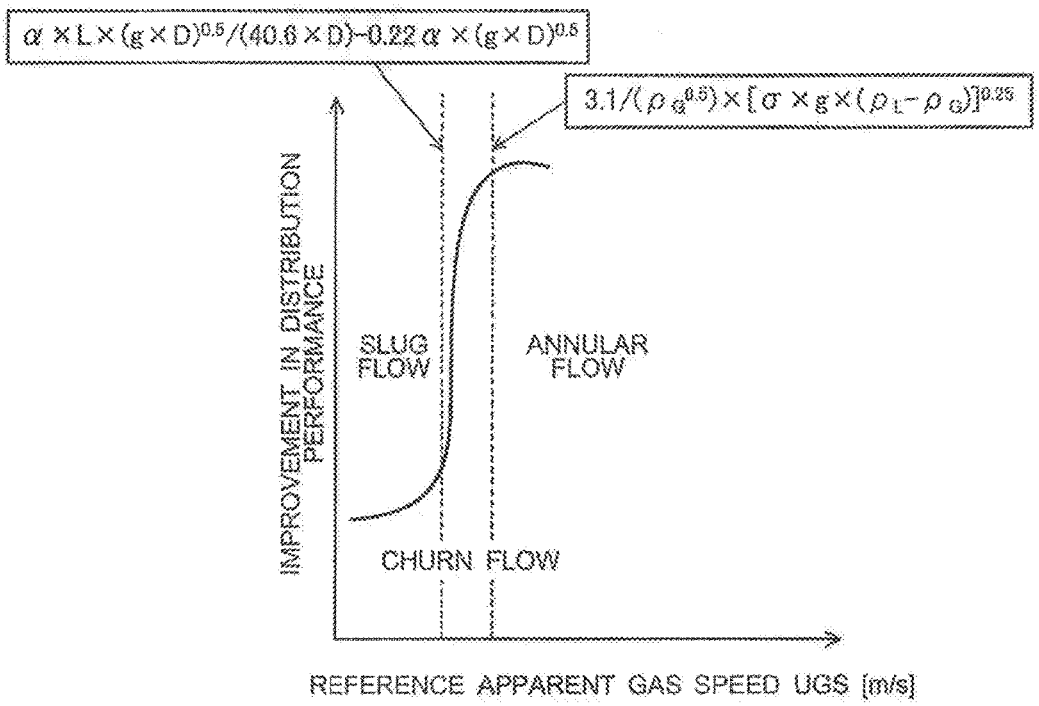
FIG. 6 is a graph illustrating the relationship between a reference apparent gas speed of the refrigerant and the improvement in the distribution performance according to Embodiment 1 of the present invention.

FIG. 6 is a graph illustrating the relationship between the reference apparent gas speed $U_{GS}$ [m/s] of the refrigerant and the improvement in the distribution performance according to Embodiment 1 of the present invention.

As illustrated in FIG. 6, when the reference apparent gas speed $U_{GS}$ [m/s] of the refrigerant is within either of the ranges defined above, the refrigerant flowing into the second header manifold 11 forms an annular flow or a churn flow. Therefore, the distribution performance is expected to be improved. Accordingly, the efficiency of the heat exchanger can be improved. Consequently, the energy efficiency can be improved.

Note that α is the void fraction of the refrigerant and is expressed as $\alpha=x/[x+(\rho_G/\rho_L)\times(1-x)]$, L is the entrance length [m], g is the gravitational acceleration [m/$s^2$], D is the inside diameter [m] of the second header manifold 11, x is the quality of the refrigerant, $\rho_G$ is the gas density [kg/$m^3$] of the refrigerant, $\rho_L$ is the liquid density [kg/$m^3$] of the refrigerant, and σ is the surface tension [N/m] of the refrigerant. The void fraction α of the refrigerant is measured by, for example, utilizing electrical resistance, or by visual observation. The entrance length L [m] at an inlet of the second header manifold 11 is defined as a distance between a position of the inlet of the second header manifold 11 and a position of the center axis of one of the branch tubes 12 that is nearest to the position of the inlet.

The reference apparent gas speed $U_{SG}$ is calculated by measuring the flow speed G, the quality x, and the gas density $\rho_G$ of the refrigerant flowing into the second header manifold 11 and is defined as $U_{SG}=(G\times x)/\rho_G$.

As illustrated in FIG. 6, if the condition $U_{SG}\geq\alpha\times L\times(g\times D)^{0.5}/(40.6\times D)\times0.22\alpha\times(g\times D)^{0.5}$ is satisfied, the degree of improvement in the distribution performance increases sharply. More preferably, if the condition $U_{SG}\geq3.1/(\rho_G^{0.5})\times[\sigma\times g\times(\rho_L-\rho_G)]^{0.25}$ is satisfied, a particularly great improvement is realized.

For example, in an air-conditioning apparatus including the second header 10, if the flow speed of the refrigerant flowing into the flow space of the second header manifold 11 is the maximum value within the range of variation and in a rated heating operation of the second header manifold 11, gas-liquid two-phase refrigerant forming an ascending current flows through the flow space of the second header manifold 11.

It is preferable that the quality x of the refrigerant in the second header manifold 11 flowing into the second header 10 fall within a range $0.05\leq x\leq0.30$, because such a condition particularly increases the degree of improvement in the distribution performance and in the performance of the heat exchanger that is brought by the branch tubes 12 projecting into the second header manifold 11.

Figure 7:
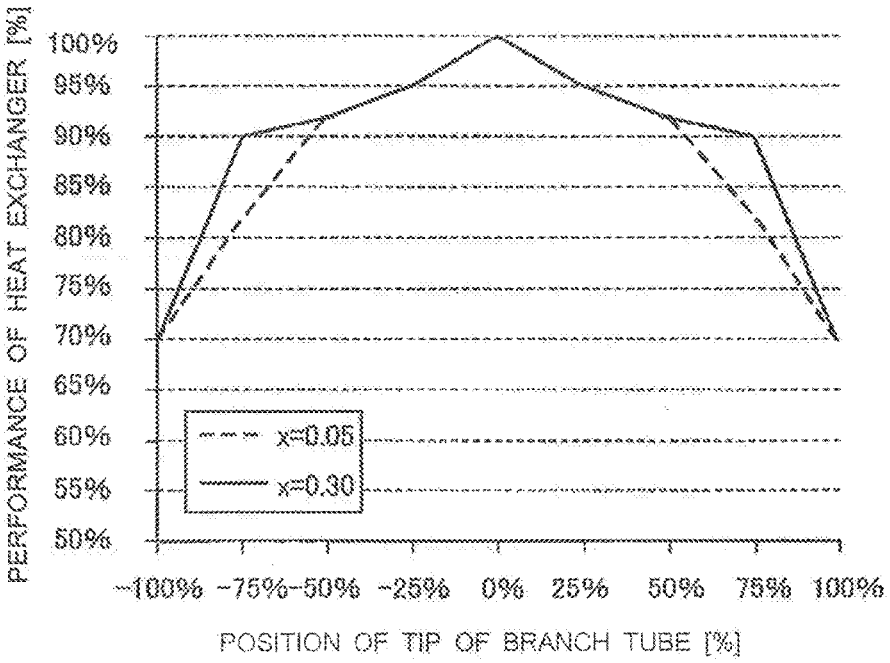
FIG. 7 is a graph illustrating the relationship between the position of the tip of the branch tube and the performance of a heat exchanger according to Embodiment 1 of the present invention.

FIG. 7 is a graph illustrating the relationship between the position of the tip of the branch tube 12 and the performance of the heat exchanger according to Embodiment 1 of the present invention. FIG. 7 illustrates an example of the result of the experiment conducted by the present inventors.

In the drawing, the position of the tip of the branch tube 12 is based on the definition that the center position of the flow space of the second header manifold 11 in the horizontal plane corresponds to 0%, and the position of the wall surface of the flow space of the second header manifold 11 in the horizontal plane corresponds to 100% on either side, as illustrated in FIGS. 3, 4, and 5.

If the quality x is 0.30 and if the tip of the branch tube 12 is positioned on the outer side with respect to 75% on either side, the performance of the heat exchanger sharply drops.

If the quality x is 0.05, since the quality x is lower than 0.30, the liquid-phase portion has a greater thickness. Accordingly, the performance of the heat exchanger sharply drops if the tip of the branch tube 12 is positioned on the outer side with respect to 50% on either side. In contrast, if the tip of the branch tube 12 is positioned on the inner side with respect to 50% on either side, the drop of the performance of the heat exchanger is gentle.

Hence, assuming that the quality x is 0.05 with which the liquid-phase portion has a large thickness, the distribution performance can be improved by positioning the tip of the branch tube 12 in the area within 50% on either side.

If the tip of the branch tube 12 is positioned in the area within 50% on either side, a larger amount of liquid refrigerant can be distributed to the upper part of the second header 10. It is more preferable that the tip of the branch tube 12 be positioned at the inside-diameter center of the second header manifold 11, that is, at 0%, because the liquid refrigerant at a flow rate ranging more widely can be distributed to the upper part of the second header manifold 11.

The above description concerns a case where the center axis of the branch tube 12 that extends horizontally and the center axis of the second header manifold 11 that extends vertically cross each other. Alternatively, for example, the center axis of the branch tube 12 that extends horizontally may be displaced from the center axis of the second header manifold 11 that extends vertically.

Figure 8:
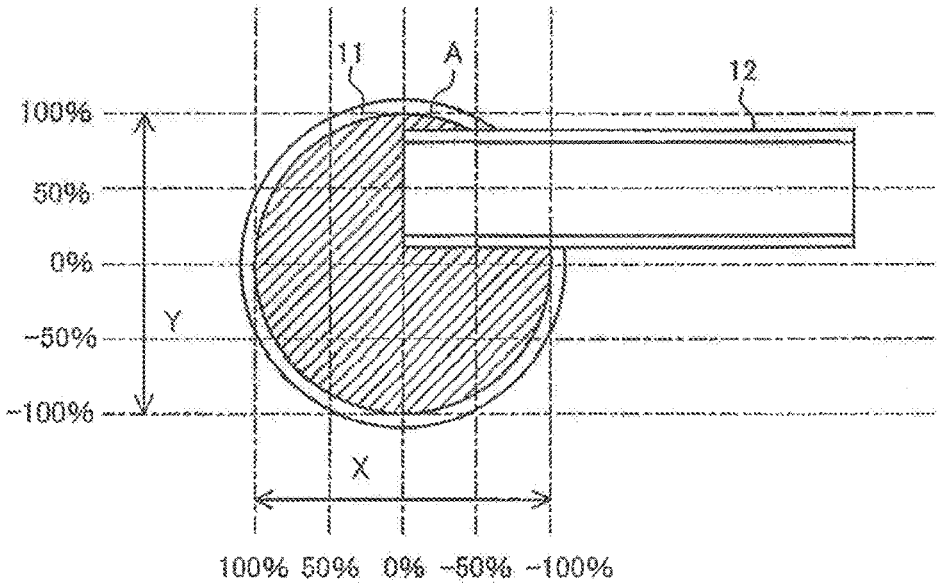
FIG. 8 is a diagram illustrating yet another example of the position of the tip of the branch tube in the header manifold according to Embodiment 1 of the present invention.
Figure 9:
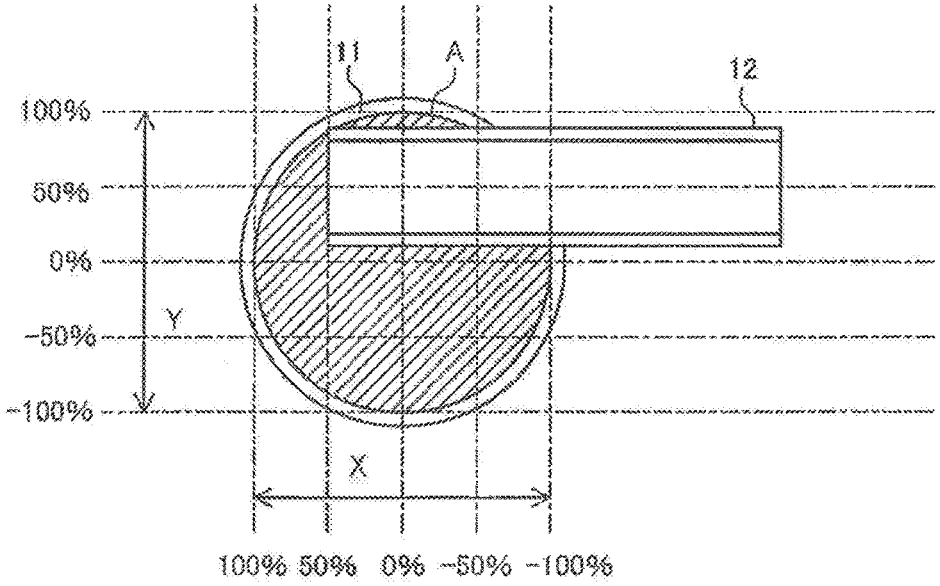
FIG. 9 is a diagram illustrating yet another example of the position of the tip of the branch tube in the header manifold according to Embodiment 1 of the present invention.

FIG. 8 is a diagram illustrating yet another example of the position of the tip of the branch tube 12 in the second header manifold 11 according to Embodiment 1 of the present invention. FIG. 9 is a diagram illustrating yet another example of the position of the tip of the branch tube 12 in the second header manifold 11 according to Embodiment 1 of the present invention.

Here, the center position of the flow space of the second header manifold 11 in a horizontal plane is defined as 0%, the position of the wall surface of the flow space of the second header manifold 11 in the horizontal plane is defined as 100% on either side, the direction of insertion of each of the plurality of branch tubes 12 in the horizontal plane is defined as the X direction, and the width direction of each of the plurality of branch tubes 12 that is orthogonal to the X direction in the horizontal plane is defined as the Y direction.

As illustrated in FIG. 8, if the center axis of the branch tube 12 is displaced in the Y direction, the improvement in the distribution performance becomes greatest when the tip of the branch tube 12 is positioned at 0% in the X direction and the center axis of the branch tube 12 is positioned at 0% in the Y direction.

However, as long as the center axis of the branch tube 12 is positioned in an area within 50% on either side in the Y direction, the distribution performance can be improved by utilizing characteristics of the pattern of annular or churn flow.

As illustrated in FIG. 9, if the center axis of the branch tube 12 is positioned in the area within 50% on either side in the Y direction and the tip of the branch tube 12 is positioned in the area within 50% on either side, it is preferable that part of the branch tube 12 be in contact with the inner wall of the second header manifold 11, because the length of projection can thus be controlled easily.

In such a case, if the center axis of the branch tube 12 is positioned in an area within 25% on either side in the Y direction and the tip of the branch tube 12 is positioned in an area within 25% on either side, the distribution performance can be improved stably even with a low quality of the refrigerant.

The lengths of insertion of the plurality of branch tubes 12 into the second header manifold 11 are preferably the same but may be different as long as the tips of the branch tubes 12 or the center axes of the branch tubes 12 are each positioned in the area within 50% on either side.

The branch tubes 12 are each described as a component of the second header 10. Alternatively, for example, the branch tube 12 may be provided as part of a round heat-transfer tube of the heat exchanger, that is, as an extension of the heat-transfer tube.

Since the branch tube 12 may be used as a substitution for part of the heat-transfer tube, the inner surface of the branch tube 12 may be processed to have a shape that promotes heat transfer, with grooves or the like.

The kind of refrigerant that flows through the second header 10 is not specifically limited. However, using any of refrigerants each having a high refrigerant gas density, namely, R32, R410A, and $CO_2$, is preferable. Originally, liquid refrigerant is characterized in being less likely to reach the upper part of the second header 10. Therefore, the use of any of the above refrigerant greatly improves the performance of the heat exchanger.

Also preferable is a mixture of two or more kinds of refrigerant having different boiling point differences that are selected from olefin-based refrigerant such as R1234yf and R1234ze(E); HFC refrigerant such as R32; hydrocarbon refrigerant such as propane and isobutane; $CO_2$; DME (dimethyl ether); and the like. The use of such refrigerant also greatly improves the performance of the heat exchanger with an improvement in the distribution performance.

FIG. 1 illustrates the entrance length L [m] at the inlet of the second header manifold 11. The entrance length L [m] is defined as a distance between the inlet of the second header manifold 11 and the center axis of one of the branch tubes 12 that is nearest from the inlet.

The present invention depends on the flow pattern of the gas-liquid two-phase refrigerant that flows through the second header manifold 11. Therefore, it is more preferable that the flow of the gas-liquid two-phase refrigerant be fully developed. According to the experiment conducted by the present inventors, the entrance length L required for the gas-liquid two-phase refrigerant to develop needs to satisfy a condition $L \geq 5D$, where D is the inside diameter [m] of the second header manifold 11: as long as $L \geq 5D$ is satisfied, the distribution performance can be improved. The improvement becomes greater if the entrance length L satisfies a condition $L \geq 10D$.

Figure 10:
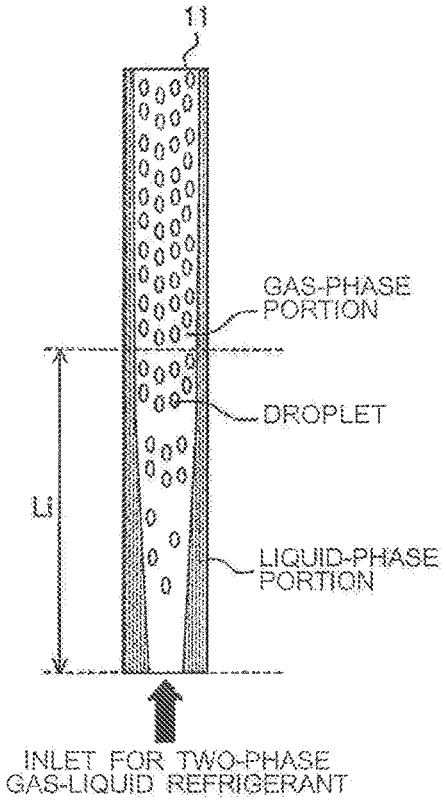
FIG. 10 is a schematic diagram illustrating how an annular flow develops in an entrance portion in a lower part of the header manifold according to Embodiment 1 of the present invention.

FIG. 10 is a schematic diagram illustrating how an annular flow develops in an entrance portion in the lower part of the second header manifold 11 according to Embodiment 1 of the present invention.

The gas-liquid two-phase refrigerant enters the second header manifold 11 from the lower part thereof as a vertically ascending current. The liquid-phase portion is thick at the inlet. As the flow develops, droplets start to be generated. Therefore, the liquid-phase portion gradually becomes thinner. In an area above an area defined by a length Li where a fully developed annular flow is formed, the liquid-phase portion has a uniform thickness.

Figure 11:
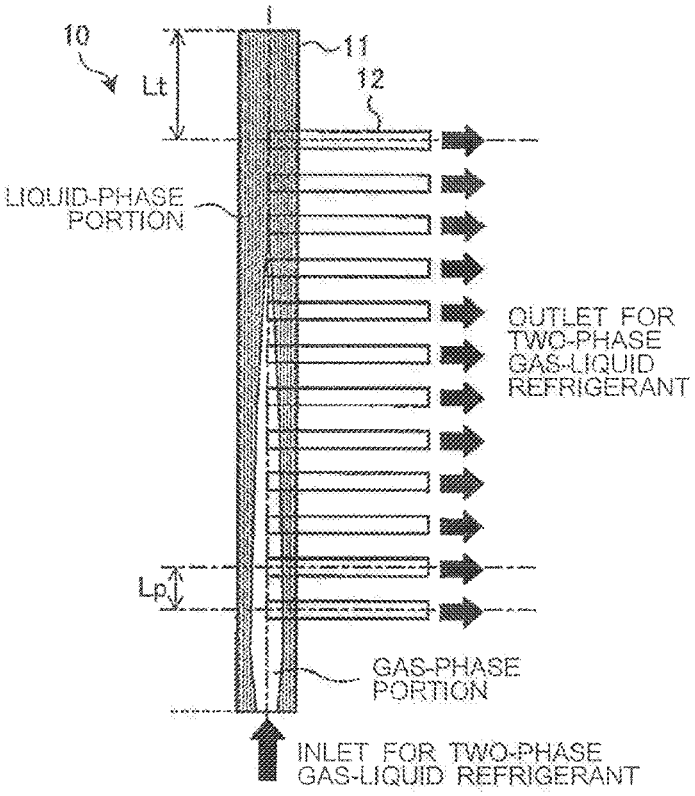
FIG. 11 is a schematic diagram illustrating an example of the header according to Embodiment 1 of the present invention.

FIG. 11 is a schematic diagram illustrating an example of the second header 10 according to Embodiment 1 of the present invention.

When the pitch between adjacent ones of the plurality of branch tubes 12 is Lp, and the length of a stagnation area in the upper part of the second header manifold 11 is Lt, a relationship Lt≥2×Lp is established.

In such a case, the influence of collision of the gas-liquid two-phase refrigerant in the upper part of the second header manifold 11 is reduced. Therefore, the flow pattern is stabilized, whereby the improvement in the distribution performance becomes greater.

The above description concerns a case where the branch tubes 12 extend from a lateral side of the second header manifold 11. The present invention is not limited to such a case.

Figure 12:
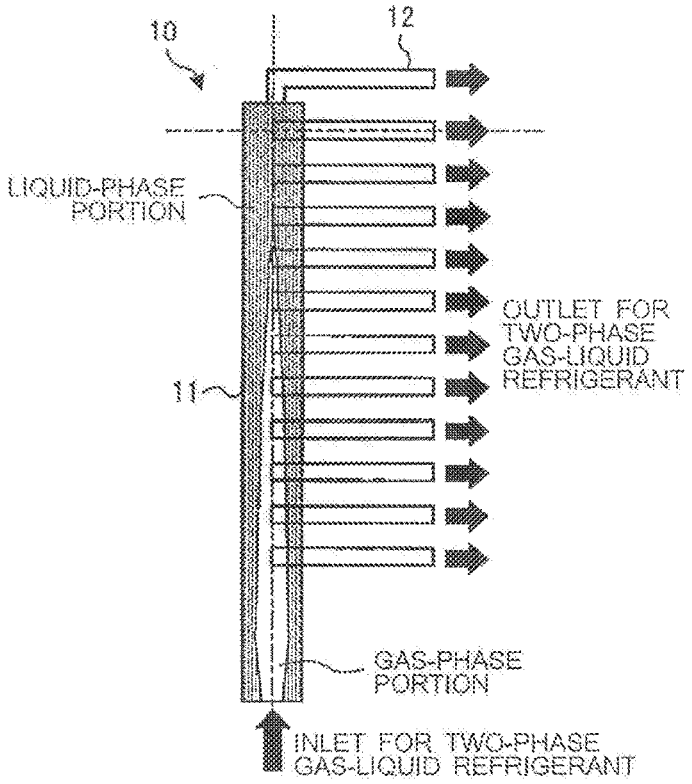
FIG. 12 is a schematic diagram illustrating another example of the header according to Embodiment 1 of the present invention.

FIG. 12 is a schematic diagram illustrating another example of the second header 10 according to Embodiment 1 of the present invention.

As illustrated in FIG. 12, the uppermost one of the plurality of branch tubes 12 may be connected to the upper end of the second header manifold 11 from the upper side.

Such a configuration is preferable because the variation in the dynamic pressure that is caused by the collision of the refrigerant in the upper part of the second header manifold 11 is small. Accordingly, the flow pattern of the refrigerant flowing through the flow space of the second header manifold 11 is stabilized. Consequently, the efficiency of the heat exchanger is improved.

Figure 13:
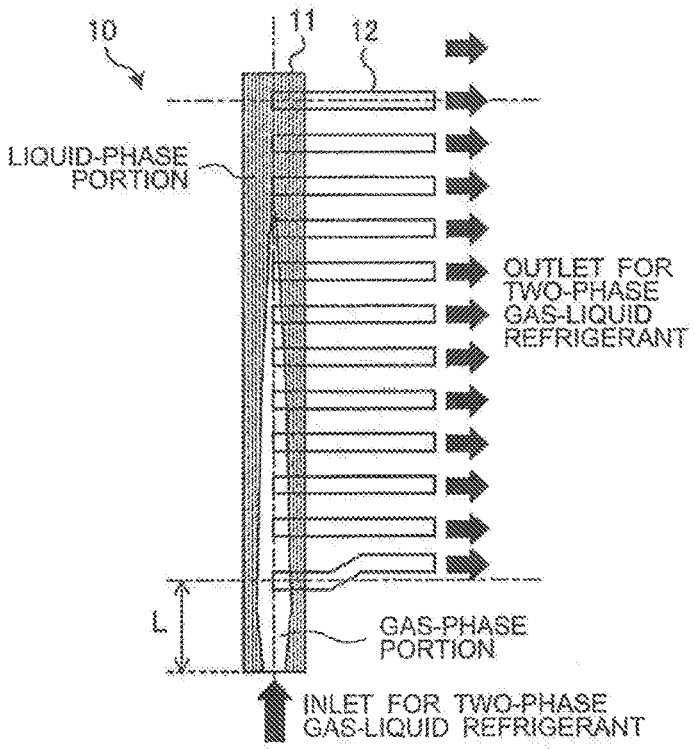
FIG. 13 is a schematic diagram illustrating yet another example of the header according to Embodiment 1 of the present invention.

FIG. 13 is a schematic diagram illustrating yet another example of the second header 10 according to Embodiment 1 of the present invention.

FIG. 13 illustrates the branch tubes 12 connected to the second header manifold 11. As illustrated in FIG. 13, at least one of the branch tubes 12 provided in the lower part of the second header manifold 11 is bent such that the inlet and the outlet thereof are at different heights, whereby a head difference is produced.

If the branch tube 12 is connected to the lower part of the second header manifold 11 such that a head difference is produced, the head difference makes it difficult for the liquid refrigerant to flow to the lower part of the second header manifold 11. Such a configuration is more preferable because a larger amount of liquid refrigerant can be distributed to the upper part of the second header manifold 11.

Figure 14:
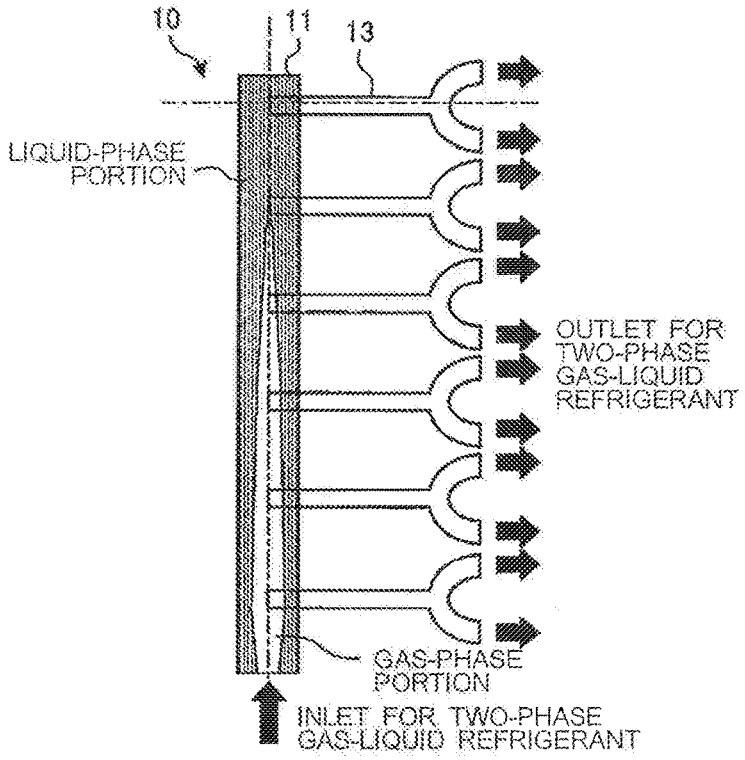
FIG. 14 is a schematic diagram illustrating yet another example of the header according to Embodiment 1 of the present invention.

FIG. 14 is a schematic diagram illustrating yet another example of the second header 10 according to Embodiment 1 of the present invention.

FIG. 14 illustrates a case where the branch tubes are each a two-way tube 13. The two-way tube 13 has an increased number, specifically two, of outflow ports compared with the number of inflow ports thereof connected to the second header manifold 11.

With the two-way tube 13 employed as the branch tube, the variation in the dynamic pressure that is caused by the branch tubes projecting into the second header manifold 11 can be reduced. Such a configuration is preferable because the variation in the flow pattern can be reduced, and the efficiency of the heat exchanger can be improved.

The above description concerns the two-way tube 13 having two outflow ports for one inflow port. The present invention is not limited to such a case. Other configurations are applicable as long as the branch tube has more outflow ports than inflow ports.

FIG. 14 illustrates a case where all of the branch tubes are two-way tubes 13. Alternatively, only some of the branch tubes may be two-way tubes 13.

Figure 15:
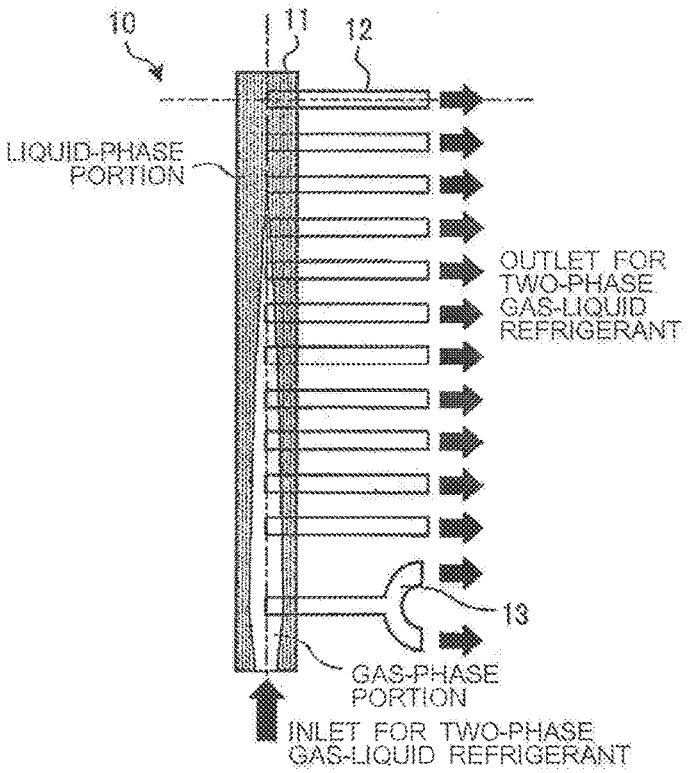
FIG. 15 is a schematic diagram illustrating yet another example of the header according to Embodiment 1 of the present invention.

FIG. 15 is a schematic diagram illustrating yet another example of the second header 10 according to Embodiment 1 of the present invention.

FIG. 15 illustrates a case where some of the branch tubes are two-way tubes 13 while the others are normal branch tubes 12 each having one inflow port and one outflow port. In the case where some of the branch tubes are two-way tubes 13, it is preferable that the flow rate of the refrigerant flowing through the second header manifold 11 be greater and/or the distance from the bottom of the second header manifold 11 is shorter, because in such case the reduction in the dynamic pressure that is caused by the projecting branch tubes can be suppressed more efficiently by the two-way tubes 13.

According to Embodiment 1, the second header 10 includes the plurality of branch tubes 12. The second header 10 includes the second header manifold 11 having a flow space that communicates with the plurality of branch tubes 12 and in which gas-liquid two-phase refrigerant flows upward and is discharged into the branch tubes 12. The second header 10 is configured such that if the refrigerant flowing into the second header manifold 11 forms a pattern of annular flow or churn flow, the tips of the branch tubes 12 inserted into the second header manifold 11 pass through the liquid-phase portion having the thickness δ [m] and reach the gas-phase portion. The thickness δ [m] of the liquid-phase portion is defined as $\delta = G \times (1-x) \times D/(4\rho_L \times U_{LS})$, where G is the flow speed [kg/(m$^2$ s)] of the refrigerant, x is the quality of the refrigerant, D is the inside diameter [m] of the header manifold, $\rho_L$ is the liquid density [kg/m$^3$] of the refrigerant, $U_{LS}$ is the reference apparent liquid speed [m/s] that is the maximum value within the range of variation in the apparent gas speed of the refrigerant flowing into the flow space of the header manifold. The reference apparent liquid speed $U_{LS}$ [m/s] is defined as $G(1-x)/\rho_L$.

In such a configuration, an annular flow or a churn flow is formed in the second header manifold 11 in which gas-liquid two-phase refrigerant flows upward. In the annular flow or the churn flow, more gas refrigerant is present around the center axis of the second header manifold 11, whereas more liquid refrigerant is present on the periphery. Since the tips of the branch tubes 12 inserted into the second header manifold 11 pass through the liquid-phase portion having the thickness δ and reach the gas-phase portion, more gas refrigerant is selectively distributed in the lower part of the second header manifold 11, making it easier for the liquid refrigerant to reach the upper part of the second header manifold 11. Accordingly, the distribution performance of the second header 10 can be improved, the efficiency of the heat exchanger can be improved, and the energy efficiency can be improved. Thus, with the second header 10 having a simplified configuration, a cost reduction is realized, and the performance of refrigerant distribution from the second header manifold 11 to the plurality of branch tubes 12 can be improved over a wide operating range. Consequently, the energy efficiency can be improved.

That is, the gas-liquid two-phase refrigerant flowing upward in the second header manifold 11 can have a pattern of annular flow or churn flow. Accordingly, gas refrigerant gathers in a central part of the second header manifold 11, whereas liquid refrigerant gathers on the periphery of the second header manifold 11. Therefore, the gas refrigerant can be selectively distributed more to those branch tubes 12 provided in the lower part of the second header 10 than to those branch tubes 12 provided in the upper part of the second header 10. Thus, the ratio of distribution of the liquid refrigerant gradually increases from the bottom toward the top of the second header 10. That is, the refrigerant can be distributed in conformity with the distribution of the volume of airflow generated by a top-flow fan. Therefore, the performance of the outdoor heat exchanger can be improved. On the other hand, the flow rate of the refrigerant varies greatly with operating conditions of the outdoor heat exchanger or the load imposed on the outdoor heat exchanger to which the second header 10 is attached. However, the quality of the refrigerant is adjustable by changing the opening degree of an expansion device provided on the upstream side of the outdoor heat exchanger in the direction of refrigerant flow. Therefore, the performance of refrigerant distribution can be improved suitably for the top-flow fan under widely varying operating conditions. Accordingly, the energy efficiency can be improved over a wide operating range. Such an advantageous effect is pronounced particularly in an outdoor heat exchanger employing a top-flow fan. An outdoor heat exchanger employing a side-flow fan also has the problem that liquid refrigerant is less likely to reach the upper part of the second header manifold 11. However, with the use of the second header 10, the liquid refrigerant becomes more likely to reach the upper side of the second header manifold 11. Thus, the distribution performance can be improved, and the energy efficiency can be improved.

According to Embodiment 1, in the second header 10, the reference apparent gas speed $U_{GS}$ [m/s] that is the maximum value within the range of variation in the apparent gas speed of the refrigerant flowing into the flow space of the second header manifold 11 satisfies the condition $U_{GS} \geq \alpha \times L \times (g \times D)^{0.5}/(40.6 \times D) - 0.22\alpha \times (g \times D)^{0.5}$, where $\alpha$ is the void fraction of the refrigerant, L is the entrance length [m], g is the gravitational acceleration [m/s$^2$], and D is the inside diameter [m] of the second header manifold 11. Here, the void fraction $\alpha$ of the refrigerant is defined as $x/[x+(\rho_G/\rho_L)\times(1-x)]$, where xis the quality of the refrigerant, $\rho_G$ is the gas density [kg/m$^3$] of the refrigerant, and $\rho_L$ is the liquid density [kg/m$^3$] of the refrigerant.

In such a configuration, an annular flow or a churn flow is formed in the second header manifold 11 in which gas-liquid two-phase refrigerant flows upward. In the annular flow or the churn flow, more gas refrigerant is present around the center of the second header manifold 11, whereas more liquid refrigerant is present on the periphery. Since the condition $U_{GS} \geq \alpha \times L \times (g \times D)^{0.5}/(40.6 \times D) - 0.22\alpha \times (g \times D)^{0.5}$ is satisfied, more gas refrigerant is selectively distributed in the lower part of the second header manifold 11, making it easier for the liquid refrigerant to reach the upper part of the second header manifold 11. Accordingly, the distribution performance of the second header 10 can be improved, the efficiency of the heat exchanger can be improved, and the energy efficiency can be improved. Thus, with the second header 10 having a simplified configuration, a cost reduction is realized, and the performance of refrigerant distribution from the second header manifold 11 to the plurality of branch tubes 12 can be improved over a wide operating range. Consequently, the energy efficiency can be improved.

According to Embodiment 1, in the second header 10, the reference apparent gas speed $U_{GS}$ [m/s] that is the maximum value within the range of variation in the apparent gas speed of the refrigerant flowing into the flow space of the second header manifold 11 satisfies the condition $U_{GS} \geq 3.1/(\rho_G^{0.5}) \times [\sigma \times g \times (\rho_L - \rho_G)]^{0.25}$, where $\rho_G$ is the gas density [kg/m$^3$] of the refrigerant, $\sigma$ is the surface tension [N/m] of the refrigerant, g is the gravitational acceleration [m/s$^2$], and $\rho_L$ is the liquid density [kg/m$^3$] of the refrigerant.

In such a configuration, an annular flow or a churn flow is formed in the second header manifold 11 in which gas-liquid two-phase refrigerant flows upward. In the annular flow or the churn flow, more gas refrigerant is present around the center of the second header manifold 11, whereas more liquid refrigerant is present on the periphery. Since the condition $U_{GS} \geq 3.1/(\rho_G^{0.5}) \times [\sigma \times g \times (\rho_L - \rho_G)]^{0.25}$ is satisfied, much more gas refrigerant is selectively distributed in the lower part of the second header manifold 11, making it much easier for the liquid refrigerant to reach the upper part of the second header manifold 11. Accordingly, the distribution performance of the second header 10 can be improved, the efficiency of the heat exchanger can be improved, and the energy efficiency can be improved. Thus, with the second header 10 having a simplified configuration, a cost reduction is realized, and the performance of refrigerant distribution from the second header manifold 11 to the plurality of branch tubes 12 can be improved over a wide operating range. Consequently, the energy efficiency can be improved.

According to Embodiment 1, the second header 10 includes the plurality of branch tubes 12. The second header 10 includes the second header manifold 11 having the flow space that communicates with the plurality of branch tubes 12 and in which gas-liquid two-phase refrigerant flows upward and is discharged into the plurality of branch tubes 12. The center position of the flow space of the second header manifold 11 in a horizontal plane is defined as 0%. The position of the wall surface of the flow space of the second header manifold 11 in the horizontal plane is defined as 100% on either side. Under such definitions, the tip of each of the branch tubes 12 inserted into the second header manifold 11 is positioned in the area within 50% on either side. The reference apparent gas speed $U_{GS}$ [m/s] that is the maximum value within the range of variation in the apparent gas speed of the refrigerant flowing into the flow space of the second header manifold 11 satisfies the condition $U_{GS} \geq \alpha \times L \times (g \times D)^{0.5}/(40.6 \times D) - 0.22\alpha \times (g \times D)^{0.5}$, where $\alpha$ is the void fraction of the refrigerant, L is the entrance length [m], g is the gravitational acceleration [m/s$^2$], and D is the inside diameter [m] of the second header manifold 11. Here, the void fraction $\alpha$ of the refrigerant is defined as $x/[x+(\rho_G/\rho_L)\times(1-x)]$, where x is the quality of the refrigerant, $\rho_G$ is the gas density [kg/m$^3$] of the refrigerant, and $\rho_L$ is the liquid density [kg/m$^3$] of the refrigerant.

In such a configuration, an annular flow or a churn flow is formed in the second header manifold 11 in which gas-liquid two-phase refrigerant flows upward. In the annular flow or the churn flow, more gas refrigerant is present around the center of the second header manifold 11, whereas more liquid refrigerant is present on the periphery. Since the tip of each of the branch tubes 12 is positioned in the area within 50% on either side and the condition $U_{GS} \geq \alpha \times L \times (g \times D)^{0.5}/(40.6 \times D) - 0.22\alpha \times (g \times D)^{0.5}$ is satisfied, more gas refrigerant is selectively distributed in the lower part of the second header manifold 11, making it easier for the liquid refrigerant to reach the upper part of the second header manifold 11. Accordingly, the distribution performance of the second header 10 can be improved, the efficiency of the heat exchanger can be improved, and the energy efficiency can be improved. Thus, with the second header 10 having a simplified configuration, a cost reduction is realized, and the performance of refrigerant distribution from the second header manifold 11 to the plurality of branch tubes 12 can be improved over a wide operating range. Consequently, the energy efficiency can be improved.

According to Embodiment 1, the reference apparent gas speed $U_{GS}$ [m/s] that is the maximum value within the range of variation in the apparent gas speed of the refrigerant flowing into the flow space of the second header manifold 11 satisfies the condition $U_{GS} \geq 3.1/(\rho_G^{0.5}) \times [\sigma \times g \times (\rho_L - \rho_G)]^{0.25}$, where $\rho_G$ is the gas density [kg/m$^3$] of the refrigerant, $\sigma$ is the surface tension [N/m] of the refrigerant, g is the gravitational acceleration [m/s$^2$], and $\rho_L$ is the liquid density [kg/m$^3$] of the refrigerant.

In such a configuration, an annular flow or a churn flow is formed in the second header manifold 11 in which gas-liquid two-phase refrigerant flows upward. In the annular flow or the churn flow, more gas refrigerant is present around the center of the second header manifold 11, whereas more liquid refrigerant is present on the periphery. Since the tip of each of the branch tubes 12 is positioned in the area within 50% on either side and the condition $U_{GS} \geq 3.1/(\rho_G^{0.5}) \times [\sigma \times g \times (\rho_L - \rho_G)]^{0.25}$ is satisfied, much more gas refrigerant is selectively distributed in the lower part of the second header manifold 11, making it much easier for the liquid refrigerant to reach the upper part of the second header manifold 11. Accordingly, the distribution performance of the second header 10 can be improved, the efficiency of the heat exchanger can be improved, and the energy efficiency can be improved. Thus, with the second header 10 having a simplified configuration, a cost reduction is realized, and the performance of refrigerant distribution from the second header manifold 11 to the plurality of branch tubes 12 can be improved over a wide operating range. Consequently, the energy efficiency can be improved.

According to Embodiment 1, the center position of the flow space of the second header manifold 11 in a horizontal plane is defined as 0%, the position of the wall surface of the flow space of the second header manifold 11 in the horizontal plane is defined as 100% on either side, the direction of insertion of each of the plurality of branch tubes 12 in the horizontal plane is defined as the X direction, and the width direction of each of the plurality of branch tubes 12 that is orthogonal to the X direction in the horizontal plane is defined as the Y direction. Under such definitions, the tips of all of the plurality of branch tubes 12 are positioned in the area within 50% on either side in the X direction, and the center axes of all of the plurality of branch tubes 12 are positioned in the area within 50% on either side in the Y direction.

In such a configuration, in an annular flow or a churn flow, more gas refrigerant is present around the center of the second header manifold 11, whereas more liquid refrigerant is present on the periphery of the second header manifold 11. Under such circumstances, the tips of all of the plurality of branch tubes 12 are positioned in the area within 50% on either side in the X direction, and the center axes of all of the plurality of branch tubes 12 are positioned in the area within 50% on either side in the Y direction. Therefore, more gas refrigerant is selectively distributed in the lower part of the second header manifold 11, making it easier for the liquid refrigerant to reach the upper part of the second header manifold 11. Accordingly, the distribution performance of the second header 10 can be improved, and the efficiency of the heat exchanger can be improved. Consequently, the energy efficiency can be improved.

According to Embodiment 1, the tips of all of the plurality of branch tubes 12 are positioned in the area within 25% on either side in the X direction, and the center axes of all of the plurality of branch tubes 12 are positioned in the area within 25% on either side in the Y direction.

In such a configuration, in an annular flow or a churn flow, more gas refrigerant is present around the center of the second header manifold 11, whereas more liquid refrigerant is present on the periphery of the second header manifold 11. Under such circumstances, the tips of all of the plurality of branch tubes 12 are positioned in the area within 25% on either side in the X direction, and the center axes of all of the plurality of branch tubes 12 are positioned in the area within 25% on either side in the Y direction. Therefore, the distribution performance can be improved stably even with a low quality. Accordingly, the efficiency of the heat exchanger can be improved. Consequently, the energy efficiency can be improved.

According to Embodiment 1, the tips of all of the plurality of branch tubes 12 are positioned at 0% in the X direction, and the center axes of all of the plurality of branch tubes 12 are positioned at 0% in the Y direction.

In such a configuration, a particularly great improvement in the distribution performance can be realized. Accordingly, the efficiency of the heat exchanger can be improved. Consequently, the energy efficiency can be improved.

According to Embodiment 1, the branch tubes 12 are each obtained by extending part of a heat-transfer tube included in a heat exchanger.

In such a configuration, since part of the heat-transfer tubes is used as each of the plurality of branch tubes 12, no joint for connecting the branch tube 12 and the heat-transfer tube to each other is necessary. Consequently, the space can be saved, and the pressure loss can be reduced.

According to Embodiment 1, when the pitch between adjacent ones of the plurality of branch tubes 12 is Lp and the length of a stagnation area in the upper part of the second header manifold 11 is Lt, the relationship $Lt \geq 2 \times Lp$ is established.

In such a configuration, the influence of the collision of the gas-liquid two-phase refrigerant in the upper part of the second header manifold 11 is reduced. Therefore, the flow pattern is stabilized, whereby the improvement in the distribution performance that is brought by the projecting branch tube becomes greater. Accordingly, the efficiency of the heat exchanger can be improved. Consequently, the energy efficiency can be improved.

According to Embodiment 1, the uppermost one of the plurality of branch tubes 12 is connected to the upper end of the second header manifold 11 from the upper side.

In such a configuration, the reduction in the dynamic pressure that is caused by the collision of the refrigerant in the upper part of the second header manifold 11 becomes small. Therefore, the flow pattern is stabilized, whereby the improvement in the distribution performance becomes greater. Accordingly, the efficiency of the heat exchanger can be improved. Consequently, the energy efficiency can be improved.

According to Embodiment 1, the refrigerant employed is R32, R410A, or $CO_2$.

In such a case, since the refrigerants listed above each have a high gas density, the improvement in the distribution performance that is brought by the projecting branch tubes 12 becomes greater.

According to Embodiment 1, the refrigerant employed is a mixture of at least two or more kinds of refrigerant having different boiling point differences that are selected from olefin-based refrigerant, HFC refrigerant, hydrocarbon refrigerant, $CO_2$, and DME.

In such a case, the variation in the density distribution that is caused by poor refrigerant distribution can be reduced by the use of the mixed refrigerant. Therefore, the distribution performance is improved, whereby the improvement in the efficiency of the heat exchanger becomes greater. Consequently, the energy efficiency can be improved.

Embodiment 2

Embodiment 2 of the present invention will now be described. Description that has been given in Embodiment 1 is omitted. Elements that are the same as or equivalent to those described in Embodiment 1 are denoted by corresponding ones of the reference numerals.

In Embodiment 2, the second header manifold 11 forms a passage whose horizontal section does not have a round tubular shape. The horizontal section of the second header manifold 11 has a non-round tubular shape.

Figure 16:
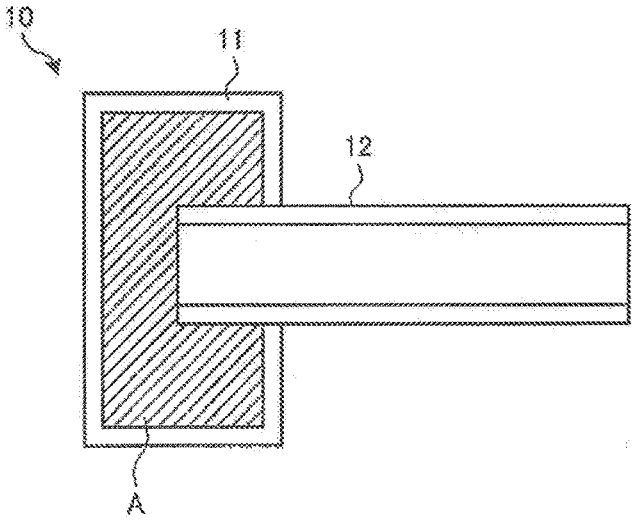
FIG. 16 is a diagram illustrating a horizontal section of a header according to Embodiment 2 of the present invention.
Figure 17:
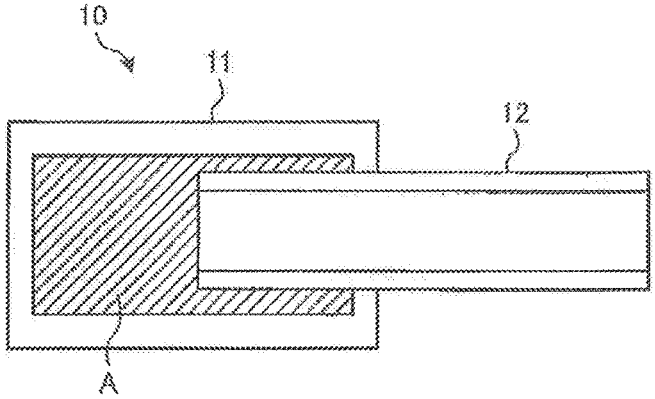
FIG. 17 is a diagram illustrating an example of the horizontal section of the header according to Embodiment 2 of the present invention.

FIG. 16 is a diagram illustrating the horizontal section of the second header 10 according to Embodiment 2 of the present invention. FIG. 17 is a diagram illustrating an example of the horizontal section of the second header 10 according to Embodiment 2 of the present invention.

As illustrated in FIGS. 16 and 17, the horizontal section of the second header manifold 11 has a rectangular tubular shape, and the passage formed of the second header manifold 11 has a rectangular shape. In such a rectangular passage as well, the distribution performance can be improved with the branch tube 12 projecting in such a manner as to reach near the center.

As illustrated in FIG. 17, in the second header manifold 11 having a rectangular tubular horizontal section, the widthwise length thereof on either side of the branch tube 12 inserted thereinto can be made smaller than that of the second header manifold having a round tubular horizontal section. Such a configuration is preferable for space saving.

In the second header manifold 11 having a rectangular tubular horizontal section, the surface joined to the branch tube 12 is orthogonal thereto. In general, such metal members are joined to each other by brazing. In the brazing, if the joining surfaces are orthogonal to each other, the ease of brazing is increased, leading to high joining quality.

If the second header manifold 11 has a rectangular passage, the center position of the passage is defined as the point of intersection of the diagonals of the rectangular passage. In such a case, the flow pattern is identified on the basis of the diameter of an equivalent circle having the same area as the section of the rectangular passage.

Figure 18:
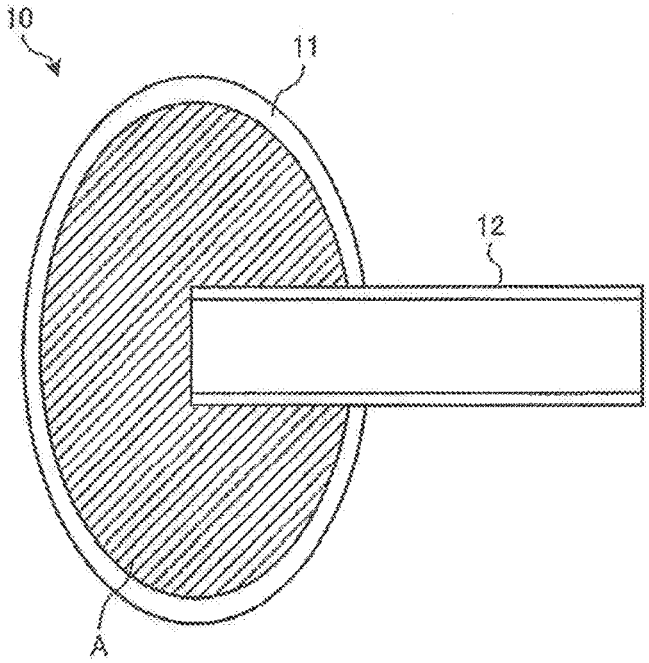
FIG. 18 is a diagram illustrating another example of the horizontal section of the header according to Embodiment 2 of the present invention.

FIG. 18 is a diagram illustrating another example of the horizontal section of the second header 10 according to Embodiment 2 of the present invention.

As illustrated in FIG. 18, the horizontal section of the second header manifold 11 has an elliptical tubular shape, and the passage formed of the second header manifold 11 has an elliptical shape. In such an elliptical passage as well, the distribution performance can be improved with the branch tube 12 projecting in such a manner as to reach near the center.

The center of the elliptical passage is defined as the point of intersection of the center lines, that is, the major axis and the minor axis.

With the second header manifold having an elliptical passage, the increase in the pressure loss of the refrigerant flowing through the second header manifold 11 having the elliptical shape that is caused by the branch tube 12 projecting up to a position near the center can be suppressed. Such a configuration is preferable for stabilizing the flow pattern.

If the branch tube 12 is inserted toward the major axis of the elliptical passage, the surface of the second header manifold 11 that is brazed to the branch tube 12 has a smaller curvature than in the case where the second header manifold has a round tubular horizontal section. Therefore, the ease of brazing is increased.

The flow pattern formed in the elliptical passage is identified on the basis of the diameter of an equivalent circle having the same area as the section of the elliptical passage.

Figure 19:
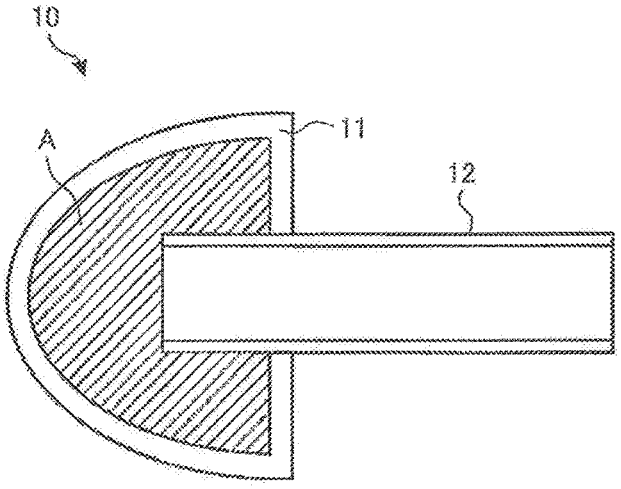
FIG. 19 is a diagram illustrating yet another example of the horizontal section of the header according to Embodiment 2 of the present invention.

FIG. 19 is a diagram illustrating yet another example of the horizontal section of the second header 10 according to Embodiment 2 of the present invention.

As illustrated in FIG. 19, the horizontal section of the second header manifold 11 has a half-round tubular shape, and the passage formed of the second header manifold 11 has a half-round shape. In such a half-round passage as well, the distribution performance can be improved with the branch tube 12 projecting in such a manner as to reach near the center.

The center of the second header manifold 11 having a half-round passage is defined as the point of intersection of lines each connecting a corresponding one of three positions nearest to the center and a corresponding one of three positions farthest from the center.

The flow pattern is identified on the basis of the diameter of an equivalent circle having the same area as the section of the half-round passage.

With the second header manifold 11 having a half-round passage, the increase in the capacity thereof in the width direction is suppressed, whereas the sectional area of the passage can be increased. Such a configuration is preferable because the space can be saved, and the pressure loss is small. Furthermore, since the surface to be joined to the branch tube 12 is flat, the ease of brazing is increased.

Figure 20:
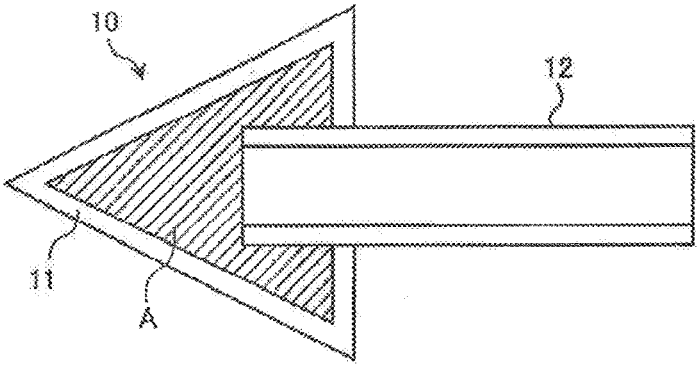
FIG. 20 is a diagram illustrating yet another example of the horizontal section of the header according to Embodiment 2 of the present invention.

FIG. 20 is a diagram illustrating yet another example of the horizontal section of the second header 10 according to Embodiment 2 of the present invention.

As illustrated in FIG. 20, the horizontal section of the second header manifold 11 has a triangular tubular shape, and the passage formed of the second header manifold 11 has a triangular shape. In such a triangular passage as well, the distribution performance can be improved with the branch tube 12 projecting in such a manner as to reach near the center.

The center of the second header manifold 11 having a triangular passage is defined as the point of intersection of lines each connecting a corresponding one of the centers of the three sides, the centers being nearest to one another, and a corresponding one of the three corners that are farthest therefrom.

The flow pattern is identified on the basis of the diameter of an equivalent circle having the same area as the section of the triangular passage.

With the second header manifold 11 having a triangular passage, the increase in the capacity thereof in the width direction is suppressed, whereas the sectional area of the passage can be increased. Such a configuration is preferable because the space can be saved, and the pressure loss is small. Furthermore, since the surface to be joined to the branch tube 12 is flat, the ease of brazing is increased.

In the second header manifold 11 having any of the rectangular passage, the elliptical passage, the half-round passage, and the triangular passage described above, the branch tube 12 is made to project into the second header manifold 11, as with the case of Embodiment 1. Furthermore, the refrigerant flowing into the second header manifold 11 is controlled to form a pattern of annular flow or churn flow. Thus, the distribution performance can be improved. Furthermore, it is preferable that the quality x be within the range $0.05 \leq x \leq 0.30$, because a great improvement in the distribution performance can be realized.

Embodiment 3

Embodiment 3 of the present invention will now be described. Description that has been given in Embodiment 1 or 2 is omitted. Elements that are the same as or equivalent to those described in Embodiment 1 or 2 are denoted by corresponding ones of the reference numerals.

In Embodiment 3, the plurality of branch tubes 12 each have a flat tubular shape.

Figure 21:
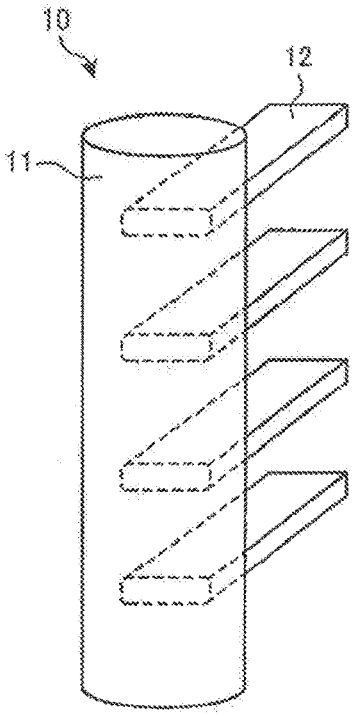
FIG. 21 is a perspective view of a header according to Embodiment 3 of the present invention.
Figure 22:
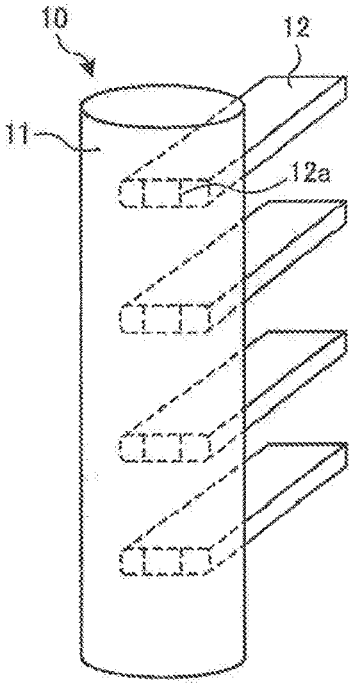
FIG. 22 is a perspective view illustrating an example of the header according to Embodiment 3 of the present invention.

FIG. 21 is a perspective view of a second header 10 according to Embodiment 3 of the present invention. FIG. 22 is a perspective view illustrating an example of the second header 10 according to Embodiment 3 of the present invention.

As illustrated in FIGS. 21 and 22, the plurality of branch tubes 12 each have a flat tubular shape.

With the flat tubular branch tubes 12, the influence of the surface tension at the branching points is increased. Accordingly, the liquid refrigerant flows uniformly in each of the branch tubes 12. Such a configuration is preferable because a great improvement in the efficiency of the heat exchanger is realized.

In such a configuration, the Y-direction position of the center axis of each branch tube 12 that is defined above is assumed to be in the area within 50% on either side with respect to an equivalent diameter of a circular tube calculated from the effective passage-section area of the flat passage.

The branch tube 12 having the flat tubular shape may be part of an air-heat exchanger. That is, part of a flat heat-transfer tube included in an air-heat exchanger may be extended to form a flat tubular shape.

Occasionally, the branch tube 12 having the flat tubular shape is used as a substitution for part of the heat-transfer tube. Therefore, the inner surface of the branch tube 12 may be processed to have a shape that promotes heat transfer, with grooves or the like.

A configuration illustrated in FIG. 22 in which the branch tube 12 has a flat tubular shape with multiple passages defined by partitions 12*a* provided therein is preferable because the branch tube 12 can have high strength.

According to Embodiment 3, the plurality of branch tubes 12 each have a flat tubular shape.

In such a configuration, since the flat tubular branch tubes 12 are employed, the influence of the surface tension at the branching points is increased. Accordingly, the liquid refrigerant flows uniformly in each of the branch tubes 12. Consequently, a great improvement in the efficiency of the heat exchanger is realized.

Furthermore, since the flat tubular branch tube 12 is inserted directly into the second header manifold 11, the number of components can be reduced, leading to a cost reduction.

Embodiment 4

Embodiment 4 of the present invention will now be described. Description that has been given in any of Embodiments 1 to 3 is omitted. Elements that are the same as or equivalent to those described in any of Embodiments 1 to 3 are denoted by corresponding ones of the reference numerals.

Figure 23:
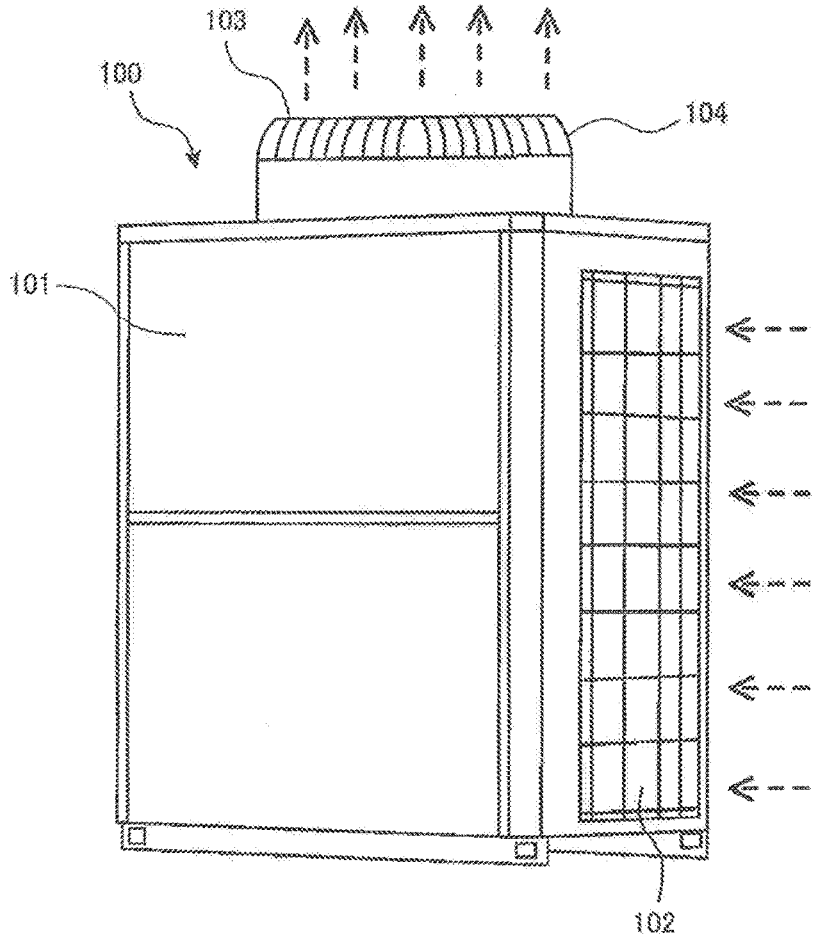
FIG. 23 is a side view of an outdoor unit included in an air-conditioning apparatus according to Embodiment 4 of the present invention.
Figure 24:
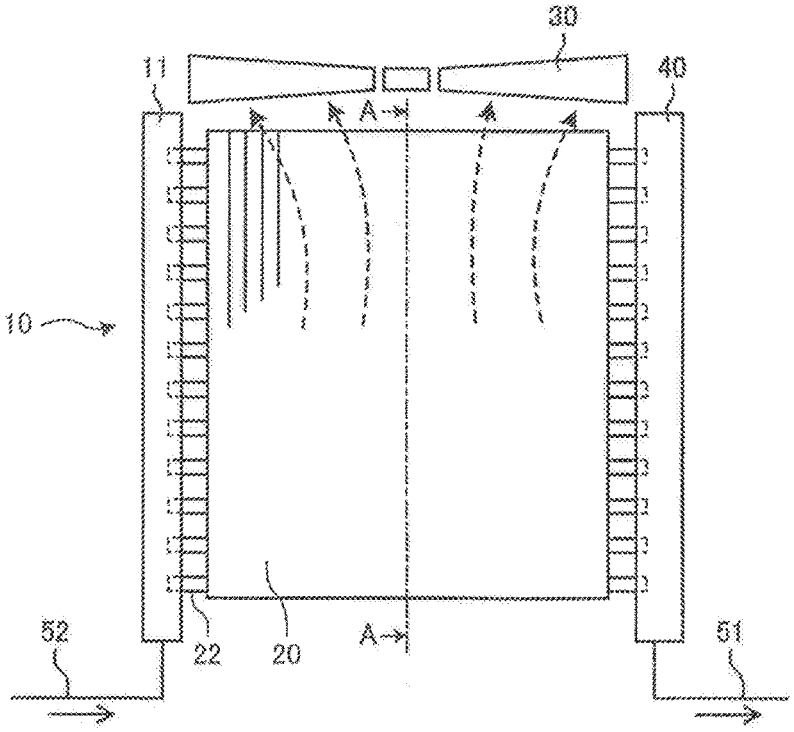
FIG. 24 is a schematic side view illustrating the connection between a header and an outdoor heat exchanger according to Embodiment 4 of the present invention.
Figure 25:
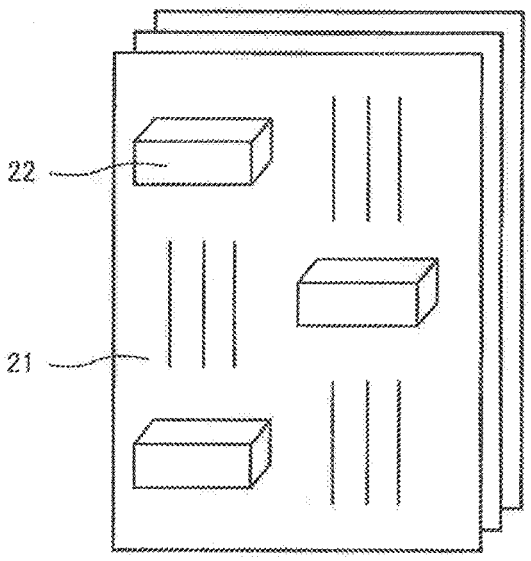
FIG. 25 is a perspective view illustrating an example of a section of the outdoor heat exchanger according to Embodiment 4 of the present invention, taken along line A-A illustrated in FIG. 24.
Figure 26:
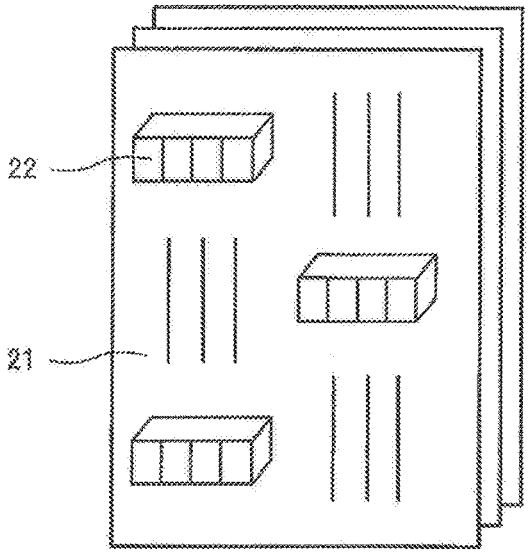
FIG. 26 is a perspective view illustrating another example of the section of the outdoor heat exchanger according to Embodiment 4 of the present invention, taken along line A-A illustrated in FIG. 24.
Figure 27:
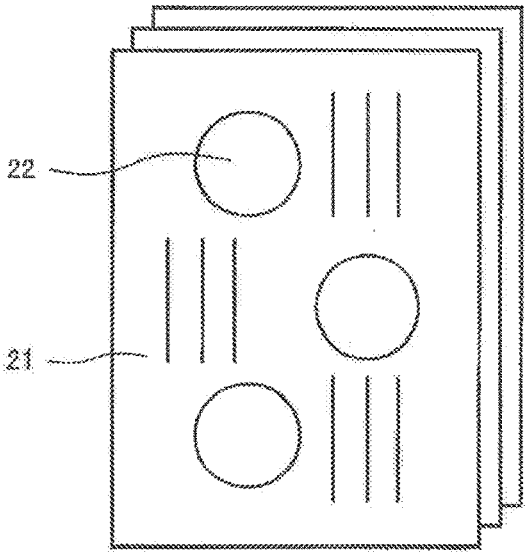
FIG. 27 is a perspective view illustrating yet another example of the section of the outdoor heat exchanger according to Embodiment 4 of the present invention, taken along line A-A illustrated in FIG. 24.

FIG. 23 is a side view of an outdoor unit 100 included in an air-conditioning apparatus according to Embodiment 4 of the present invention. FIG. 24 is a schematic side view illustrating the connection between a second header 10 and an outdoor heat exchanger 20 according to Embodiment 4 of the present invention. FIG. 25 is a perspective view illustrating an example of the section of the outdoor heat exchanger 20 according to Embodiment 4 of the present invention, taken along line A-A illustrated in FIG. 24. FIG. 26 is a perspective view illustrating another example of the section of the outdoor heat exchanger 20 according to Embodiment 4 of the present invention, taken along line A-A illustrated in FIG. 24. FIG. 27 is a perspective view illustrating yet another example of the section of the outdoor heat exchanger 20 according to Embodiment 4 of the present invention, taken along line A-A illustrated in FIG. 24.

In the drawings, solid-line arrows represent the flow of refrigerant and broken-line arrows represent the flow of air in the outdoor unit 100 of the air-conditioning apparatus in a heating operation.

In the following description, terms representing directions (such as "top", "bottom", "right", "left", "front", and "rear") are used for easy understanding. Such terms are only explanatory and do not limit the present invention. In Embodiment 4, the terms "top", "bottom", "right", "left", "front", and "rear" are used on the premise that the outdoor unit 100 is seen from the front, which also applies to the subsequent embodiments.

The outdoor unit 100 of the air-conditioning apparatus according to Embodiment 4 illustrated in FIG. 23 includes the outdoor heat exchanger 20 illustrated in FIG. 24. The outdoor unit 100 of the air-conditioning apparatus is of a top-flow type and causes the refrigerant to circulate between the outdoor unit 100 and an indoor unit, which is not illustrated, thereby forming a refrigeration cycle circuit. The outdoor unit 100 is used as, for example, one of multiple outdoor units intended for a high-rise and is installed at the roof or the like of such a building.

The outdoor unit 100 includes a box-like casing 101. The outdoor unit 100 has an air inlet 102 in the form of an opening provided in a side face of the casing 101. The outdoor unit 100 includes the outdoor heat exchanger 20, illustrated in FIG. 24, provided in the casing 101 and along the air inlet 102. The outdoor unit 100 has an air outlet 103 in the form of an opening provided in a top face of the casing 101. The outdoor unit 100 includes a fan guard 104 that covers the air outlet 103 and through which air can pass. The outdoor unit 100 includes a top-flow fan 30, illustrated in FIG. 24, provided in the fan guard 104 and that takes in outdoor air from the air inlet 102 and exhausts the outdoor air from the air outlet 103.

The outdoor heat exchanger 20 included in the outdoor unit 100 of the air-conditioning apparatus causes the outdoor air taken in from the air inlet 102 by the fan 30 and the refrigerant to exchange heat therebetween. As illustrated in FIG. 24, the outdoor heat exchanger 20 is positioned below the fan 30. The outdoor heat exchanger 20 includes a plurality of fins 21 stacked at intervals, and a plurality of heat-transfer tubes 22 each extending through the fins 21 in the direction of stacking of the fins 21 in such a manner as to project therefrom on two sides in the direction in which the refrigerant flows therein.

The plurality of heat-transfer tubes 22 are each connected at one end thereof to a first header 40. The plurality of heat-transfer tubes 22 are each connected at the other end thereof to the second header 10.

An outflow pipe 51 is connected to the bottom of the first header 40. An inflow pipe 52 is connected to the bottom of the second header 10.

In Embodiment 4, as illustrated in FIG. 24, the plurality of branch tubes included in the second header 10 are each obtained by extending part of a corresponding one of the heat-transfer tubes 22 included in the outdoor heat exchanger 20. However, the present invention is not limited to such a case. The plurality of branch tubes included in the second header 10 may be provided separately from the heat-transfer tubes 22 included in the outdoor heat exchanger 20.

The heat-transfer tubes 22 of the outdoor heat exchanger 20 according to Embodiment 4 may each be a flat tube having a flat sectional shape as illustrated in FIG. 25. Alternatively, the heat-transfer tube 22 may be a flat multi-passage tube, illustrated in FIG. 26, having a flat sectional shape and provided thereinside with a plurality of passages. The heat-transfer tube 22 is not limited to a flat tube and may be a circular tube having a circular section as illustrated in FIG. 27. The shape of the heat-transfer tube 22 is not limited. Moreover, the heat-transfer tubes 22 may each have a grooved surface so that the area of heat transfer is increased. Alternatively, the heat-transfer tubes 22 may each have a flat surface so that the increase in the pressure loss is suppressed.

Now, the flow of the refrigerant in the outdoor unit 100 of the air-conditioning apparatus according to Embodiment 4 in a heating operation will be described with reference to FIG. 24.

In the heating operation, gas-liquid two-phase refrigerant flows into the second header 10 of the outdoor unit 100 from the inflow pipe 52. In the second header 10, the refrigerant flows toward the upper of the second header manifold 11 and is distributed to the plurality of heat-transfer tubes 22 that are orthogonal to the second header manifold 11. The refrigerant thus distributed to the plurality of heat-transfer tubes 22 receive heat from ambient air in the outdoor heat exchanger 20 and evaporates into gas refrigerant or refrigerant containing a large amount of gas. The refrigerant that has undergone heat exchange in the outdoor heat exchanger 20 is collected in the first header 40, flows through the outflow pipe 51, and is discharged.

As described in Embodiments 1 to 3, the quality x of the refrigerant flowing through the inflow pipe 52 satisfies the condition $0.05 \leq x \leq 0.30$. The second header 10 is the header according to any of Embodiments 1 to 3.

Figure 28:
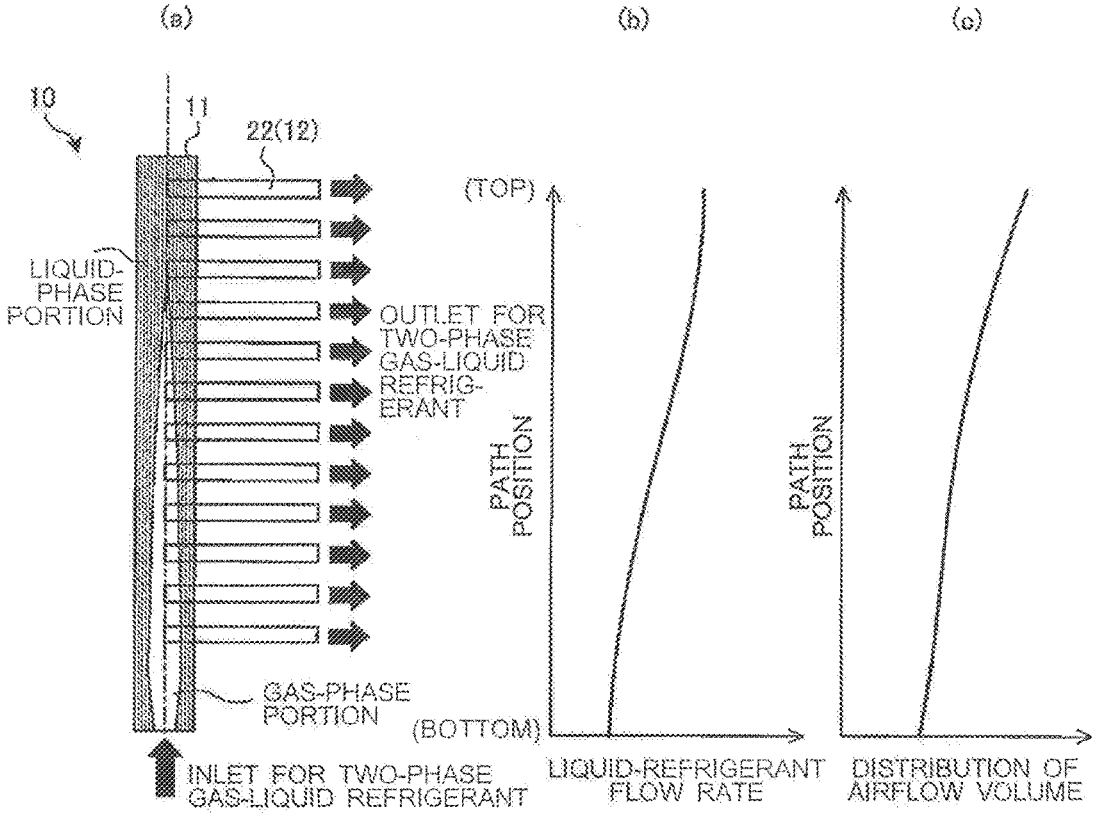
FIG. 28 includes diagrams illustrating as a whole the header according to Embodiment 4 of the present invention and the relationship between the flow rate of liquid refrigerant and the distribution of the volume of airflow in the outdoor heat exchanger, specifically, FIG. 28(*a*) is a schematic diagram of the header, FIG. 28(*b*) is a graph illustrating the relationship between the path position and the flow rate of the liquid refrigerant, and FIG. 28(*c*) is a graph illustrating the relationship between the path position and the distribution of the volume of airflow.

FIG. 28 includes diagrams illustrating as a whole the second header 10 according to Embodiment 4 of the present invention and the relationship between the flow rate of liquid refrigerant and the distribution of the volume of airflow in the outdoor heat exchanger 20. FIG. 28(*a*) is a schematic diagram of the second header 10. FIG. 28(*b*) is a graph illustrating the relationship between the path position and the flow rate of the liquid refrigerant. FIG. 28(*c*) is a graph illustrating the relationship between the path position and the distribution of the volume of airflow.

As illustrated in FIG. 28, more liquid refrigerant is distributed in the upper part of the second header manifold 11 in conformity with the distribution of the volume of airflow, in which more air is distributed in the upper part where the top-flow fan 30 is provided. Therefore, the efficiency of the heat exchanger can be improved.

Figure 29:
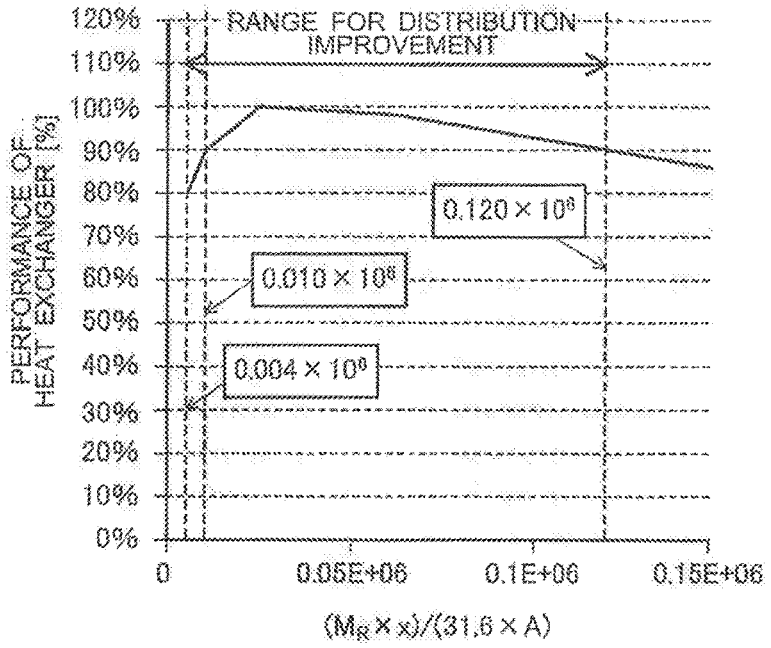
FIG. 29 is a graph illustrating the relationship between a parameter $(M_R \times x)/(31.6 \times A)$ concerning the thickness of a liquid film formed of the refrigerant and the performance of the heat exchanger according to Embodiment 4 of the present invention.

FIG. 29 is a graph illustrating the relationship between a parameter $(M_R \times x)/(31.6 \times A)$ concerning the liquid-phase thickness and the performance of the heat exchanger according to Embodiment 4 of the present invention.

The refrigerant distribution that conforms to the distribution of the volume of airflow generated by the top-flow fan 30 significantly depends on the liquid-phase thickness as a parameter. According to the experiment conducted by the present inventors, if the outdoor heat exchanger 20 employs the top-flow fan 30, the parameter $(M_R \times x)/(31.6 \times A)$ concerning the thickness of a liquid film formed of the refrigerant (the liquid-phase thickness) falls within a range $0.004 \times 10^6 \leq (M_R \times x)/(31.6 \times A) \leq 0.120 \times 10^6$, where $M_R$ is the maximum flow rate [kg/h] of the refrigerant flowing into the second header 10, x is the quality of the refrigerant, and A is the effective passage-section area [$m^2$] of the second header manifold 11.

It is more preferable that the parameter $(M_R \times x)/(31.6 \times A)$ concerning the thickness of the liquid film formed of the refrigerant (the liquid-phase thickness) be within a range $0.010 \times 10^6 \leq (M_R \times x)/(31.6) \leq 0.120 \times 10^6$. Such a case is more preferable because the distribution performance can be improved over a wide range of operating conditions.

If the parameter $(M_R \times x)/(31.6 \times A)$ concerning the thickness of the liquid film formed of the refrigerant (the liquid-phase thickness) is within the range indicated in FIG. 29, a refrigerant-distribution characteristic that is suitable for the distribution of the volume of airflow can be obtained. Note that the maximum flow rate of the refrigerant is defined as the flow rate of the refrigerant in a rated heating operation and is measurable on the basis of the input to the compressor, the capacity of the indoor unit, the rotation speed of the compressor, the number of operating indoor units, and so forth.

Figure 30:
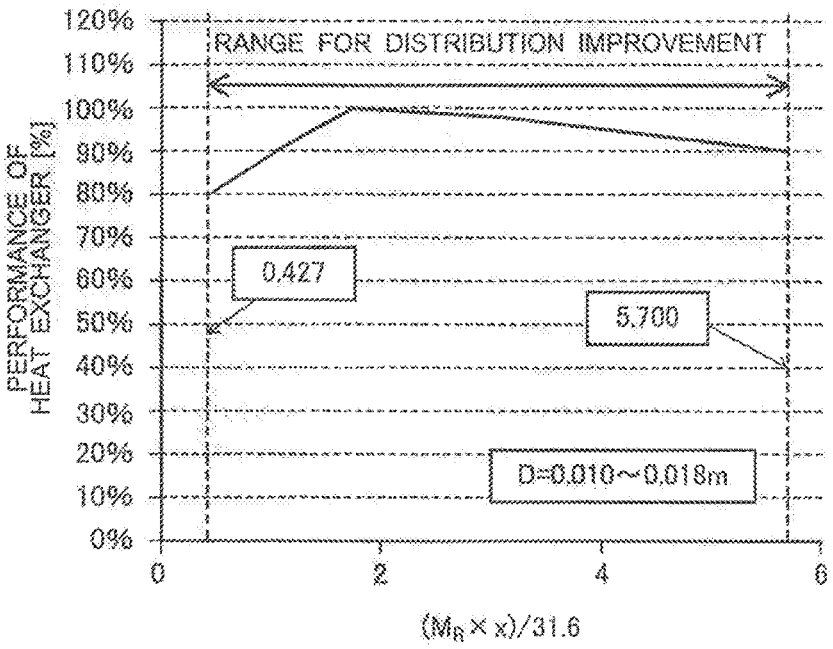
FIG. 30 is a graph illustrating the relationship between a parameter $(M_R \times x)/31.6$ concerning the thickness of the liquid film formed of the refrigerant and the performance of the heat exchanger according to Embodiment 4 of the present invention.

FIG. 30 is a graph illustrating the relationship between a parameter $(M_R \times x)/31.6$ concerning the thickness of the liquid film formed of the refrigerant and the performance of the heat exchanger according to Embodiment 4 of the present invention.

As illustrated in FIG. 30, if the heat-transfer tubes 22 have substantially the same length, it is preferable that a condition $0.427 \leq (M_R \times x)/31.6 \leq 5.700$ be satisfied with the inside diameter D [m] of the second header manifold 11 being within a range $0.010 \leq D \leq 0.018$. In such a case, the refrigerant flows through the second header manifold 11 forming a liquid film having an optimum thickness. Consequently, the distribution performance can be improved.

Figure 31:
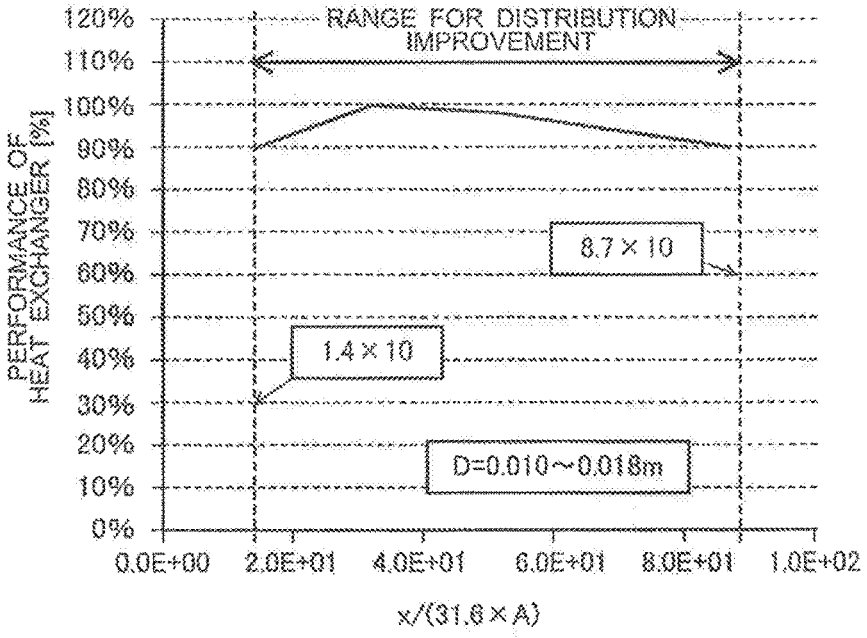
FIG. 31 is a graph illustrating the relationship between a parameter x/(31.6×A) concerning the thickness of the liquid film formed of the refrigerant and the performance of the heat exchanger according to Embodiment 4 of the present invention.

FIG. 31 is a graph illustrating the relationship between a parameter $x/(31.6 \times A)$ concerning the thickness of the liquid film formed of the refrigerant and the performance of the heat exchanger according to Embodiment 4 of the present invention.

As illustrated in FIG. 31, it is preferable that another parameter $x/(31.6 \times A)$ concerning the thickness of the liquid film formed of the refrigerant satisfy a condition $1.4 \times 10 \leq x/(31.6 \times A) \leq 8.7 \times 10$. In such a case, regardless of the flow rate of the refrigerant, the performance of refrigerant distribution can be made most suitable for the distribution of the volume of airflow generated by the top-flow fan 30.

Figure 32:
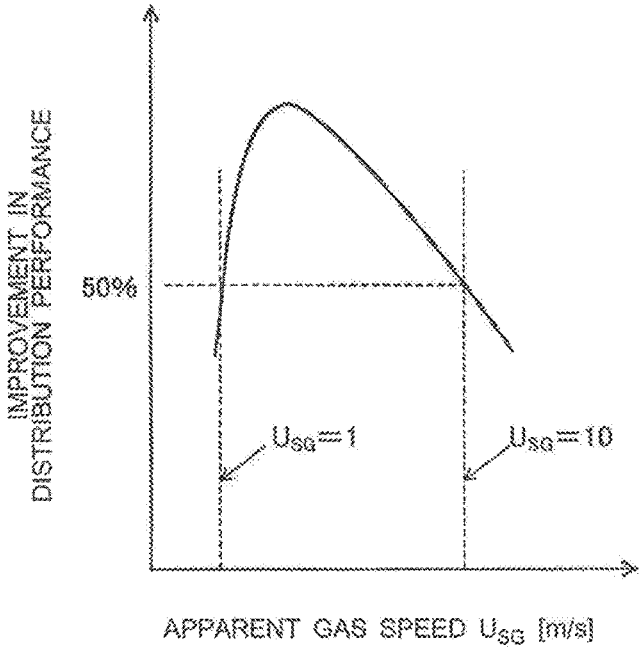
FIG. 32 is a graph illustrating the relationship between apparent gas speed and the improvement in the distribution performance according to Embodiment 4 of the present invention.

FIG. 32 is a graph illustrating the relationship between the apparent gas speed $U_{SG}$ [m/s] and the improvement in the distribution performance according to Embodiment 4 of the present invention.

As illustrated in FIG. 32, if the apparent gas speed $U_{SG}$ satisfies a condition $1 \leq U_{SG} \leq 10$, the performance reduction due to poor distribution can be suppressed to ½ or smaller.

The apparent gas speed $U_{SG}$ [m/s] is defined as $U_{SG} = (G \times x)/\rho_G$, where G is the flow speed [kg/($m^2$ s)] of the refrigerant flowing into the second header manifold 11, x is the quality of the refrigerant, and $\rho_G$ is the gas density [kg/$m^3$] of the refrigerant.

Furthermore, the flow speed G [kg/($m^2$ s)] of the refrigerant is defined as $G = M_R/(3600 \times A)$, where $M_R$ is the maximum flow rate [kg/h] of the refrigerant flowing into the second header 10, and A is the effective passage-section area [$m^2$] of the second header manifold 11.

In Embodiment 4, the outflow pipe 51 is connected to the bottom of the first header 40. However, the present invention is not limited to such a case.

Figure 33:
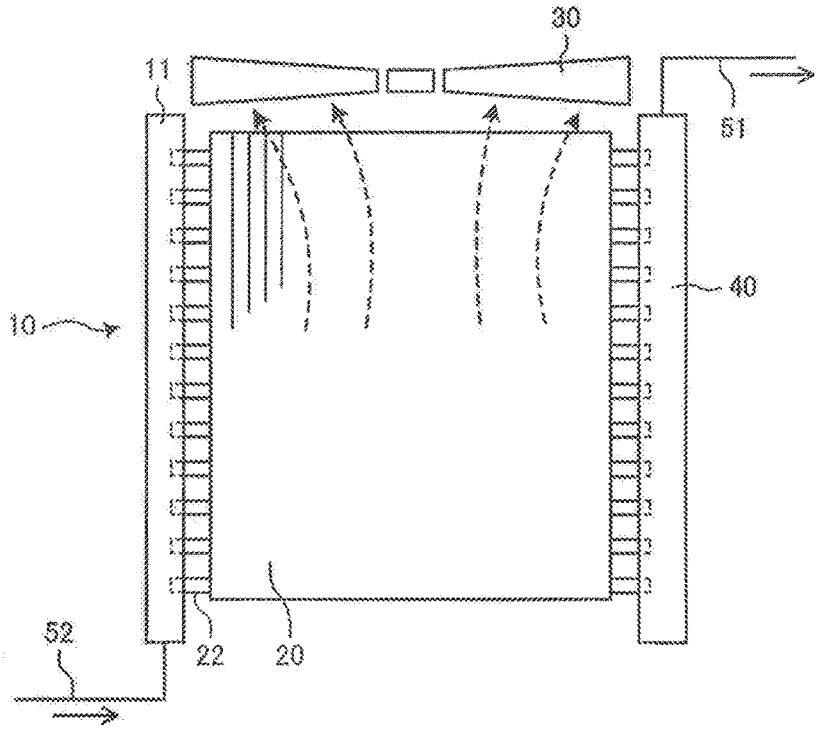
FIG. 33 is a schematic side view illustrating an example of the connection between the header and the outdoor heat exchanger according to Embodiment 4 of the present invention.

FIG. 33 is a schematic side view illustrating an example of the connection between the second header 10 and the outdoor heat exchanger 20 according to Embodiment 4 of the present invention.

As illustrated in FIG. 33, the outflow pipe 51 may be connected to the top of the first header 40. Such a configuration is preferable because the liquid refrigerant becomes more likely to reach the upper part of the second header 10.

Figure 34:
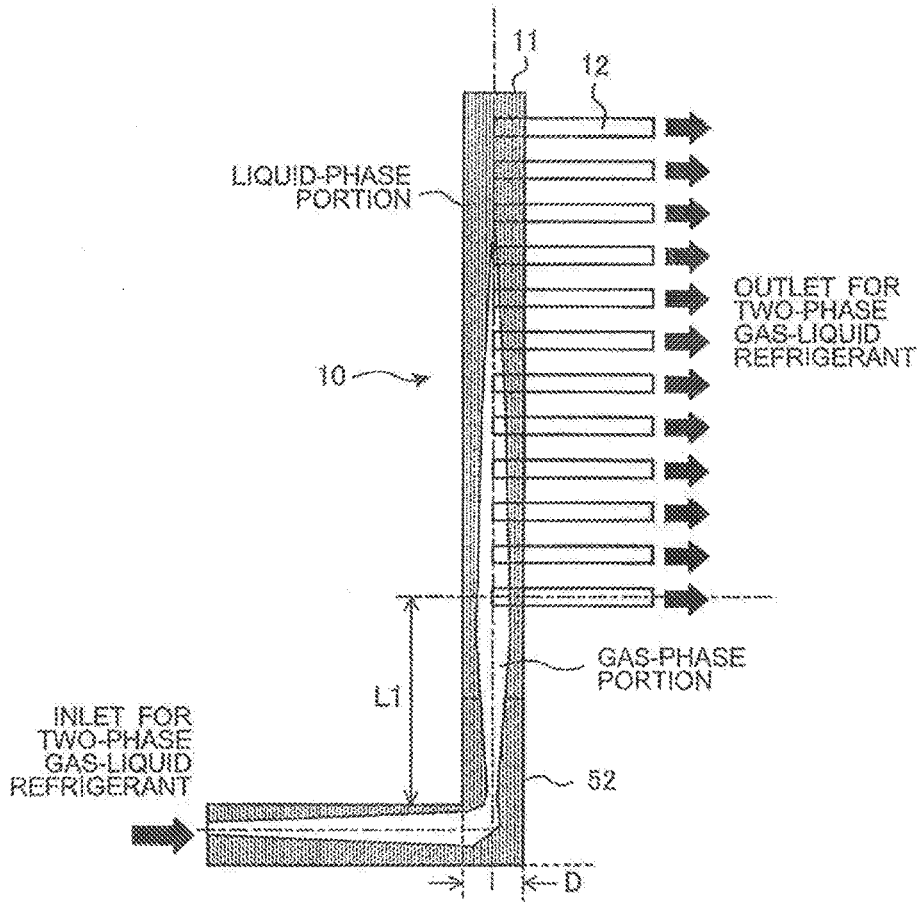
FIG. 34 is a schematic diagram illustrating an example of the connection between the header and an inflow pipe according to Embodiment 4 of the present invention.

FIG. 34 is a schematic diagram illustrating an example of the connection between the second header 10 and the inflow pipe 52 according to Embodiment 4 of the present invention.

As illustrated in FIG. 34, the inflow pipe 52 is connected to the bottom of the second header 10. Considering the development of the flow pattern, as the flow develops more, the thickness of the liquid film form forming an annular flow becomes smaller and the liquid refrigerant becomes more likely to reach the upper part of the second header manifold 11. In general, 100D is necessary for the liquid film to fully develop. According to the result of the experiment conducted by the present inventors, it is preferable that a length L1 from the lowest portion of the inflow pipe 52 to the center of the lowest one of the branch tubes 12 satisfy a condition $L1 \geq 5D$, where D is the inside diameter [m] of the second header manifold 11. Under such a condition, the degree of improvement in the distribution performance is substantially the same as that realized with a fully developed flow.

In the above case, as illustrated in FIG. 34, the inflow pipe 52 is connected to the second header 10 while being bent by 90 degrees. However, the above case is only exemplary.

Figure 35:
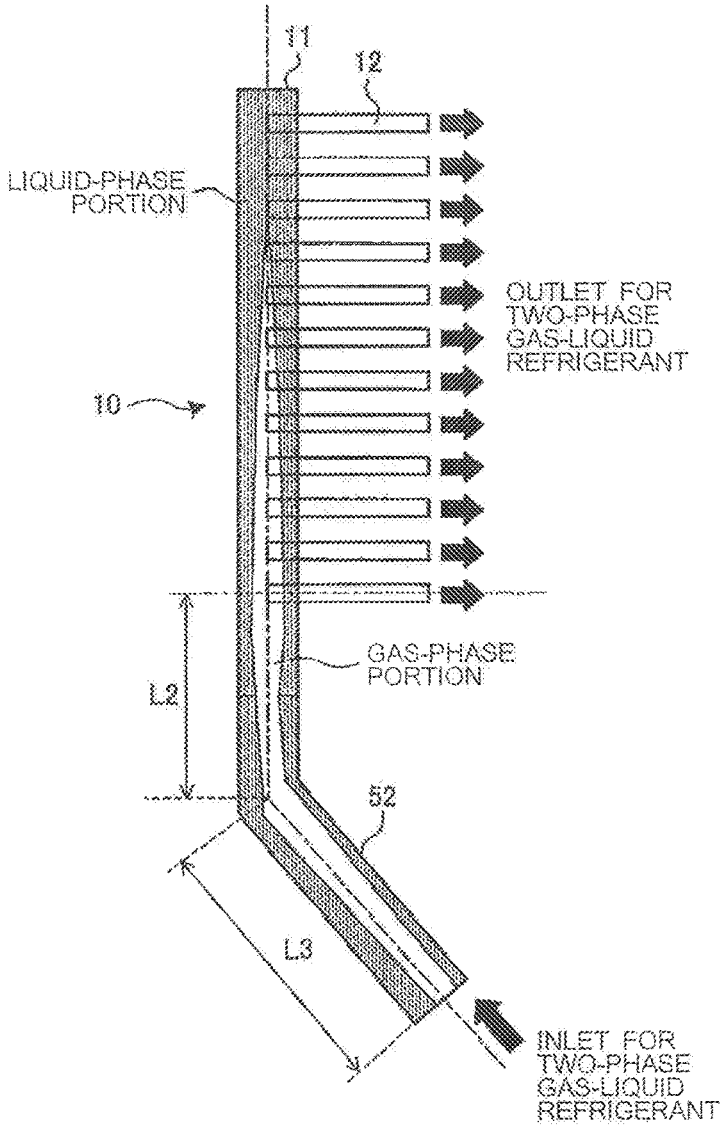
FIG. 35 is a schematic diagram illustrating another example of the connection between the header and the inflow pipe according to Embodiment 4 of the present invention.

FIG. 35 is a schematic diagram illustrating another example of the connection between the second header 10 and the inflow pipe 52 according to Embodiment 4 of the present invention.

The shape or orientation, that is, the attaching angle, of the inflow pipe 52 may be such that the inflow pipe is inclined, for example, as illustrated in FIG. 35.

In such a case, letting the combined length of a portion of the entrance portion of the second header 10 and a straight portion of the inflow pipe 52 be L2 and the inclined portion of the inflow pipe 52 be L3, it is preferable that a condition $(L2+L3) \geq 6D$ be satisfied, because the flow pattern develops well.

According to Embodiment 4, letting the flow rate [kg/h] of the refrigerant be $M_R$; the quality of the refrigerant flowing into the header manifold in the rated heating operation be x; and the effective passage-section area [$m^2$] of the header manifold be A, the quality x of the refrigerant flowing into the second header manifold 11 satisfies the condition $0.05 \leq x \leq 0.30$, and the parameter $(M_R \times x)/(31.6 \times A)$ concerning the thickness of the liquid film formed of the refrigerant falls within the range $0.004 \times 10^6 \leq (M_R \times x)/(31.6 \times A) \leq 0.120 \times 10^6$.

In such a configuration, more liquid refrigerant can be distributed to those heat-transfer tubes 22 nearer to the top-flow fan 30 where there is more airflow.

Accordingly, the efficiency of the outdoor heat exchanger 20 can be improved. Consequently, the energy efficiency can be improved.

According to Embodiment 4, letting the flow rate [kg/h] of the refrigerant be $M_R$, the quality of the refrigerant flowing into the header manifold in the rated heating operation be x, and the effective passage-section area [$m^2$] of the second header manifold 11 be A, the quality x of the refrigerant flowing into the second header manifold 11 satisfies the condition $0.05 \leq x \leq 0.30$, and the parameter $(M_R \times x)/(31.6 \times A)$ concerning the thickness of the liquid film formed of the refrigerant falls within the range $0.010 \times 10^6 \leq (M_R \times x)/(31.6 \times A) \leq 0.120 \times 10^6$.

In such a configuration, much more liquid refrigerant can be distributed to those heat-transfer tubes 22 nearer to the top-flow fan 30 where there is more airflow. Accordingly, the efficiency of the outdoor heat exchanger 20 can be improved further. Consequently, the energy efficiency can be improved further.

According to Embodiment 4, letting the flow rate [kg/h] of the refrigerant be $M_R$ and the quality of the refrigerant flowing into the second header manifold 11 in the rated heating operation be x, the quality x of the refrigerant flowing into the second header manifold 11 satisfies the condition $0.05 \leq x \leq 0.30$, the inside diameter D [m] of the second header manifold 11 falls within the range $0.010 \leq D \leq 0.018$, and the parameter $(M_R \times x)/31.6$ concerning the thickness of the liquid film formed of the refrigerant falls within the range $0.427 \leq (M_R \times x)/31.6 \leq 5.700$.

In such a configuration, a refrigerant distribution that is most suitable for the distribution of the volume of airflow generated by the top-flow fan 30 can be obtained. Accordingly, the efficiency of the outdoor heat exchanger 20 can be improved. Consequently, the energy efficiency can be improved.

According to Embodiment 4, letting the quality of the refrigerant flowing into the second header manifold 11 in the rated heating operation be x and the effective passage-section area [$m^2$] of the second header manifold 11 be A, the quality x of the refrigerant flowing into the second header manifold 11 satisfies the condition $0.05 \leq x \leq 0.30$, the inside diameter D [m] of the second header manifold 11 falls within the range $0.010 \leq D \leq 0.018$, and the parameter $x/(31.6 \times A)$ concerning the thickness of the liquid film formed of the refrigerant falls within the range $1.4 \times 10 \leq x/(31.6 \times A) \leq 8.7 \times 10$.

In such a configuration, a refrigerant distribution that is most suitable for the distribution of the volume of airflow generated by the top-flow fan 30 can be obtained. Accordingly, the efficiency of the outdoor heat exchanger 20 can be improved. Consequently, the energy efficiency can be improved.

According to Embodiment 4, letting the quality of the refrigerant flowing into the second header manifold 11 in the rated heating operation be x, the quality x of the refrigerant flowing into the second header manifold 11 satisfies the condition $0.05 \leq x \leq 0.30$, and the apparent gas speed $U_{SG}$ [m/s] of the refrigerant flowing into the second header manifold 11 falls within the range $1 \leq U_{GS} \leq 10$.

The apparent gas speed $U_{SG}$ [m/s] is defined as $U_{SG}=(G \times x)/\rho_G$, where G is the flow speed [kg/($m^2$ s)] of the refrigerant flowing into the second header manifold 11, x is the quality of the refrigerant, and $\rho_G$ is the gas density [kg/($m^3$)] of the refrigerant. Furthermore, the flow speed [kg/($m^2$ s)] of the refrigerant is defined as $G=M_R/(3600 \times A)$, where $M_R$ is the flow rate [kg/h] of the refrigerant flowing into the second header manifold 11 in the rated heating operation, and A is the effective passage-section area [$m^2$] of the second header manifold 11.

In such a configuration, a refrigerant distribution that is most suitable for the distribution of the volume of airflow generated by the top-flow fan 30 can be obtained. Accordingly, the efficiency of the outdoor heat exchanger 20 can be improved. Consequently, the energy efficiency can be improved.

According to Embodiment 4, the outdoor heat exchanger 20 includes the plurality of heat-transfer tubes 22 arranged in such a manner as to project therefrom on both sides. The outdoor heat exchanger 20 includes the first header 40 connected to one end of each of the plurality of heat-transfer tubes 22. The outdoor heat exchanger 20 includes the second header 10 connected to the other end of each of the plurality of heat-transfer tubes 22. The outdoor heat exchanger 20 includes the plurality of fins 21 joined to each of the plurality of heat-transfer tubes 22. The outdoor heat exchanger 20 forms part of the refrigeration cycle circuit through which refrigerant circulates. The second header 10 is the header according to any of Embodiments 1 to 4. The second header manifold 11 of the second header 10 has the flow space that communicates with the plurality of branch tubes 12 connected to the plurality of heat-transfer tubes 22, respectively. When the outdoor heat exchanger serves as an evaporator, gas-liquid two-phase refrigerant flows upward in the flow space and is discharged into the plurality of branch tubes 12.

In such a configuration, the gas-liquid two-phase refrigerant flows upward in the second header manifold 11 of the second header 10 and forms an annular flow or a churn flow. Hence, in the annular flow or the churn flow, more gas refrigerant is present around the center of the second header manifold 11, whereas more liquid refrigerant is present on the periphery. Therefore, more gas refrigerant is selectively distributed in the lower part of the second header manifold 11, making it easier for the liquid refrigerant to reach the upper part of the second header manifold 11. Accordingly, the performance of refrigerant distribution in the second header 10 is improved, and the efficiency of the outdoor heat exchanger 20 is improved. Consequently, the energy efficiency can be improved. Thus, with the second header 10 having a simplified configuration, a cost reduction is realized, and the performance of refrigerant distribution from the second header manifold 11 to the plurality of branch tubes 12 can be improved over a wide operating range. Consequently, the energy efficiency can be improved.

Embodiment 5

Embodiment 5 of the present invention will now be described. Description that has been given in any of Embodiments 1 to 4 is omitted. Elements that are the same as or equivalent to those described in any of Embodiments 1 to 4 are denoted by corresponding ones of the reference numerals.

Embodiment 5 employs tube-shape-converting joints 23 provided to the plurality of branch tubes 12, respectively, of the second header 10. The tube-shape-converting joints 23 each convert the tip of a corresponding one of the branch tubes 12 inserted into the second header manifold 11 from the flat tubular shape for the connection to a corresponding one of the flat heat-transfer tubes 22 included in the heat exchanger into the round tubular shape.

Figure 36:
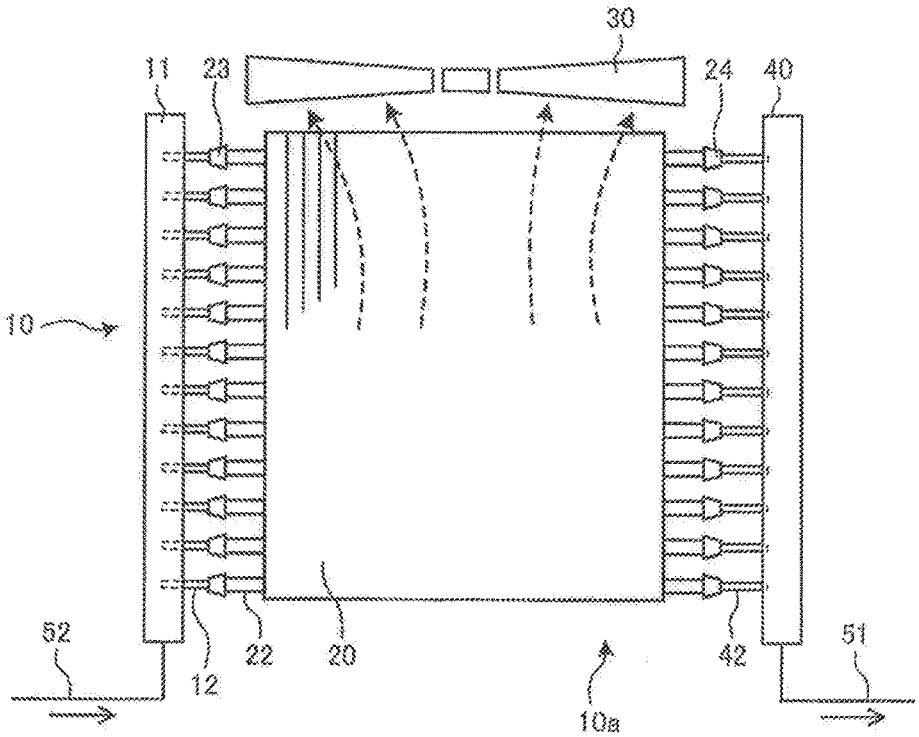
FIG. 36 is a schematic side view of an outdoor heat exchanger according to Embodiment 5 of the present invention.
Figure 37:
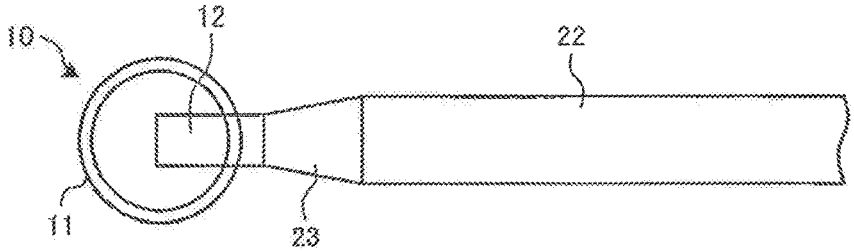
FIG. 37 is a top view of a header and a heat-transfer tube according to Embodiment 5 of the present invention.

FIG. 36 is a schematic side view of an outdoor heat exchanger 20 according to Embodiment 5 of the present invention. FIG. 37 is a top view of the second header 10 and the heat-transfer tube 22 according to Embodiment 5 of the present invention.

In Embodiment 5, the tube-shape-converting joints 23 are provided. The tube-shape-converting joints 23 connect the round tubular branch tubes 12 connected to the second header 10 and the flat tubular heat-transfer tubes 22 included in the outdoor heat exchanger 20 to each other, respectively, while changing the shape thereof. Furthermore, tube-shape-converting joints 24 are provided. The tube-shape-converting joints 24 connect round tubular branch tubes 42 connected to the first header 40 and the flat tubular heat-transfer tubes 22 included in the outdoor heat exchanger 20 to each other, respectively, while changing the shape thereof.

The tube-shape-converting joints 23 and 24 convert the shape of the branch tubes 12 and 42 inserted into the second header 10 and the first header 40 from the flat tubular shape for the heat-transfer tubes 22 into the round tubular shape.

Since the shape of the branch tubes 12 and 42 inserted into the second header 10 and the first header 40 is converted from the flat tubular shape into the round tubular shape, the effective passage-section area of each of the second header 10 and the first header 40 can be increased. Therefore, the increase in the pressure loss that is caused by the projecting portions of the branch tubes 12 and 42 can be suppressed, whereby the reduction in the performance of the outdoor heat exchanger 20 can be suppressed. Such an advantageous effect is pronounced particularly in the second header 10, in which the branch tubes 12 project into the second header manifold 11 in such a manner as to reach near the center.

Furthermore, the influence of the projecting portions of the branch tubes 12 upon the flow of the refrigerant in the second header manifold 11 can be reduced. Therefore, the flow pattern tends to be stabilized, whereby the improvement in the distribution performance that is brought by the projecting branch tubes 12 becomes greater.

Furthermore, with the tube-shape-converting joints 23 and 24, the diameters of the second header 10 and the first header 40 in a horizontal section can be reduced. Consequently, a distributor occupying a smaller space can be provided.

The configuration illustrated in FIG. 36 employs the tube-shape-converting joints 23 and 24 that are provided for the second header 10 and the first header 40, respectively. Alternatively, only the tube-shape-converting joints 23 may be provided to some of the plurality of branch tubes 12 included in the second header 10.

In such a case, it is effective that the tube-shape-converting joints 23 are provided to those branch tubes 12 that are near the inflow port of the header where the flow rate of the refrigerant is relatively high, because a greater reduction in the pressure loss can be realized.

The tube-shape-converting joint is not limited to those that convert the heat-transfer tube 22 having the flat tubular shape into a round tubular shape. For example, if the heat-transfer tube 22 is a round tube, the tube-shape-converting joint may be a converting joint that allows the diameter of the branch tube 12 to be smaller than the diameter of the heat-transfer tube 22. Other configurations are applicable as long as such a joint converts the heat-transfer tube 22 into the branch tube 12 such that the effective passage-section area of the second header manifold 11 becomes larger than in a hypothetical case where the heat-transfer tube 22 is made to project into the second header manifold 11.

According to Embodiment 5, the branch tubes 12 are provided with the tube-shape-converting joints 23 each convert the tip of a corresponding one of the branch tubes 12 inserted into the second header manifold 11 from the flat tubular shape for the connection to a corresponding one of the flat heat-transfer tubes 22 included in the heat exchanger into the round tubular shape.

In such a configuration, the reduction in the effective passage-section area of the second header manifold 11 that is caused by the insertion can be suppressed, whereby the disturbance of the flow pattern can be suppressed, realizing a greater improvement in the distribution performance.

Accordingly, the efficiency of the outdoor heat exchanger 20 is improved. Consequently, the energy efficiency can be improved.

Embodiment 6

Embodiment 6 of the present invention will now be described. Description that has been given in any of Embodiments 1 to 5 is omitted. Elements that are the same as or equivalent to those described in any of Embodiments 1 to 5 are denoted by corresponding ones of the reference numerals.

In Embodiment 6, at least two second headers 10*a* and 10*b* that are separate from each other in the height direction are connected to each other on the upstream side in the direction in which the refrigerant flows into the outdoor heat exchanger 20 in the heating operation.

Figure 38:
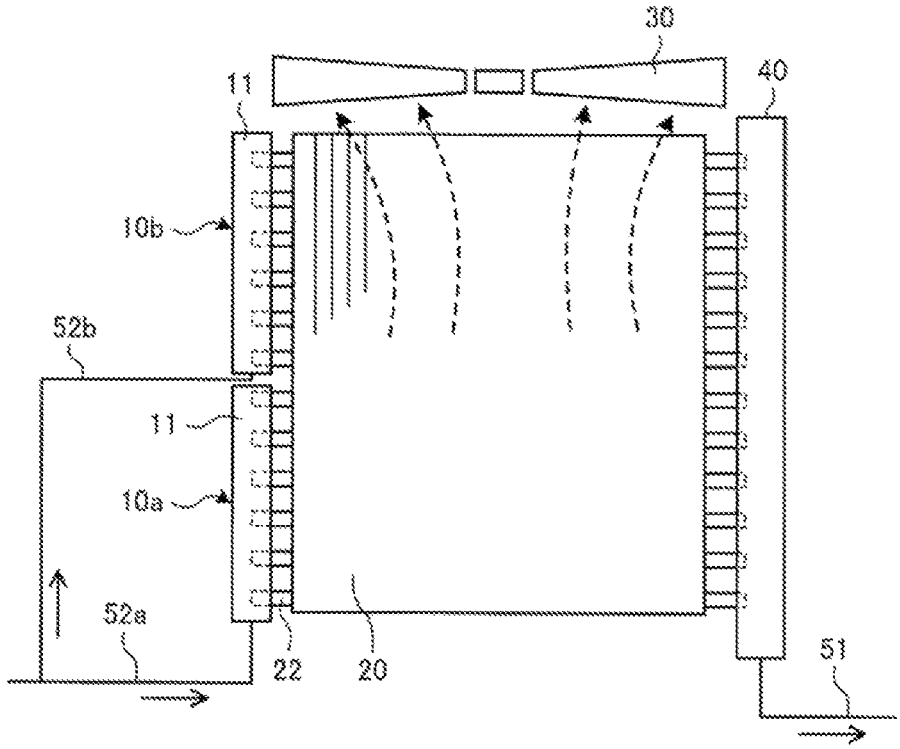
FIG. 38 is a schematic side view of an outdoor heat exchanger according to Embodiment 6 of the present invention.

FIG. 38 is a schematic side view of an outdoor heat exchanger 20 according to Embodiment 6 of the present invention.

As illustrated in FIG. 38, the second header 10*a* into which the gas-liquid two-phase refrigerant flows from a first inflow pipe 52*a*, and the second header 10*b* into which the gas-liquid two-phase refrigerant flows from a second inflow pipe 52*b* are provided separately from each other in the height direction of the outdoor heat exchanger 20.

Since the outdoor heat exchanger 20 is divided into the second headers 10*a* and 10*b* in the height direction, the influence of the head difference can be reduced. Accordingly, more liquid refrigerant can be distributed to the upper part of the outdoor heat exchanger 20 where there is more airflow generated by the top-flow fan 30. Therefore, a greater improvement in the efficiency of performance of the outdoor heat exchanger 20 and in the energy efficiency can be realized than in a case where the second header is not divided.

Embodiment 6 concerns a case where the second header is divided into two pieces. However, the number of pieces into which the second header is divided and the number of branch tubes provided to each of the pieces of the header are not limited.

According to Embodiment 6, at least two second headers 10*a* and 10*b* that are separate from each other in the height direction are connected to each other on the upstream side in the direction in which the refrigerant flows into the outdoor heat exchanger 20 in the heating operation.

In such a configuration, the influence of the head difference in the second headers 10*a* and 10*b* can be reduced. Consequently, a greater improvement in the distribution performance can be realized.

Embodiment 7

Embodiment 7 of the present invention will now be described. Description that has been given in any of Embodiments 1 to 6 is omitted. Elements that are the same as or equivalent to those described in any of Embodiments 1 to 6 are denoted by corresponding ones of the reference numerals.

In Embodiment 7, the outdoor heat exchanger 20 including the second header 10 according to any of Embodiments 1 to 6 is connected to a compressor 61, an expansion device 62, and an indoor heat exchanger 63 by refrigerant pipes in such a manner as to form a refrigeration cycle circuit, whereby an air-conditioning apparatus 200 capable of performing a heating operation is obtained.

Figure 39:
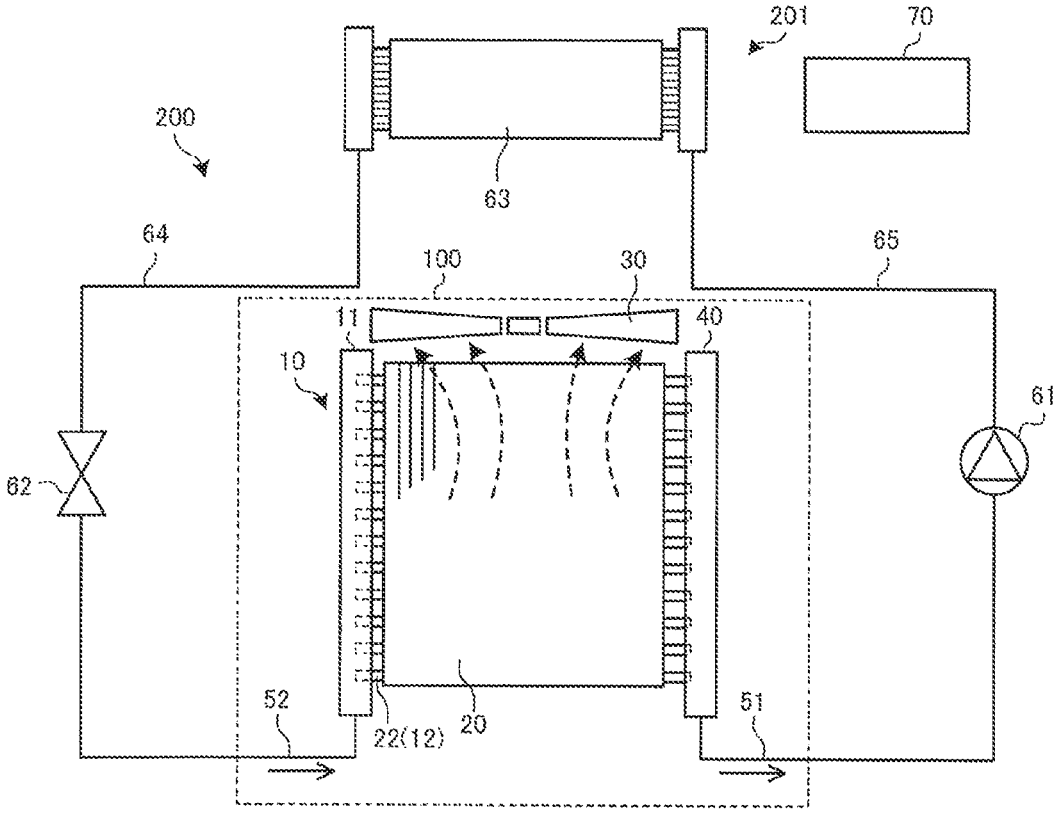
FIG. 39 is a diagram illustrating a configuration of an air-conditioning apparatus according to Embodiment 7 of the present invention.

FIG. 39 is a diagram illustrating a configuration of an air-conditioning apparatus 200 according to Embodiment 7 of the present invention.

In the air-conditioning apparatus 200 illustrated in FIG. 39, the outdoor unit 100 that includes the second header 10 and the outdoor heat exchanger 20 is connected to an indoor unit 201.

The expansion device 62, such as an expansion valve, is provided on the upstream side of the inflow pipe 52 of the outdoor heat exchanger 20. The expansion device 62 and the indoor unit 201 are connected to each other by a connecting pipe 64. The indoor unit 201 and the compressor 61 are connected to each other by a connecting pipe 65. The refrigerant discharged from the outdoor heat exchanger 20 flows into the compressor 61 through the outflow pipe 51.

A controller 70 is configured to control the compressor 61 or the expansion device 62 such that the quality x of the refrigerant flowing into the second header 10 falls within the range $0.05 \leq x \leq 0.30$ in the rated heating operation.

The controller 70 includes a microcomputer including a CPU, a ROM, a RAM, an I/O port, and so forth.

The controller 70 is provided with various sensors connected thereto wirelessly or by control signal lines so that the controller 70 can receive detected values therefrom. The controller 70 is connected in such a manner as to be capable of controlling the rotation speed of the compressor 61 or the opening degree of the expansion device 62 wirelessly or via the control signal lines.

Although the type or shape of the indoor unit 201 is not limited herein, the indoor unit 201 includes, in general, the indoor heat exchanger 63, a fan that is not illustrated, and the expansion device 62 such as an expansion valve. The indoor unit 201 is provided with indoor-unit headers connected to both sides, respectively, of the indoor heat exchanger 63, whereby refrigerant flows through the heat-transfer tubes of the indoor heat exchanger 63.

Now, the flow of the refrigerant in the air-conditioning apparatus 200 according to Embodiment 7 in the heating operation will be described with reference to FIG. 39.

In the drawings, solid-line arrows represent the flow of refrigerant in the heating operation. Gas refrigerant compressed by the compressor 61 and thus having a high temperature and a high pressure flows through the connecting pipe 65 into the indoor unit 201. The refrigerant thus flowed into the indoor unit 201 flows into the header, is distributed to the plurality of heat-transfer tubes included in the indoor heat exchanger 63, and flows into the indoor heat exchanger 63. The refrigerant in the indoor heat exchanger 63 releases its heat to ambient air, turns into single-phase liquid refrigerant or gas-liquid two-phase refrigerant, and flows into and is collected in the header. The refrigerant thus collected in the header flows through the connecting pipe 64 into the expansion device 62. In the expansion device 62, the refrigerant turns into low-temperature, low-pressure, gas-liquid two-phase refrigerant or single-phase liquid refrigerant. Then, the refrigerant flows through the inflow pipe 52 into the second header 10.

The gas-liquid two-phase refrigerant reaches the bottom of the second header 10 and is distributed to the plurality of heat-transfer tubes 22 while flowing upward in the second header manifold 11. The refrigerant thus distributed receives heat from air flowing outside the heat-transfer tubes 22, whereby the phase of the refrigerant changes from the liquid phase to the gas phase. Then, the gas-phase refrigerant is discharged into the first header 40. In the first header 40, the refrigerant is collected from the heat-transfer tubes 22. The collected refrigerant is discharged from the bottom of the first header 40 and flows into the compressor 61 again.

The frequency of the compressor 61 changes with the capacity of the indoor heat exchanger 63 that is required for the indoor unit 201.

FIG. 39 illustrates a case where one indoor unit 201 is provided for one outdoor unit 100. However, the number of indoor units 201 and the number of outdoor units 100 to be provided are not limited.

FIG. 39 illustrates a case where header-type distributors are provided at the two respective ends of the set of heat-transfer tubes included in the indoor heat exchanger 63 of the indoor unit 201. However, the type of the distributor is not limited. For example, a distributor-type (collision-type) distributor or the like may be connected to the heat-transfer tubes of the indoor heat exchanger 63.

The opening degree of the expansion device 62 is controlled such that the quality x of the refrigerant flowing into the second header 10 falls within the range $0.05 \leq x \leq 0.30$ in the rated heating operation. The opening degree is controlled by, for example, storing a table summarizing optimum opening degrees of the expansion device 62 for rotation speeds of the compressor 61. In such a control method, an improvement in the distribution performance that is brought by the branch tubes 12 projecting into the second header 10 can be realized under widely varying operating conditions.

According to Embodiment 7, the air-conditioning apparatus 200 includes the compressor 61, the indoor heat exchanger 63, the expansion device 62, and the outdoor heat exchanger 20 that form a refrigeration cycle circuit through which refrigerant circulates. The outdoor heat exchanger 20 is the heat exchanger according to any of Embodiments 1 to 6. The air-conditioning apparatus 200 includes the controller 70 configured to control the compressor 61 or the expansion device 62 such that the quality x of the refrigerant flowing into the second header 10 falls within the range $0.05 \leq x \leq 0.30$ in the rated heating operation.

In such a configuration, the distribution performance of the second header 10 can be improved stably over a wide range of operating conditions. Accordingly, the efficiency of the outdoor heat exchanger 20 can be improved. Consequently, the energy efficiency can be improved.

Embodiment 8

Figure 40:
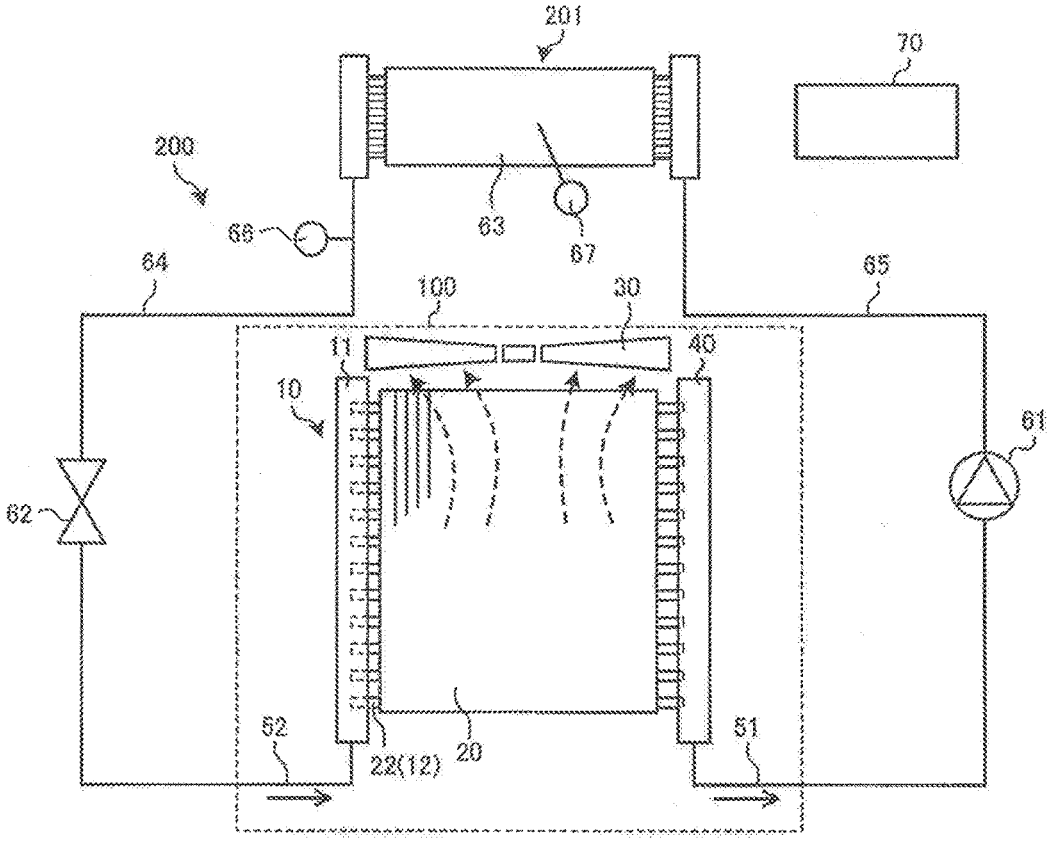
FIG. 40 is a diagram illustrating a configuration of an air-conditioning apparatus according to Embodiment 8 of the present invention.

FIG. 40 is a diagram illustrating a configuration of an air-conditioning apparatus 200 according to Embodiment 8 of the present invention. Description that has been given in Embodiment 7 is omitted. Elements that are the same as or equivalent to those described in Embodiment 7 are denoted by corresponding ones of the reference numerals.

In Embodiment 8, the air-conditioning apparatus 200 according to Embodiment 7 includes a first temperature sensor 66 provided on the connecting pipe 64 and that detects the temperature at the outlet of the indoor unit. Furthermore, the air-conditioning apparatus 200 includes a second temperature sensor 67 provided on the indoor heat exchanger 63 and that detects the temperature of the refrigerant flowing through the heat-transfer tubes of the indoor heat exchanger 63.

In the heating operation, the controller 70 measures a condensation saturation temperature Tc of the refrigerant by using the second temperature sensor 67 and a condenser outlet temperature TRout of the refrigerant by using the first temperature sensor 66 provided at the outlet of the indoor unit. Thus, the controller 70 detects S.C. at the outlet of the condenser (=Tc−TRout, also referred to as outlet temperature difference) and controls the quality x flowing into the second header 10 to fall within the range $0.05 \leq x \leq 0.30$.

The S.C. can be controlled by adjusting the opening degree of the expansion device 62 and by, for example, examining in advance the relationship among the frequency of the compressor 61, the S.C., and the quality. In such a control method, an improvement in the distribution performance that is brought by the branch tube 12 projecting into the second header 10 can be realized under widely varying operating conditions.

According to Embodiment 8, the air-conditioning apparatus 200 includes the compressor 61, the indoor heat exchanger 63, the expansion device 62, and the outdoor heat exchanger 20 that form a refrigeration cycle circuit through which refrigerant circulates. The outdoor heat exchanger 20 is the heat exchanger according to any of Embodiments 1 to 6. The air-conditioning apparatus 200 includes the first temperature sensor 66 provided on the downstream side, in the heating operation, of the indoor heat exchanger 63. The air-conditioning apparatus 200 includes the second temperature sensor 67 provided on the indoor heat exchanger. The air-conditioning apparatus 200 includes the controller 70 configured to calculate the outlet temperature difference S.C. (=Tc−TRout) of the indoor heat exchanger 63 from the temperature (the condenser outlet temperature TRout) detected by the first temperature sensor 66 and the temperature (the condensation saturation temperature Tc) detected by the second temperature sensor 67 in the heating operation, and to control the compressor 61 or the expansion device 62 such that the quality x of the refrigerant flowing into the second header 10 falls within the range $0.05 \leq x \leq 0.30$ in the rated heating operation.

In such a configuration, the distribution performance of the second header 10 can be improved stably over a wide range of operating conditions. Accordingly, the efficiency of the outdoor heat exchanger 20 can be improved. Consequently, the energy efficiency can be improved.

Embodiment 9

Figure 41:
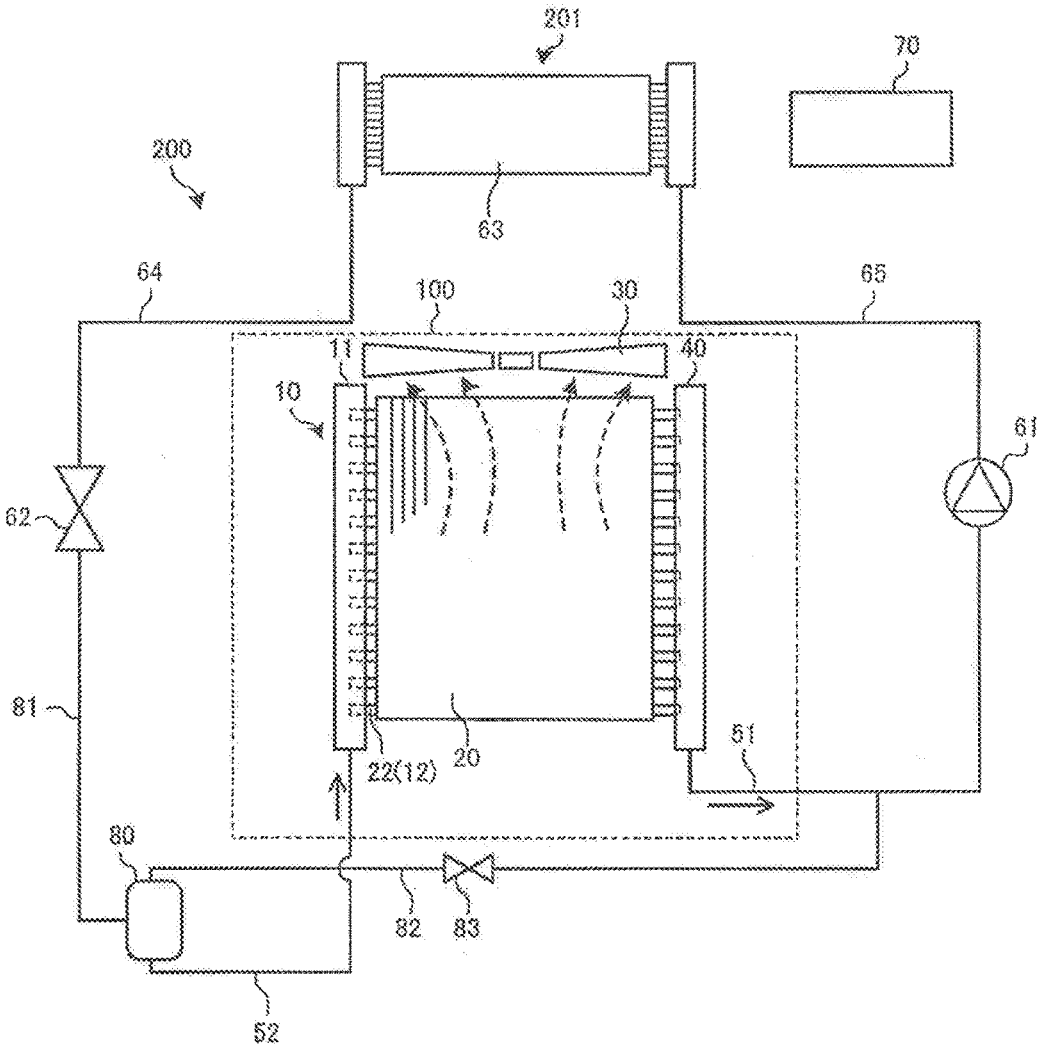
FIG. 41 is a diagram illustrating a configuration of an air-conditioning apparatus according to Embodiment 9 of the present invention.

FIG. 41 is a diagram illustrating a configuration of an air-conditioning apparatus 200 according to Embodiment 9 of the present invention. Description that has been given in Embodiment 7 or 8 is omitted. Elements that are the same as or equivalent to those described in Embodiment 7 or 8 are denoted by corresponding ones of the reference numerals.

In Embodiment 9, the air-conditioning apparatus 200 according to Embodiment 7 or 8 includes a gas-liquid separator 80 provided between the second header 10 and the expansion device 62. The expansion device 62 and the gas-liquid separator 80 are connected to each other by a connecting pipe 81. The gas-liquid separator 80 and the outflow pipe 51 are connected to each other by a gas bypass pipe 82. The gas bypass pipe 82 allows gas refrigerant obtained through the separation by the gas-liquid separator 80 to flow directly to the compressor 61. The gas bypass pipe 82 is provided at a halfway position thereof with a gas-bypass regulating valve 83. The opening degree of the gas-bypass regulating valve 83 is changeable by the controller 70.

The controller 70 adjusts the opening degree of the gas-bypass regulating valve 83 in accordance with operating conditions and thus controls the quality x of the refrigerant flowing into the second header 10 to fall within the range $0.05 \leq x \leq 0.30$.

In such a control method, a greater improvement in the distribution performance of the second header 10 that is brought by the branch tubes 12 projecting thereinto can be realized under widely varying operating conditions.

In addition, since some of the gas refrigerant is made to flow into the gas bypass pipe 82 and thus bypass the outdoor heat exchanger 20, the pressure loss in the outdoor heat exchanger 20 can be reduced. Consequently, the efficiency of the outdoor heat exchanger 20 can be improved.

The gas-bypass regulating valve 83 whose opening degree is changeable may be an electronic expansion valve or the like whose opening degree is adjustable. Alternatively, for example, the gas-bypass regulating valve 83 may be substituted for by a combination of a solenoid valve and a capillary tube or a check valve and a flow resistor provided to the gas bypass pipe 82, but is not specifically limited.

Figure 42:
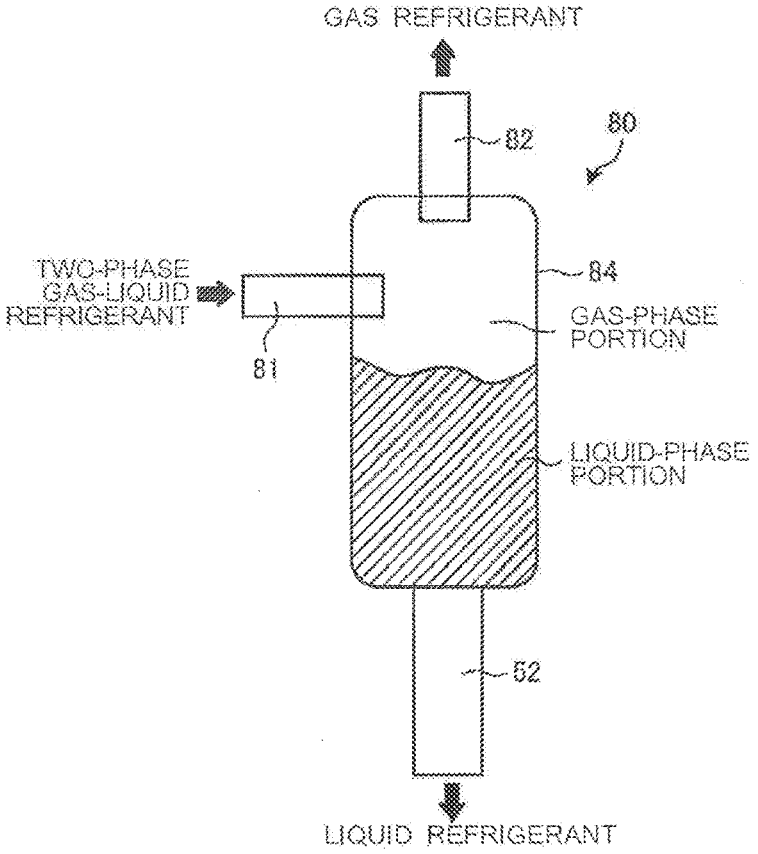
FIG. 42 is a diagram illustrating a configuration of a gas-liquid separator according to Embodiment 9 of the present invention.
Figure 43:
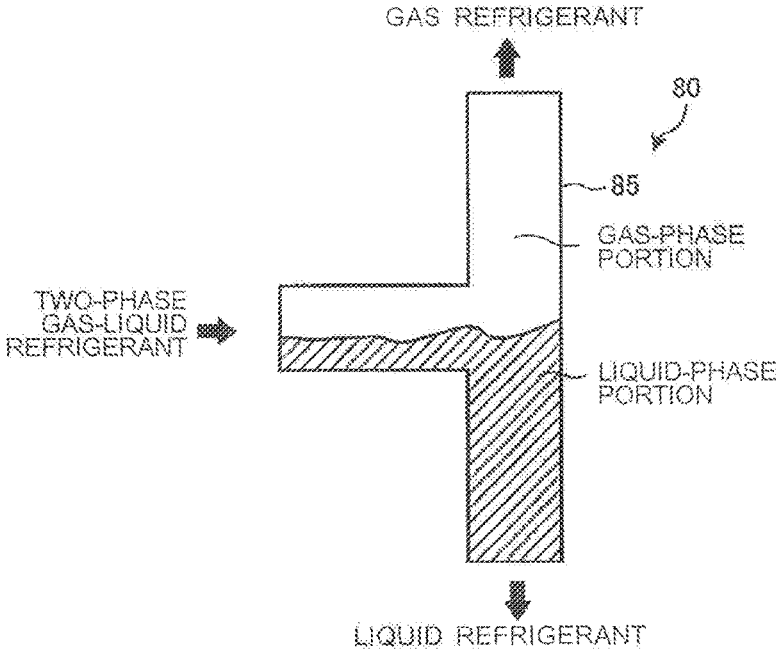
FIG. 43 is a diagram illustrating an example of the configuration of the gas-liquid separator according to Embodiment 9 of the present invention.
Figure 44:
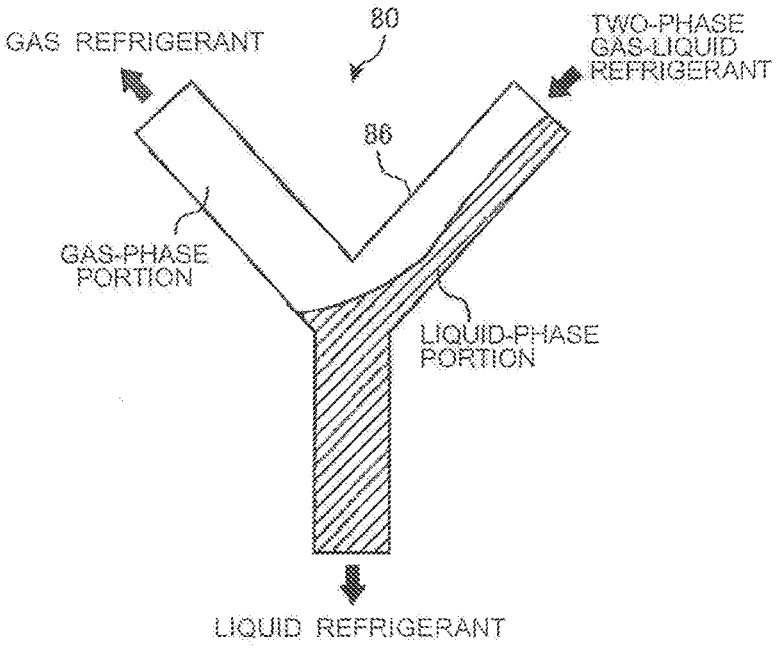
FIG. 44 is a diagram illustrating another example of the configuration of the gas-liquid separator according to Embodiment 9 of the present invention.

FIG. 42 is a diagram illustrating a configuration of the gas-liquid separator 80 according to Embodiment 9 of the present invention. FIG. 43 is a diagram illustrating an example of the configuration of the gas-liquid separator 80 according to Embodiment 9 of the present invention. FIG. 44 is a diagram illustrating another example of the configuration of the gas-liquid separator 80 according to Embodiment 9 of the present invention.

In general, as illustrated in FIG. 42, the gas-liquid separator 80 is formed of a gas-liquid-separating container 84 but is not limited to such a configuration.

For example, a simple gas-liquid separator 80 that utilizes the orientation of the refrigerant pipe may be employed, such as a T-shaped branching pipe 85 illustrated in FIG. 43 or a Y-shaped branching pipe 86 illustrated in FIG. 44.

The controller 70 controls, for example, the quality x to fall within the range $0.05 \leq x \leq 0.30$ in the rated heating operation. More preferably, the controller 70 controls the gas-bypass regulating valve 83 to be open in the rated heating operation but to be closed under the other conditions. The degree to which the gas-bypass regulating valve 83 is opened is determined by, for example, examining in advance the relationship between the rotation speed of the compressor 61 and the opening degree that is optimum therefor. Alternatively, the degree to which the gas-bypass regulating valve 83 is opened may be determined by examining the relationship between the number of operating indoor units 201 and the opening degree that is optimum therefor.

While FIG. 41 illustrates a case where the gas-liquid separator 80 is provided outside the outdoor unit 100, the present invention is not limited to such a case. For example, the gas-liquid separator 80 may be included in the outdoor unit 100.

According to Embodiment 9, the air-conditioning apparatus 200 includes the compressor 61, the indoor heat exchanger 63, the expansion device 62, and the outdoor heat exchanger 20 that form a refrigeration cycle circuit through which refrigerant circulates. The outdoor heat exchanger 20 is the heat exchanger according to any of Embodiments 1 to 6. The air-conditioning apparatus 200 includes the gas-liquid separator 80 provided between the outdoor heat exchanger 20 and the expansion device 62. The air-conditioning apparatus 200 includes the gas bypass pipe 82 that allows the gas refrigerant obtained through the separation by the gas-liquid separator 80 to flow directly to the compressor 61. The air-conditioning apparatus 200 includes the gas-bypass regulating valve 83 provided on the gas bypass pipe 82. The air-conditioning apparatus 200 includes the controller 70 configured to control the gas-bypass regulating valve 83 in accordance with operating conditions such that the quality x of the refrigerant flowing into the second header 10 falls within the range $0.05 \leq x \leq 0.30$.

In such a configuration, an improvement in the distribution performance of the second header 10 can be realized over a wide range of operating conditions. Accordingly, the efficiency of the outdoor heat exchanger 20 can be improved. Consequently, the energy efficiency can be improved.

Embodiment 10

Figure 45:
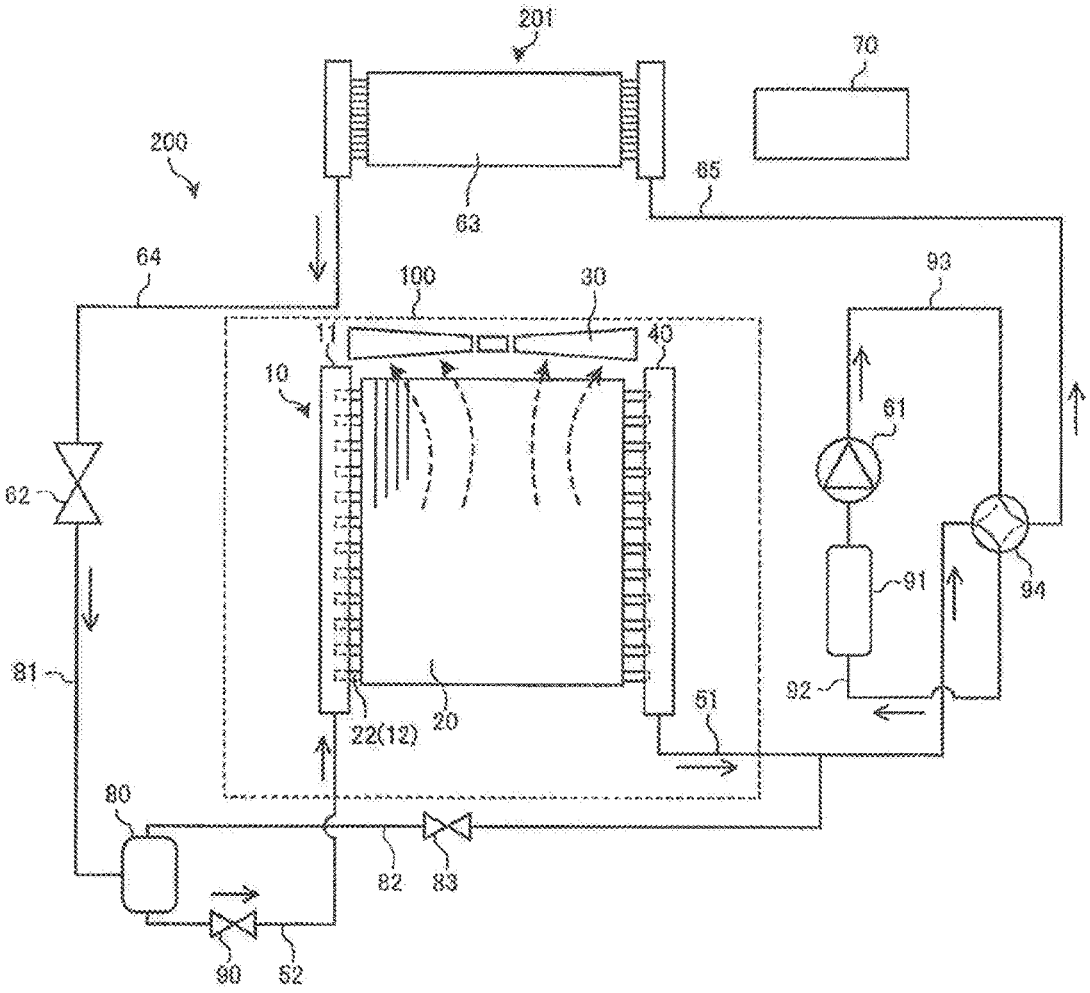
FIG. 45 is a diagram illustrating a configuration of an air-conditioning apparatus according to Embodiment 10 of the present invention in a heating operation.
Figure 46:
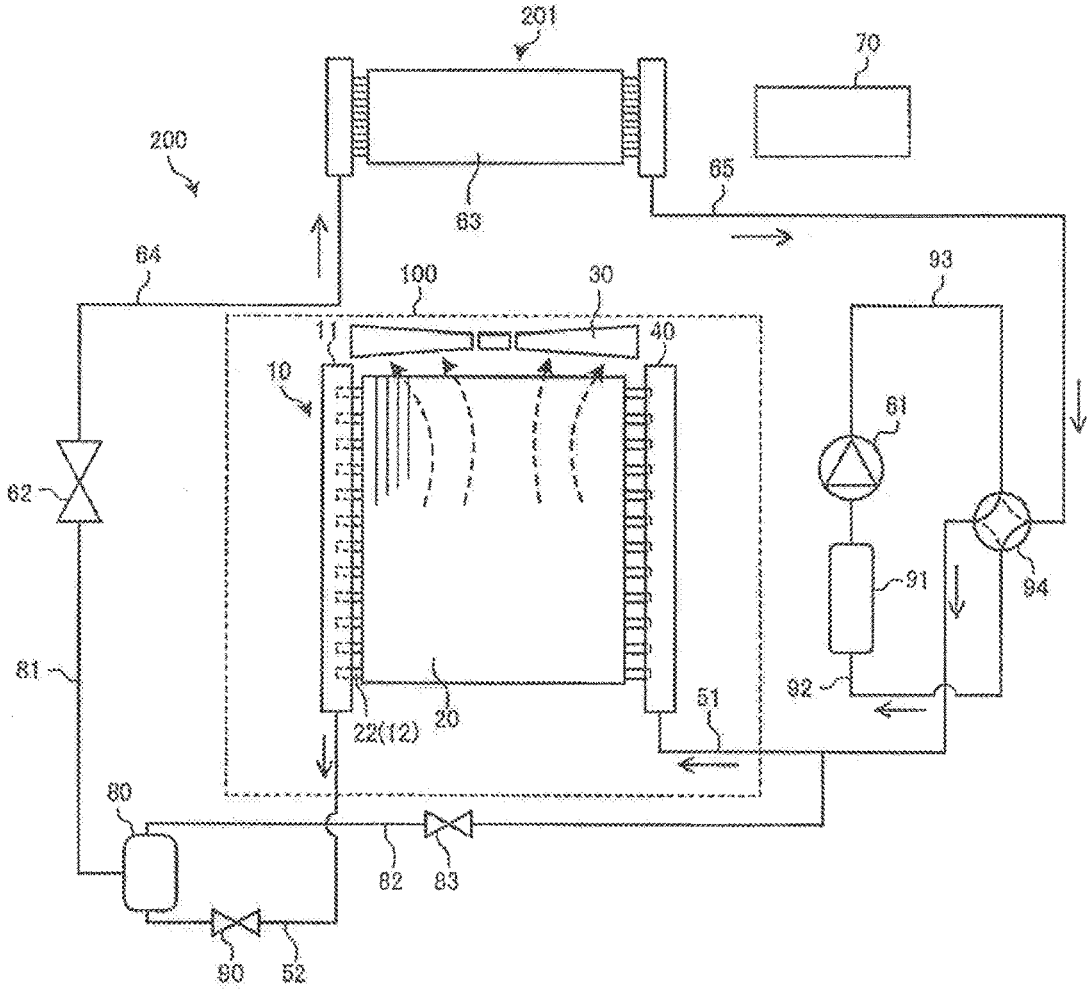
FIG. 46 is a diagram illustrating a configuration of the air-conditioning apparatus according to Embodiment 10 of the present invention in a cooling operation.

FIG. 45 is a diagram illustrating a configuration of an air-conditioning apparatus 200 according to Embodiment 10 of the present invention in a heating operation. In the drawing, solid-line arrows represent the flow of refrigerant in the heating operation. FIG. 46 is a diagram illustrating a configuration of the air-conditioning apparatus 200 according to Embodiment 10 of the present invention in a cooling operation. In the drawing, solid-line arrows represent the flow of refrigerant in the cooling operation. Description that has been given in any of Embodiments 7 to 9 is omitted. Elements that are the same as or equivalent to those described in any of Embodiments 7 to 9 are denoted by corresponding ones of the reference numerals.

In Embodiment 10, a header-preceding regulating valve 90 is provided at a halfway position of the inflow pipe 52 between the gas-liquid separator 80 and the second header 10 according to Embodiment 9. Furthermore, an accumulator 91 is provided on the upstream side with respect to the compressor 61. The accumulator 91 is provided on the upstream side thereof with an accumulator inflow pipe 92. The compressor 61 is provided on the discharge side thereof with a compressor discharge pipe 93. Furthermore, a four-way valve 94 that switches the flow of the refrigerant between that for the cooling operation and that for the heating operation is provided.

The controller 70 controls the opening degree of the header-preceding regulating valve 90, whereby completely separated liquid refrigerant is obtained by the gas-liquid separator 80 even at a low flow rate of the refrigerant. Therefore, a situation where $x<0.05$ can be prevented. Accordingly, an improvement in the efficiency of the outdoor heat exchanger 20 is realized with a stable improvement in the distribution performance over a wide operating range. Consequently, the energy efficiency can be improved.

The accumulator 91 is provided on the upstream side with respect to the compressor 61 so that the entry of the liquid refrigerant into the compressor 61 is suppressed or excessive refrigerant is stored therein. In such a configuration, the controller 70 adjusts the opening degree of the expansion device 62 and the opening degree of the header-preceding regulating valve 90. Thus, the inflow pipe 52, the connecting pipe 81, and the gas-liquid separator 80 that are provided between the expansion device 62 and the header-preceding regulating valve 90 can be used as a liquid storage. It is preferable to use such a liquid storage because the capacity of the accumulator 91 can be reduced correspondingly.

In the cooling operation, the controller 70 fully opens the header-preceding regulating valve 90. Thus, the liquid refrigerant can be stored in the inflow pipe 52, a portion of the gas bypass pipe 82, the gas-liquid separator 80, and the connecting pipe 81. Therefore, the S.C. at the outlet of the outdoor heat exchanger 20 can be reduced. Such a configuration is preferable because, in the cooling operation as well, the efficiency of the outdoor heat exchanger 20 can be improved, and the energy efficiency can be improved.

Now, the flow of the refrigerant in the cooling operation will be described.

As illustrated in FIG. 46, refrigerant that is discharged from the compressor 61 has a high temperature and a high pressure and flows through the compressor discharge pipe 93, the four-way valve 94, and the outflow pipe 51 into the first header 40. In the first header 40, the refrigerant is distributed to the plurality of heat-transfer tubes 22. The refrigerant thus distributed releases its heat to the atmosphere around the outdoor heat exchanger 20, turns into gas-liquid two-phase refrigerant or liquid refrigerant, is collected in the second header 10, flows through the inflow pipe 52, and is discharged. Then, the refrigerant flows through the header-preceding regulating valve 90, the gas-liquid separator 80, and the connecting pipe 81, is expanded by the expansion device 62, turns into low-pressure, gas-liquid two-phase refrigerant or single-phase liquid refrigerant, and flows into the indoor unit 201. The refrigerant thus flowed into the indoor unit 201 takes heat from the atmosphere around the indoor heat exchanger 63 of the indoor unit 201 and evaporates into single-phase gas refrigerant or gas-liquid two-phase refrigerant containing a large amount of gas refrigerant. Then, the refrigerant flows through the header and the connecting pipe 65, further flows through the four-way valve 94, the accumulator inflow pipe 92, and the accumulator 91, and flows into the compressor 61 again.

Now, the reason why the efficiency of the outdoor heat exchanger 20 can be improved either in the heating operation or in the cooling operation by adjusting the header-preceding regulating valve 90, the expansion device 62, and the gas-bypass regulating valve 83 according to Embodiment 10 will be described.

In the heating operation, the controller 70 adjusts the opening degree of the expansion device 62, thereby turning the refrigerant into a gas-liquid two-phase state. In this step, the controller 70 fully opens the header-preceding regulating valve 90 and opens the gas-bypass regulating valve 83, whereby the flow rate of the gas refrigerant flowing into the second header 10 can be reduced. Accordingly, the quality x of the refrigerant flowing into the second header 10 is controlled to fall within the range $0.05 \leq x \leq 0.30$. Thus, an improvement in the distribution performance that is brought by the projecting branch tube 12 is realized, and the efficiency of the outdoor heat exchanger 20 can be improved. Consequently, the energy efficiency can be improved.

In the cooling operation, the controller 70 fully opens the gas-bypass regulating valve 83 under a condition where a large amount of refrigerant is necessary, thereby turning the refrigerant into a low-pressure, gas-liquid two-phase state at the header-preceding regulating valve 90. Thus, the two-phase gas-liquid area in the air-conditioning apparatus 200 is increased. In such a manner, the amount of refrigerant can be optimized. Consequently, the efficiency of the air-conditioning apparatus 200 can be improved. On the other hand, if there is an excessively large amount of refrigerant, the controller 70 fully opens the header-preceding regulating valve 90, thereby increasing the area filled with liquid refrigerant. Accordingly, the area of the outdoor heat exchanger 20 that is filled with liquid refrigerant can be reduced. Thus, the heat-transfer area filled with single-phase liquid refrigerant can be reduced. Therefore, the efficiency of the outdoor heat exchanger 20 can be improved.

The mechanism of improving the efficiency of the outdoor heat exchanger 20 by reducing the area filled with liquid refrigerant is as follows.

Figure 47:
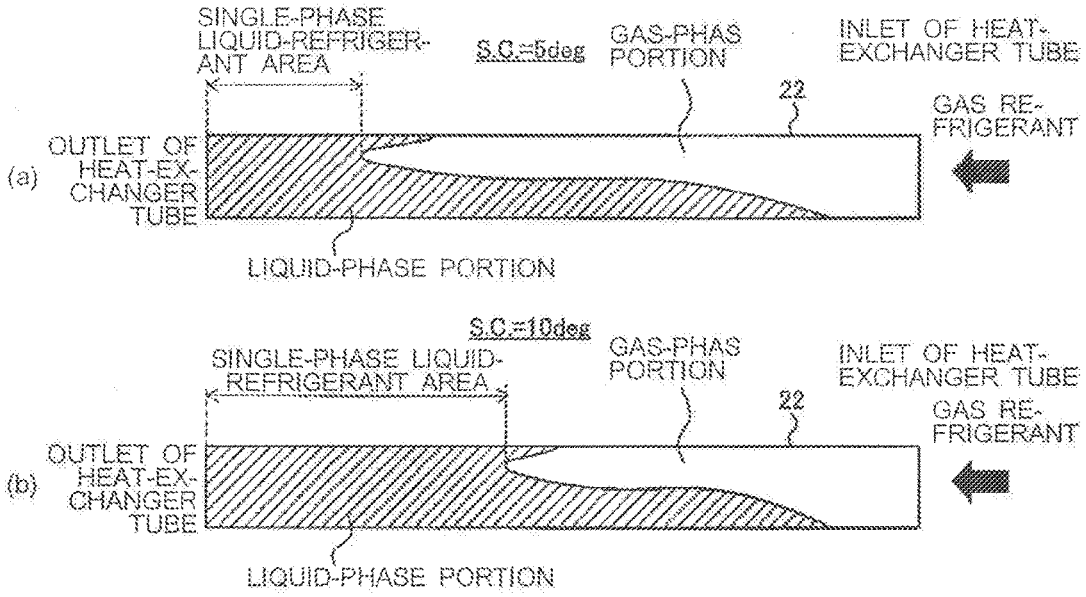
FIG. 47 includes diagrams outlining as a whole the flow of the refrigerant in a heat-transfer tube according to Embodiment 10 of the present invention, specifically, FIG. 47(*a*) illustrates a case where S.C. at the outlet of the heat-transfer tube is 5 degrees, and FIG. 47(*b*) illustrates a case where the S.C. at the outlet of the heat-transfer tube is 10 degrees.

FIG. 47 includes diagrams outlining as a whole the flow of the refrigerant in the heat-transfer tube 22 according to Embodiment 10 of the present invention. FIG. 47(*a*) illustrates a case where the S.C. at the outlet of the heat-transfer tube is 5 degrees. FIG. 47(*b*) illustrates a case where the S.C. at the outlet of the heat-transfer tube is 10 degrees.

The S.C. is defined by the difference between the saturation temperature of the refrigerant and the temperature of the refrigerant at the outlet of the heat-transfer tube. The greater the S.C., the larger the area of the heat-transfer tube 22 that is filled with liquid refrigerant.

If the area filled with liquid refrigerant is large, the area of the heat-transfer tube 22 that is filled with single-phase liquid refrigerant is large. The heat-transfer coefficient of the single-phase liquid refrigerant in the tube is smaller than the heat-transfer coefficient of the gas-liquid two-phase refrigerant. Therefore, if the area of the heat-transfer tube 22 that is filled with single-phase liquid refrigerant becomes large, the efficiency of the outdoor heat exchanger 20 is reduced.

According to Embodiment 10, the air-conditioning apparatus 200 includes the compressor 61, the four-way valve 94, the indoor heat exchanger 63, the expansion device 62, and the outdoor heat exchanger 20 that form a refrigeration cycle circuit through which refrigerant circulates. The air-conditioning apparatus 200 is capable of performing the heating operation and the cooling operation by switching the flow of the refrigerant at the four-way valve 94. The outdoor heat exchanger 20 is the heat exchanger according to any of Embodiments 1 to 6. The air-conditioning apparatus 200 includes the gas-liquid separator 80 provided between the outdoor heat exchanger 20 and the expansion device 62. The air-conditioning apparatus 200 includes the gas bypass pipe 82 that allows the gas refrigerant obtained through the separation by the gas-liquid separator 80 to flow directly to the compressor 61. The air-conditioning apparatus 200 includes the gas-bypass regulating valve 83 provided on the gas bypass pipe 82. The air-conditioning apparatus 200 includes the header-preceding regulating valve 90 provided on the downstream side, in the heating operation, with respect to the gas-liquid separator 80. The air-conditioning apparatus 200 includes the controller 70 configured to control the expansion device 62, the gas-bypass regulating valve 83, and the header-preceding regulating valve 90 in the heating operation such that the quality x of the refrigerant flowing into the second header 10 falls within the range $0.05 \leq x \leq 0.30$, and to control the header-preceding regulating valve 90 in the cooling operation such that the gas-liquid separator 80 is used as a liquid storage.

In such a configuration, the efficiency of the outdoor heat exchanger 20 can be improved either in the cooling operation or in the heating operation. Consequently, the energy efficiency can be improved.

Embodiment 11

Figure 48:
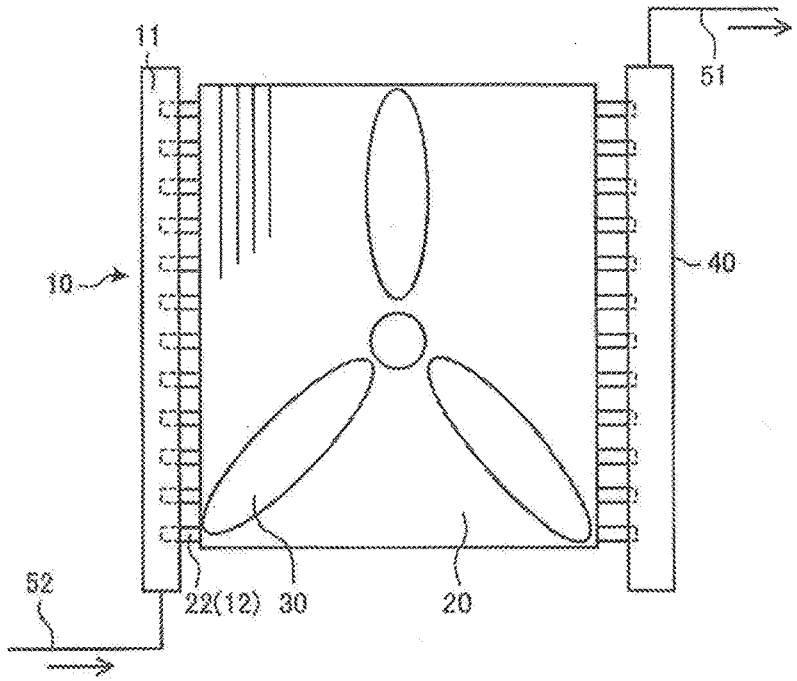
FIG. 48 is a schematic side view of an outdoor heat exchanger according to Embodiment 11 of the present invention.

FIG. 48 is a schematic side view of an outdoor heat exchanger 20 according to Embodiment 11 of the present invention.

As illustrated in FIG. 48, the outdoor heat exchanger 20 includes a side-flow fan 30 and receives wind from a lateral side.

The outdoor heat exchanger 20 including the side-flow fan 30 also has a problem in that liquid refrigerant is less likely to reach the upper part of the second header manifold 11. Therefore, with the use of the second header 10, liquid refrigerant becomes more likely to flow toward the upper side of the second header manifold 11. Hence, the distribution performance can be improved. Accordingly, the efficiency of the outdoor heat exchanger 20 can be improved. Consequently, the energy efficiency can be improved.

REFERENCE SIGNS LIST

10 second header 10*a* second header 10*b* second header 11 second header manifold 12 branch tube 12*a* partition 13 two-way tube 20 outdoor heat exchanger 21 fin 22 heat-transfer tube 23 tube-shape-converting joint 24 tube-shape-converting joint 30 fan 40 first header 42 branch tube 51 outflow pipe 52 inflow pipe 52*a* first inflow pipe 52*b* second inflow pipe 61 compressor 62 expansion device 63 indoor heat exchanger 64 connecting pipe 65 connecting pipe 66 first temperature sensor 67 second temperature sensor 70 controller 80 gas-liquid separator 81 connecting pipe 82 gas bypass pipe 83 gas-bypass regulating valve 84 gas-liquid-separating container 85 branching pipe 86 branching pipe 90 header-preceding regulating valve 91 accumulator 92 accumulator inflow pipe compressor discharge pipe 94 four-way valve 100 outdoor unit 101 casing 102 air inlet 103 air outlet 104 fan guard 200 air-conditioning apparatus 201 indoor unit

The invention claimed is:

1. An air-conditioning apparatus, comprising:

a refrigerant;

a compressor;

an indoor heat exchanger;

an expansion device;

an outdoor heat exchanger that form a refrigeration cycle circuit through which the refrigerant circulates; and a controller that controls the compressor and the expansion device, wherein the outdoor heat exchanger comprises:

a plurality of heat-transfer tubes arranged vertically spaced from each other;

a first header connected to one end of each of the plurality of heat-transfer tubes;

a second header connected to an other end of each of the plurality of heat-transfer tubes; and a plurality of fins joined to each of the plurality of heat-transfer tubes, wherein the second header serves as an evaporator and comprises: a plurality of branch tubes connected to corresponding one of the plurality of heat-transfer tubes, and a header manifold having a flow space that communicates with the plurality of branch tubes and in which gas-liquid two-phase refrigerant flows upward and is discharged into the plurality of branch tubes, wherein the controller controls G [kg/(m$^2$ s)] which is a flow speed of the refrigerant in the flow space of the header manifold of the second header and x which is a quality of the refrigerant flowing into the header manifold in a manner that the refrigerant flowing into the header manifold forms a pattern of annular flow or churn flow and tips of the branch tubes inserted into the header manifold pass through a liquid-phase portion having a thickness δ [m] and reach a gas-phase portion, wherein the thickness δ [m] of the liquid-phase portion is defined as $\delta=G\times(1-x)\times D/(4\rho_L\times U_{LS})$, D is an inside diameter [m] of the header manifold, $\rho_L$ is a liquid density [kg/m$^3$] of the refrigerant, $U_{LS}$ is a reference apparent liquid speed [m/s] that is a maximum value within a range of variation in an apparent gas speed of the refrigerant flowing into the flow space of the header manifold, the reference apparent liquid speed $U_{LS}$ [m/s] being defined as $G(1-x)/\rho_L$.

2. The air-conditioning apparatus of claim 1, wherein:

a reference apparent gas speed $U_{GS}$ [m/s] that is a maximum value within a range of variation in an apparent gas speed of the refrigerant flowing into the flow space of the header manifold satisfies a condition $U_{GS}\geq\alpha\times L\times(g\times D)^{0.5}/(40.6\times D)-0.22\alpha\times(g\times D)^{0.5}$, where α is a void fraction of the refrigerant, L is an entrance length [m], g is a gravitational acceleration [m/s$^2$], and D is the inside diameter [m] of the header manifold, and the void fraction α of the refrigerant is defined as $x/[x+(\rho_G/\rho_L)\times(1-x)]$, where x is the quality of the refrigerant, $\rho_G$ is a gas density [kg/m$^3$] of the refrigerant, and $\rho_L$ is the liquid density [kg/m$^3$] of the refrigerant.

3. The air-conditioning apparatus of claim 2, wherein:

the reference apparent gas speed $U_{GS}$ [m/s] that is the maximum value within the range of variation in the apparent gas speed of the refrigerant flowing into the flow space of the header manifold satisfies a condition $U_{GS}\geq3.1/(\rho_G^{0.5})\times[\sigma\times g\times(\rho_L-\rho_G)]^{0.25}$, where $\rho_G$ is the gas density [kg/m$^3$] of the refrigerant, σ is a surface tension [N/m] of the refrigerant, g is the gravitational acceleration [m/s$^2$], and $\rho_L$ is the liquid density [kg/m$^3$] of the refrigerant.

4. The air-conditioning apparatus of claim 1, wherein:

when a center position of the flow space of the header manifold in a horizontal plane is defined as 0% and a position of a wall surface of the flow space of the header manifold in the horizontal plane is defined as 100% on either side, a tip of each of the branch tubes inserted into the header manifold is positioned in an area within 50% on either side, a reference apparent gas speed $U_{GS}$ [m/s] that is a maximum value within a range of variation in an apparent gas speed of the refrigerant flowing into the flow space of the header manifold satisfies a condition $U_{GS}\geq\alpha\times L\times(g\times D)^{0.5}/(40.6\times D)-0.22\alpha\times(g\times D)^{0.5}$, where α is a void fraction of the refrigerant, L is an entrance length [m], g is a gravitational acceleration [m/s$^2$], and D is an inside diameter [m] of the header manifold, and the void fraction α of the refrigerant is defined as $x/[x+(\rho_G/\rho_L)\times(1-x)]$, where x is a quality of the refrigerant, $\rho_G$ is a gas density [kg/m$^3$] of the refrigerant, and $\rho_L$ is a liquid density [kg/m$^3$] of the refrigerant.

5. The air-conditioning apparatus of claim 4, wherein:

the reference apparent gas speed $U_{GS}$ [m/s] that is the maximum value within the range of variation in the apparent gas speed of the refrigerant flowing into the flow space of the header manifold satisfies a condition $U_{GS}\geq3.1/(\rho_G^{0.5})\times[\sigma\times g\times(\rho_L-\rho_G)]^{0.25}$, where $\rho_G$ is the gas density [kg/m$^3$] of the refrigerant, σ is a surface tension [N/m] of the refrigerant, g is the gravitational acceleration [m/s$^2$], and $\rho_L$ is the liquid density [kg/m$^3$] of the refrigerant.

6. The air-conditioning apparatus of claim 1, wherein:

when a center position of the flow space of the header manifold in a horizontal plane is defined as 0%; a position of a wall surface of the flow space of the header manifold in the horizontal plane is defined as 100% on either side; a direction of insertion of each of the plurality of branch tubes in the horizontal plane is defined as an X direction; and a width direction of each of the plurality of branch tubes that is orthogonal to the X direction in the horizontal plane is defined as a Y direction, tips of all of the plurality of branch tubes are positioned in an area within 50% on either side in the X direction; and center axes of all of the plurality of branch tubes are positioned in an area within 50% on either side in the Y direction.

7. The air-conditioning apparatus of claim 6, wherein:

the tips of all of the plurality of branch tubes are positioned in an area within 25% on either side in the X direction, and the center axes of all of the plurality of branch tubes are positioned in an area within 25% on either side in the Y direction.

8. The air-conditioning apparatus of claim 1, wherein:

when a flow rate [kg/h] of the refrigerant is $M_R$, the quality of the refrigerant flowing into the header manifold in a rated heating operation is x, and an effective passage-section area [$m^2$] of the header manifold is A, the quality x of the refrigerant flowing into the header manifold satisfies a condition $0.05 \leq x \leq 0.30$, and a parameter $(M_R \times x)/(31.6 \times A)$ concerning a thickness of a liquid film formed of the refrigerant falls within a range $0.004 \times 10^6 \leq (M_R \times x)/(31.6 \times A) \leq 0.120 \times 10^6$.

9. The air-conditioning apparatus of claim 8, wherein:

when the flow rate [kg/h] of the refrigerant is $M_R$, the quality of the refrigerant flowing into the header manifold in the rated heating operation is x, and the effective passage-section area [$m^2$] of the header manifold is A, the quality x of the refrigerant flowing into the header manifold satisfies the condition $0.05 \leq x \leq 0.30$, and the parameter $(M_R \times x)/(31.6 \times A)$ concerning the thickness of the liquid film formed of the refrigerant falls within a range $0.010 \times 10^6 \leq (M_R \times x)/(31.6 \times A) \leq 0.120 \times 10^6$.

10. The air-conditioning apparatus of claim 1, wherein:

when the flow rate [kg/h] of the refrigerant is $M_R$ and the quality of the refrigerant flowing into the header manifold in the rated heating operation is x, the quality x of the refrigerant flowing into the header manifold satisfies the condition $0.05 \leq x \leq 0.30$, the inside diameter D [m] of the header manifold falls within a range $0.010 \leq D \leq 0.018$, and a parameter $(M_R \times x)/31.6$ concerning the thickness of the liquid film formed of the refrigerant falls within a range $0.427 \leq (M_R \times x)/31.6 \leq 5.700$.

11. The air-conditioning apparatus of claim 1, wherein:

when the quality of the refrigerant flowing into the header manifold in the rated heating operation is x and the effective passage-section area [$m^2$] of the header manifold is A, the quality x of the refrigerant flowing into the header manifold satisfies the condition $0.05 \leq x \leq 0.30$, the inside diameter D [m] of the header manifold falls within the range $0.010 \leq D \leq 0.018$, and a parameter $x/(31.6 \times A)$ concerning the thickness of the liquid film formed of the refrigerant falls within a range $1.4 \times 10 \leq x/(31.6 \times A) \leq 8.7 \times 10$.

12. The air-conditioning apparatus of claim 1, wherein:

when the quality of the refrigerant flowing into the header manifold in the rated heating operation is x, the quality x of the refrigerant flowing into the header manifold satisfies the condition $0.05 \leq x \leq 0.30$, and the apparent gas speed $U_{SG}$ [m/s] of the refrigerant flowing into the header manifold falls within a range $1 \leq U_{SG} \leq 10$, and the apparent gas speed $U_{SG}$ [m/s] is defined as $U_{SG} = (G \times x)/\rho_G$, where G is the flow speed [kg/($m^2$ s)] of the refrigerant flowing into the header manifold, x is the quality of the refrigerant, and $\rho_G$ is the gas density [kg/($m^3$)] of the refrigerant; and the flow speed [kg/($m^2$ s)] of the refrigerant is defined as $G = M_R/(3600 \times A)$, where $M_R$ is the flow rate [kg/h] of the refrigerant flowing into the header manifold in the rated heating operation, and A is the effective passage-section area [$m^2$] of the header manifold.

13. The air-conditioning apparatus of claim 1, wherein:

the branch tubes include tube-shape-converting joints each converting the tip of a corresponding one of the branch tubes inserted into the header manifold from a flat tubular shape for connection to a corresponding one of flat heat-transfer tubes included in a heat exchanger into a round tubular shape.

14. The air-conditioning apparatus of claim 1, wherein:

the branch tubes are extensions of part of the heat-transfer tube included in the heat exchanger.

15. The air-conditioning apparatus of claim 1, wherein:

the plurality of branch tubes each have a flat tubular shape.

16. The air-conditioning apparatus of claim 1, wherein:

when a pitch between adjacent ones of the plurality of branch tubes is Lp and a length of a stagnation area in an upper part of the header manifold is Lt, a relationship $Lt \geq 2 \times Lp$ is established.

17. The air-conditioning apparatus of claim 1, wherein:

an uppermost one of the plurality of branch tubes is connected to an upper end of the header manifold from an upper side.

18. The air-conditioning apparatus of claim 1, wherein:

the second header is divided into at least two pieces in a height direction, the two pieces being connected to each other on an upstream side in a direction in which the refrigerant flows into the heat exchanger in a heating operation.

19. The air-conditioning apparatus of claim 1, wherein:

the controller controls the compressor or the expansion device such that the quality x of the refrigerant flowing into the second header falls within the range $0.05 \leq x \leq 0.30$ in the rated heating operation.

20. The air-conditioning apparatus of claim 1, further comprising:

a first temperature sensor on a downstream side, in the heating operation, of the indoor heat exchanger;

a second temperature sensor on the indoor heat exchanger; and a controller configured to calculate an outlet temperature difference of the indoor heat exchanger from a temperature detected by the first temperature sensor and a temperature detected by the second temperature sensor in the heating operation, and to control the compressor or the expansion device such that the quality x of the refrigerant flowing into the second header falls within the range $0.05 \leq x \leq 0.30$ in the rated heating operation.

21. The air-conditioning apparatus of claim 1, further comprising:

a gas-liquid separator at a refrigerant flow path between the outdoor heat exchanger and the expansion device;

a gas bypass pipe that allows gas refrigerant obtained through separation by the gas-liquid separator to flow directly to the compressor;

a gas-bypass regulating valve at the gas bypass pipe; and a controller configured to control the gas-bypass regulating valve in accordance with operating conditions such that the quality x of the refrigerant flowing into the second header falls within the range $0.05 \leq x \leq 0.30$.

22. The air-conditioning apparatus of claim 1, further comprising:

a four-way valve, wherein:

the air-conditioning apparatus performs a heating operation and a cooling operation by switching a flow of the refrigerant at the four-way valve, the air-conditioning apparatus further comprises:

a gas-liquid separator at a refrigerant flow path between the outdoor heat exchanger and the expansion device;

a gas bypass pipe that allows gas refrigerant obtained through separation by the gas-liquid separator to flow directly to the compressor;

a gas-bypass regulating valve at the gas bypass pipe;

a header-preceding regulating valve at a downstream side, in the heating operation, of the gas-liquid separator; and a controller configured to control the expansion device, the gas-bypass regulating valve, and the header-preceding regulating valve in the heating operation such that the quality x of the refrigerant flowing into the second header falls within the range $0.05 \leq x \leq 0.30$, and to control the header-preceding regulating valve in the cooling operation such that the gas-liquid separator is used as a liquid storage.

23. The air-conditioning apparatus of claim 1, further comprising:

a header manifold including a flow space that communicates with the plurality of branch tubes and in which gas-liquid two-phase refrigerant flows in from an inlet of the header manifold upward and is discharged into the plurality of branch tubes, at least one of the headers being for use in an operation mode, the operation mode including an operation condition in which the refrigerant flows in a flow pattern such that more gas-phase portion, than liquid-phase portion, of the gas-liquid two-phase refrigerant flowing to the header manifold is present around a center axis of the header manifold, the at least one of the headers including an entrance portion in which the refrigerant flows upward, the entrance portion being provided between the inlet of the header manifold and a branch tube of the branch tubes closest to the inlet, the entrance portion having an entrance length L [m] satisfying a condition $L \geq 5D$, where D is the inside diameter [m] of the header manifold, wherein:

when a center position of the flow space of the header manifold in a horizontal plane is defined as 0% and a position of a wall surface of the flow space of the header manifold in the horizontal plane is defined as 100% on either side, a tip of each of the branch tubes inserted into the header manifold is positioned in an area within 50% on either side, and tips of the branch tubes connected to a lower part of the header manifold are positioned at a part in which more gas-phase portion, than the liquid-phase portion, of the refrigerant is present.

24. The air-conditioning apparatus of claim 23, wherein:

when a center position of the flow space of the header manifold in a horizontal plane is defined as 0%, a position of a wall surface of the flow space of the header manifold in the horizontal plane is defined as 100% on either side, a direction of insertion of each of the plurality of branch tubes in the horizontal plane is defined as an X direction, and a width direction of each of the plurality of branch tubes that is orthogonal to the X direction in the horizontal plane is defined as a Y direction, tips of all of the plurality of branch tubes are positioned in an area within 50% on either side in the X direction; and center axes of all of the plurality of branch tubes are positioned in an area within 50% on either side in the Y direction.

25. The air-conditioning apparatus of claim 23, wherein:

the inflow pipe is attached to the entrance portion such that the inflow pipe is inclined, and a condition $(L2+L3) \geq 6D$ is satisfied where L2 is a combined length [m] of a portion of the entrance portion and a strait portion of the inflow pipe, and L3 is a length [m] of the inclined portion of the inflow pipe.

26. The air-conditioning apparatus of claim 23, wherein in the operation condition, a reference apparent gas speed $U_{GS}$ [m/s] that is a maximum value within a range of variation in an apparent gas speed of the refrigerant flowing into the flow space of the header manifold satisfies a condition $U_{GS} \geq \alpha \times L \times (g \times D)^{0.5}/(40.6 \times D) - 0.22\alpha \times (g \times D)^{0.5}$, where $\alpha$ is a void fraction of the refrigerant, L is an entrance length [m], g is a gravitational acceleration [m/s$^2$], and D is the inside diameter [m] of the header manifold, and wherein the void fraction $\alpha$ of the refrigerant is defined as $x/[x+(\rho_G/\rho_L)\times(1-x)]$, where x is the quality of the refrigerant, $\rho_G$ is a gas density [kg/m$^3$] of the refrigerant, and $\rho_L$ is the liquid density [kg/m$^3$] of the refrigerant.

27. The air-conditioning apparatus of claim 23, wherein:

in the operation condition, the reference apparent gas speed $U_{GS}$ [m/s] that is the maximum value within the range of variation in the apparent gas speed of the refrigerant flowing into the flow space of the header manifold satisfies a condition $U_{GS} \geq 3.1/(\rho_G^{0.5}) \times [\sigma \times g \times (\rho_L - \rho_G)]^{0.25}$, where $\rho_G$ is the gas density [kg/m$^3$] of the refrigerant, $\sigma$ is a surface tension [N/m] of the refrigerant, g is the gravitational acceleration [m/s$^2$], and $\rho_L$ is the liquid density [kg/m$^3$] of the refrigerant.

28. The air-conditioning apparatus of claim 23, wherein:

the branch tubes include tube-shape-converting joints each converting the tip of a corresponding one of the branch tubes inserted into the header manifold from a flat tubular shape for connection to a corresponding one of flat heat-transfer tubes included in a heat exchanger into a round tubular shape.

29. The air-conditioning apparatus of claim 23, wherein:

the branch tubes are extensions of part of the heat-transfer tube included in the heat exchanger.

30. The air-conditioning apparatus of claim 23, wherein:

an uppermost one of the plurality of branch tubes is connected to an upper end of the header manifold from an upper side.

31. The air-conditioning apparatus of claim 23, wherein:

the air-conditioning apparatus is at least one of the indoor heat exchanger and the outdoor heat exchanger.

32. The air-conditioning apparatus of claim 31, wherein:

the at least one of the headers is connected to the outdoor heat exchanger of the refrigeration cycle circuit, a gas-liquid separator is at a refrigerant path between the heat outdoor heat exchanger and the expansion device, a gas-bypass regulating valve is at a gas bypass pipe that allows gas refrigerant obtained through separation by the gas-liquid separator to flow directly to the compressor, and the air-conditioning apparatus is configured to bypass a part of the refrigerant by the gas-bypass pipe under at least one condition in the heating operation to adjust the pattern of flow of the refrigerant.

33. A method of using an air-conditioning apparatus, the air-conditioning apparatus including:

a refrigerant, a compressor, an indoor heat exchanger, an expansion device, an outdoor heat exchanger, that form a refrigeration cycle circuit through which the refrigerant circulates; and a controller that controls the compressor and the expansion device, wherein the outdoor heat exchanger includes:

a plurality of heat-transfer tubes arranged vertically spaced from each other;

a first header connected to one end of each of the plurality of heat-transfer tubes;

a second header connected to an other end of each of the plurality of heat-transfer tubes; and a plurality of fins joined to each of the plurality of heat-transfer tubes, wherein the second header serves as an evaporator and includes:

a plurality of branch tubes connected to corresponding one of the plurality of heat-transfer tubes, and a header manifold having a flow space that communicates with the plurality of branch tubes and in which gas-liquid two-phase refrigerant flows upward and is discharged into the plurality of branch tubes, the method comprising:

controlling, using the controller, G [kg/(m$^2$ s)] which is a flow speed of the refrigerant in the flow space of the header manifold of the second header and x which is a quality of the refrigerant flowing into the header manifold in a manner that the refrigerant flowing into the header manifold forms a pattern of annular flow or churn flow and tips of the branch tubes inserted into the header manifold pass through a liquid-phase portion having a thickness δ [m] and reach a gas-phase portion, wherein the thickness δ [m] of the liquid-phase portion is defined as $\delta=G\times(1-x)\times D/(4\rho_L\times U_{LS})$, D is an inside diameter [m] of the header manifold, $\rho_L$ is a liquid density [kg/m$^3$] of the refrigerant, $U_{LS}$ is a reference apparent liquid speed [m/s] that is a maximum value within a range of variation in an apparent gas speed of the refrigerant flowing into the flow space of the header manifold, the reference apparent liquid speed $U_{LS}$ [m/s] being defined as $G(1-x)/\rho_L$.

34. The method of claim 33, wherein:

a reference apparent gas speed $U_{GS}$ [m/s] that is a maximum value within a range of variation in an apparent gas speed of the refrigerant flowing into the flow space of the header manifold satisfies a condition $U_{GS}\geq\alpha\times L\times(g\times D)^{0.5}/(40.6\times D)-0.22\alpha\times(g\times D)^{0.5}$, where α is a void fraction of the refrigerant, L is an entrance length [m], g is a gravitational acceleration [m/s$^2$], and D is the inside diameter [m] of the header manifold, and the void fraction α of the refrigerant is defined as $x/[x+(\rho_G/\rho_L)\times(1-x)]$, where x is the quality of the refrigerant, $\rho_G$ is a gas density [kg/m$^3$] of the refrigerant, and $\rho_L$ is the liquid density [kg/m$^3$] of the refrigerant.

35. The method of claim 34, wherein:

the reference apparent gas speed $U_{GS}$ [m/s] that is the maximum value within the range of variation in the apparent gas speed of the refrigerant flowing into the flow space of the header manifold satisfies a condition $U_{GS}\geq3.1/(\rho_G^{0.5})\times[\sigma\times g\times(\rho_L-\rho_G)]^{0.25}$, where $\rho_G$ is the gas density [kg/m$^3$] of the refrigerant, σ is a surface tension [N/m] of the refrigerant, g is the gravitational acceleration [m/s$^2$], and $\rho_L$ is the liquid density [kg/m$^3$] of the refrigerant.

36. The method of claim 33, wherein:

when a center position of the flow space of the header manifold in a horizontal plane is defined as 0% and a position of a wall surface of the flow space of the header manifold in the horizontal plane is defined as 100% on either side, a tip of each of the branch tubes inserted into the header manifold is positioned in an area within 50% on either side, a reference apparent gas speed $U_{GS}$ [m/s] that is a maximum value within a range of variation in an apparent gas speed of the refrigerant flowing into the flow space of the header manifold satisfies a condition $U_{GS}\geq\alpha\times L\times(g\times D)^{0.5}/(40.6\times D)-0.22\alpha\times(g\times D)^{0.5}$, where α is a void fraction of the refrigerant, L is an entrance length [m], g is a gravitational acceleration [m/s$^2$], and D is an inside diameter [m] of the header manifold, and the void fraction α of the refrigerant is defined as $x/[x+(\rho_G/\rho_L)\times(1-x)]$, where x is a quality of the refrigerant, $\rho_G$ is a gas density [kg/m$^3$] of the refrigerant, and $\rho_L$ is a liquid density [kg/m$^3$] of the refrigerant.

37. The method of claim 36, wherein:

the reference apparent gas speed $U_{GS}$ [m/s] that is the maximum value within the range of variation in the apparent gas speed of the refrigerant flowing into the flow space of the header manifold satisfies a condition $U_{GS}\geq3.1/(\rho_G^{0.5})\times[\sigma\times g\times(\rho_L-\rho_G)]^{0.25}$, where $\rho_G$ is the gas density [kg/m$^3$] of the refrigerant, σ is a surface tension [N/m] of the refrigerant, g is the gravitational acceleration [m/s$^2$], and $\rho_L$ is the liquid density [kg/m$^3$] of the refrigerant.

38. The method of claim 33, wherein:

when a center position of the flow space of the header manifold in a horizontal plane is defined as 0%; a position of a wall surface of the flow space of the header manifold in the horizontal plane is defined as 100% on either side; a direction of insertion of each of the plurality of branch tubes in the horizontal plane is defined as an X direction; and a width direction of each of the plurality of branch tubes that is orthogonal to the X direction in the horizontal plane is defined as a Y direction, tips of all of the plurality of branch tubes are positioned in an area within 50% on either side in the X direction; and center axes of all of the plurality of branch tubes are positioned in an area within 50% on either side in the Y direction.

39. The method of claim 38, wherein:

the tips of all of the plurality of branch tubes are positioned in an area within 25% on either side in the X direction, and the center axes of all of the plurality of branch tubes are positioned in an area within 25% on either side in the Y direction.

40. The method of claim 33, wherein:

when a flow rate [kg/h] of the refrigerant is $M_R$, the quality of the refrigerant flowing into the header manifold in a rated heating operation is x, and an effective passage-section area [m$^2$] of the header manifold is A, the quality x of the refrigerant flowing into the header manifold satisfies a condition $0.05\leq x\leq0.30$, and a parameter $(M_R\times x)/(31.6\times A)$ concerning a thickness of a liquid film formed of the refrigerant falls within a range $0.004\times10^6\leq(M_R\times x)/(31.6\times A)\leq0.120\times10^6$.

41. The method of claim 40, wherein:

when the flow rate [kg/h] of the refrigerant is $M_R$, the quality of the refrigerant flowing into the header manifold in the rated heating operation is x, and the effective passage-section area [$m^2$] of the header manifold is A, the quality x of the refrigerant flowing into the header manifold satisfies the condition $0.05 \leq x \leq 0.30$, and the parameter $(M_R \times x)/(31.6 \times A)$ concerning the thickness of the liquid film formed of the refrigerant falls within a range $0.010 \times 10^6 \leq (M_R \times x)/(31.6 \times A) \leq 0.120 \times 10^6$.

42. The method of claim 33, wherein:

when the flow rate [kg/h] of the refrigerant is $M_R$ and the quality of the refrigerant flowing into the header manifold in the rated heating operation is x, the quality x of the refrigerant flowing into the header manifold satisfies the condition $0.05 \leq x \leq 0.30$, the inside diameter D [m] of the header manifold falls within a range $0.010 \leq D \leq 0.018$, and a parameter $(M_R \times x)/31.6$ concerning the thickness of the liquid film formed of the refrigerant falls within a range $0.427 \leq (M_R \times x)/31.6 \leq 5.700$.

43. The method of claim 33, wherein:

when the quality of the refrigerant flowing into the header manifold in the rated heating operation is x and the effective passage-section area [$m^2$] of the header manifold is A, the quality x of the refrigerant flowing into the header manifold satisfies the condition $0.05 \leq x \leq 0.30$, the inside diameter D [m] of the header manifold falls within the range $0.010 \leq D \leq 0.018$, and a parameter $x/(31.6 \times A)$ concerning the thickness of the liquid film formed of the refrigerant falls within a range $1.4 \times 10 \leq x/(31.6 \times A) \leq 8.7 \times 10$.

44. The method of claim 33, wherein:

when the quality of the refrigerant flowing into the header manifold in the rated heating operation is x, the quality x of the refrigerant flowing into the header manifold satisfies the condition $0.05 \leq x \leq 0.30$, and the apparent gas speed $U_{SG}$ [m/s] of the refrigerant flowing into the header manifold falls within a range $1 \leq U_{SG} \leq 10$, and the apparent gas speed $U_{SG}$ [m/s] is defined as $U_{SG} = (G \times x)/\rho_G$, where G is the flow speed [kg/($m^2$ s)] of the refrigerant flowing into the header manifold, x is the quality of the refrigerant, and $\rho_G$ is the gas density [kg/($m^3$)] of the refrigerant; and the flow speed [kg/($m^2$ s)] of the refrigerant is defined as $G = M_R/(3600 \times A)$, where $M_R$ is the flow rate [kg/h] of the refrigerant flowing into the header manifold in the rated heating operation, and A is the effective passage-section area [$m^2$] of the header manifold.

45. The method of claim 33, wherein:

the branch tubes include tube-shape-converting joints each converting the tip of a corresponding one of the branch tubes inserted into the header manifold from a flat tubular shape for connection to a corresponding one of flat heat-transfer tubes included in a heat exchanger into a round tubular shape.

46. The method of claim 33, wherein:

the branch tubes are extensions of part of the heat-transfer tube included in the heat exchanger.

47. The method of claim 33, wherein:

the plurality of branch tubes each have a flat tubular shape.

48. The method of claim 33, wherein:

when a pitch between adjacent ones of the plurality of branch tubes is Lp and a length of a stagnation area in an upper part of the header manifold is Lt, a relationship $Lt \geq 2 \times Lp$ is established.

49. The method of claim 33, wherein:

an uppermost one of the plurality of branch tubes is connected to an upper end of the header manifold from an upper side.

50. The method of claim 33, wherein:

the second header is divided into at least two pieces in a height direction, the two pieces being connected to each other on an upstream side in a direction in which the refrigerant flows into the heat exchanger in a heating operation.

51. The method of claim 33, further comprising:

controlling, by the controller, the compressor or the expansion device such that the quality x of the refrigerant flowing into the second header falls within the range $0.05 \leq x \leq 0.30$ in the rated heating operation.

52. The method of claim 33, wherein the air-condition apparatus further includes:

a first temperature sensor provided on a downstream side, in the heating operation, of the indoor heat exchanger; and a second temperature sensor provided on the indoor heat exchanger, the method further comprising calculating, by the controller, an outlet temperature difference of the indoor heat exchanger from a temperature detected by the first temperature sensor and a temperature detected by the second temperature sensor in the heating operation, and to control the compressor or the expansion device such that the quality x of the refrigerant flowing into the second header falls within the range $0.05 \leq x \leq 0.30$ in the rated heating operation.

53. The method according to claim 33, wherein the air-conditioning apparatus further includes:

a gas-liquid separator provided at a refrigerant flow path between the outdoor heat exchanger and the expansion device;

a gas bypass pipe that allows gas refrigerant obtained through separation by the gas-liquid separator to flow directly to the compressor; and a gas-bypass regulating valve provided at the gas bypass pipe, the method further comprising controlling, by the controller, the gas-bypass regulating valve in accordance with operating conditions such that the quality x of the refrigerant flowing into the second header falls within the range $0.05 \leq x \leq 0.30$.

54. The method according to claim 33, wherein the air-conditioning apparatus further includes:

a four-way valve, the air-conditioning apparatus to perform a heating operation and a cooling operation by switching a flow of the refrigerant at the four-way valve, a gas-liquid separator provided at a refrigerant flow path between the outdoor heat exchanger and the expansion device;

a gas bypass pipe that allows gas refrigerant obtained through separation by the gas-liquid separator to flow directly to the compressor;

a gas-bypass regulating valve provided at the gas bypass pipe; and a header-preceding regulating valve provided at a downstream side, in the heating operation, of the gas-liquid separator, the method further comprising:

controlling the expansion device, the gas-bypass regulating valve, and the header-preceding regulating valve in the heating operation such that the quality x of the refrigerant flowing into the second header falls within the range $0.05 \leq x \leq 0.30$, and to control the header-preceding regulating valve in the cooling operation such that the gas-liquid separator is used as a liquid storage.

55. The method according to claim 33, wherein the air-conditioning apparatus further includes:

a header manifold having a flow space that communicates with the plurality of branch tubes and in which gas-liquid two-phase refrigerant flows in from an inlet of the header manifold upward and is discharged into the plurality of branch tubes, the header being for use in an operation mode, the operation mode including an operation condition in which the refrigerant flows in a flow pattern such that more gas-phase portion, than liquid-phase portion, of the gas-liquid two-phase refrigerant flowing to the header manifold is present around a center axis of the header manifold, the header including an entrance portion in which the refrigerant flows upward, the entrance portion being provided between the inlet of the header manifold and a branch tube of the branch tubes closest to the inlet, the entrance portion having an entrance length L [m] satisfying a condition $L \geq 5D$, where D is the inside diameter [m] of the header manifold, wherein, when a center position of the flow space of the header manifold in a horizontal plane is defined as 0% and a position of a wall surface of the flow space of the header manifold in the horizontal plane is defined as 100% on either side, a tip of each of the branch tubes inserted into the header manifold is positioned in an area within 50% on either side, and tips of the branch tubes connected to a lower part of the header manifold are positioned at a part in which more gas-phase portion, than the liquid-phase portion, of the refrigerant is present.

56. The method according to claim 55, wherein:

when a center position of the flow space of the header manifold in a horizontal plane is defined as 0%; a position of a wall surface of the flow space of the header manifold in the horizontal plane is defined as 100% on either side; a direction of insertion of each of the plurality of branch tubes in the horizontal plane is defined as an X direction; and a width direction of each of the plurality of branch tubes that is orthogonal to the X direction in the horizontal plane is defined as a Y direction, tips of all of the plurality of branch tubes are positioned in an area within 50% on either side in the X direction; and center axes of all of the plurality of branch tubes are positioned in an area within 50% on either side in the Y direction.

57. The method according to claim 55, wherein:

the inflow pipe is attached to the entrance portion such that the inflow pipe is inclined, and a condition $(L2+L3) \geq 6D$ is satisfied where L2 is a combined length [m] of a portion of the entrance portion and a strait portion of the inflow pipe, and L3 is a length [m] of the inclined portion of the inflow pipe.

58. The method of claim 55, wherein the operation condition, a reference apparent gas speed $U_{GS}$ [m/s] that is a maximum value within a range of variation in an apparent gas speed of the refrigerant flowing into the flow space of the header manifold satisfies a condition $U_{GS} \geq \alpha \times L \times (g \times D)^{0.5}/(40.6 \times D) - 0.22\alpha \times (g \times D)^{0.5}$, where $\alpha$ is a void fraction of the refrigerant, L is an entrance length [m], g is a gravitational acceleration [m/s$^2$], and D is the inside diameter [m] of the header manifold, and the void fraction $\alpha$ of the refrigerant is defined as $x/[x+(\rho_G/\rho_L) \times (1-x)]$, where x is the quality of the refrigerant, $\rho_G$ is a gas density [kg/m$^3$] of the refrigerant, and $\rho_L$ is the liquid density [kg/m$^3$] of the refrigerant.

59. The method of claim 55, wherein:

the reference apparent gas speed $U_{GS}$ [m/s] that is the maximum value within the range of variation in the apparent gas speed of the refrigerant flowing into the flow space of the header manifold satisfies a condition $U_{GS} \geq 3.1/(\rho_G^{0.5}) \times [\sigma \times g \times (\rho_L - \rho_G)]^{0.25}$, where $\rho_G$ is the gas density [kg/m$^3$] of the refrigerant, $\sigma$ is a surface tension [N/m] of the refrigerant, g is the gravitational acceleration [m/s$^2$], and $\rho_L$ is the liquid density [kg/m$^3$] of the refrigerant.

60. The method of claim 55, wherein:

the branch tubes include tube-shape-converting joints each converting the tip of a corresponding one of the branch tubes inserted into the header manifold from a flat tubular shape for connection to a corresponding one of flat heat-transfer tubes included in a heat exchanger into a round tubular shape.

61. The method of claim 55, wherein:

the branch tubes are extensions of part of the heat-transfer tube included in the heat exchanger.

62. The method of claim 55, wherein:

an uppermost one of the plurality of branch tubes is connected to an upper end of the header manifold from an upper side.

63. The method according to claim 55, wherein:

the air-conditioning apparatus is at least one of the indoor heat exchanger and the outdoor heat exchanger.

64. The method according to claim 63, wherein:

the header is connected to the outdoor heat exchanger of the refrigeration cycle circuit, there is a gas-liquid separator at a refrigerant path between the heat outdoor heat exchanger and the expansion device, there is a gas-bypass regulating valve at a gas bypass pipe that allows gas refrigerant obtained through separation by the gas-liquid separator to flow directly to the compressor, and the method further comprising bypassing a part of the refrigerant by the gas-bypass pipe under at least one condition in the heating operation to adjust the pattern of flow of the refrigerant.

* * * * *